US005556251A

United States Patent [19]

Hiroi et al.

[11] Patent Number: 5,556,251

[45] Date of Patent: Sep. 17, 1996

[54] SHEET FINISHER

[75] Inventors: Masakazu Hiroi; Yoshifumi Takehara, both of Yokohama, Japan

[73] Assignee: Canon Kabushiki Kaisha, Tokyo, Japan

[21] Appl. No.: 465,612

[22] Filed: Jun. 5, 1995

Related U.S. Application Data

[63] Continuation of Ser. No. 17,372, Feb. 12, 1993, abandoned.

[30] Foreign Application Priority Data

| | | | |
|---|---|---|---|
| Feb. 12, 1992 | [JP] | Japan | 4-059501 |
| Feb. 12, 1992 | [JP] | Japan | 4-059502 |
| Feb. 12, 1992 | [JP] | Japan | 4-059503 |
| May 22, 1992 | [JP] | Japan | 4-130832 |

[51] Int. Cl.[6] ..... B65H 31/30

[52] U.S. Cl. ..... 414/790.3; 414/907; 270/58.19; 270/58.27; 270/58.28; 271/221; 271/288; 271/292

[58] Field of Search ..... 414/791, 788, 414/907, 790.3, 789.9; 270/53, 58; 271/189, 287, 288, 289, 292–295, 297, 298, 221

[56] References Cited

U.S. PATENT DOCUMENTS

| | | | |
|---|---|---|---|
| 3,995,748 | 12/1976 | Looney | 271/293 X |
| 4,295,733 | 10/1981 | Janssen | 414/791 X |
| 4,385,827 | 5/1983 | Naramore | 271/292 X |
| 4,547,112 | 10/1985 | Steinhart | 414/791 X |
| 4,687,191 | 8/1987 | Stemmle | 271/293 X |
| 4,834,360 | 5/1989 | Acquaviva . | |
| 4,847,656 | 7/1989 | Kuno et al. . | |
| 4,917,364 | 4/1990 | Iida et al. | 270/37 |
| 4,930,761 | 6/1990 | Naito et al. | 270/53 |
| 4,965,629 | 10/1990 | Hiroi et al. | 355/50 |
| 4,973,041 | 11/1990 | Yamasaki | 271/288 |
| 5,011,130 | 4/1991 | Naito et al. | 271/288 |
| 5,035,412 | 7/1991 | Hiroi | 271/294 X |
| 5,106,076 | 4/1992 | Fujita | 271/294 |
| 5,186,445 | 2/1993 | Nakanishi et al. | 270/58 |
| 5,236,185 | 8/1993 | Taneda | 270/53 |
| 5,345,303 | 9/1994 | Hiroi et al. | 271/288 |

FOREIGN PATENT DOCUMENTS

| | | |
|---|---|---|
| 4039001 | 6/1991 | Germany . |
| 4101401 | 7/1991 | Germany . |

*Primary Examiner*—H. Grant Skaggs
*Attorney, Agent, or Firm*—Fitzpatrick, Cella, Harper & Scinto

[57] ABSTRACT

A sheet post-processing apparatus includes at least one tray for stacking discharged sheets; a stacker, disposed adjacent to the tray, for receiving a set of sheets from the tray; a controller operable in one of a first mode in which the set of sheets is transferred to the stacker and a second mode in which the set of sheets remains on the tray; and a retractor for retracting the stacker by relative movement between the tray and the stacker when the second mode is selected.

25 Claims, 40 Drawing Sheets

SHEET FINISHER

This application is a continuation of application Ser. No. 08/017,372 filed Feb. 12, 1993 now abandoned.

FIELD OF THE INVENTION AND RELATED ART

The present invention relates to a sheet post-processing apparatus, and more particularly to a sheet post-processing apparatus for sheets discharged from an image forming apparatus such as a copying machine, a laser beam printer or other printer, and which are sequentially sorted and accommodated on sheet receiving trays or bins, and to an image forming apparatus having the sheet post-processing apparatus.

The present invention is not limited to a sorter provided with a plurality of bin trays, but is applicable to a sheet post-processing apparatus having only one tray.

Conventionally, a sheet sorting apparatus (mainly sorter) sorts sheets in bins which are arranged vertically or horizontally.

In a usual sorter for sorting particularly a plurality of copy sets, an operator takes the finished copy sheets from the front or side of the sorter one-by-one or together.

A limitless sorter is known in which a number of sets of copy sheets exceeding the number of bins are automatically stacked on another stacker.

In this limitless sorter, even if there are only twenty bins, the number of sets (60 for example) exceeding 21, are automatically conveyed out from the bins onto a stacker. Accordingly, a great number of sets of copies can be processed with a simple structure. This is very advantageous for the operator. However, it certainly requires a time period for taking the sheets from the bins to the stacker. In addition, in this construction, it is possible to take out sheets immediately from the side other than having the stacker. However, even if an attempt is made to take sheets out of the stacker side, it is not possible to do so because of the existence of the stacker.

SUMMARY OF THE INVENTION

Accordingly, it is a principal object of the present invention to provide a sheet post-processing apparatus which permits the sets of sheet to be taken out without difficulty.

It is another object of the present invention to provide a sheet post-processing apparatus in which the alignment of the sheet sets on the tray and the discharging of the sheet sets from the tray, are easy.

It is a further object of the present invention to provide a sheet post-processing apparatus in which the sheets aligned on a tray can be stapled in good order.

In an embodiment of the present invention, there are selectable modes, in one of which the sheets are automatically discharged from the tray to a stacker and in another of which the operator is permitted to take sets of sheets out by himself (manual mode).

According to an aspect of the present invention there is provided a sheet post-processing apparatus, comprising: at least one tray means for stacking discharged sheets; stacking means, disposed adjacent to the at least one tray means, for receiving a set of sheets from the tray means; control means operable in a first mode in which the set of sheets is transferred to the stacking means and a second mode in which the set of sheets remains on the tray means; and means for retracting the stacking means by relative movement between said tray means and said stacking means when the second mode is selected.

According to another aspect of the present invention, there is provided an image forming apparatus, comprising: an image forming station; at least one tray means for stacking discharged sheets from said image forming station; stacking means, disposed adjacent to the at least one tray means, for receiving a set of sheets from the tray means; control means operable in a first mode in which the set of sheets is transferred to the stacking means and a second mode in which the set of sheets remains on the tray means; and means for retracting the stacking means by relative movement between the tray means and said stacking means when the second mode is selected.

According to a further aspect of the present invention, there is provided a sheet post-processing apparatus, comprising: a plurality of single tray means for stacking discharged sheets; stacking means, disposed adjacent to the plurality of tray means for receiving a set of sheets from the tray means; means for providing number information relating to the number of discharged sheets; control means operable in a first mode in which the set of sheets is transferred to the stacking means and a second mode in which the set of sheets remains on the tray means; and wherein when the number information is smaller than the number of the tray means, second mode is selected.

According to a further aspect of the present invention, there is provided an image forming apparatus, comprising: image an forming station; a plurality of single tray means for stacking discharged sheets from the image forming station; stacking means, disposed adjacent to the plurality of tray means, for receiving a set of sheets from the tray means; means for providing number information relating to the number of discharged sheets; control means operable in a first mode in which the set of sheets is transferred to the stacking means and a second mode in which the set of sheets remains on the tray means; and wherein when the number information is smaller than the number of tray means, the second mode is selected.

According to a further aspect of the present invention, there is provided a sheet post-processing apparatus, comprising; a plurality of single tray means for stacking discharged sheets; stacking means, disposed adjacent to the plurality of tray means, for receiving a set of sheets from the tray means; means for providing number information relating to the number of discharged sheets; control means operable in a first mode in which the set of sheets is transferred to the stacking means and a second mode in which the set of sheets remains on the tray means; and wherein when the number information is smaller than a predetermined number, the second mode is selected.

According to a yet further object of the present invention, there is provided an image forming apparatus, comprising: an image forming station; a plurality of single tray means for stacking discharged sheets from the image forming station; stacking means, disposed adjacent to the plurality of tray means, for receiving a set of sheets from the tray means; means for providing number information relating to the number of discharged sheets; control means operable in a first mode in which the set of sheets is transferred to the stacking means and a second mode in which the set of sheets remains on the tray means; and wherein when the number information is smaller than a predetermined number, the second mode is selected.

According to the present invention, the automatic and manual modes are selectable. Therefore, the sets of sheets can be taken out properly depending on the number of sets. For this reason, it is efficient.

For example, when number of the trays is 20 bins, and a number of copies less than 20 sets are required, or when only a few copy sets are required irrespective of the number of bins, it is possible for the operator to directly take the sheets out from the bins, without stacking them on the stacker. In the latter case, it is possible that they are stacked on the stacker if the required number is 18, but they are not stacked if the number is less than 18.

Where the stacker is retractable, the sets of sheets can easily be taken out from the bin trays.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 15, including

DESCRIPTION OF THE PREFERRED EMBODIMENTS

Embodiments of the present invention will be described referring to the accompanying drawings.

Figure 1:
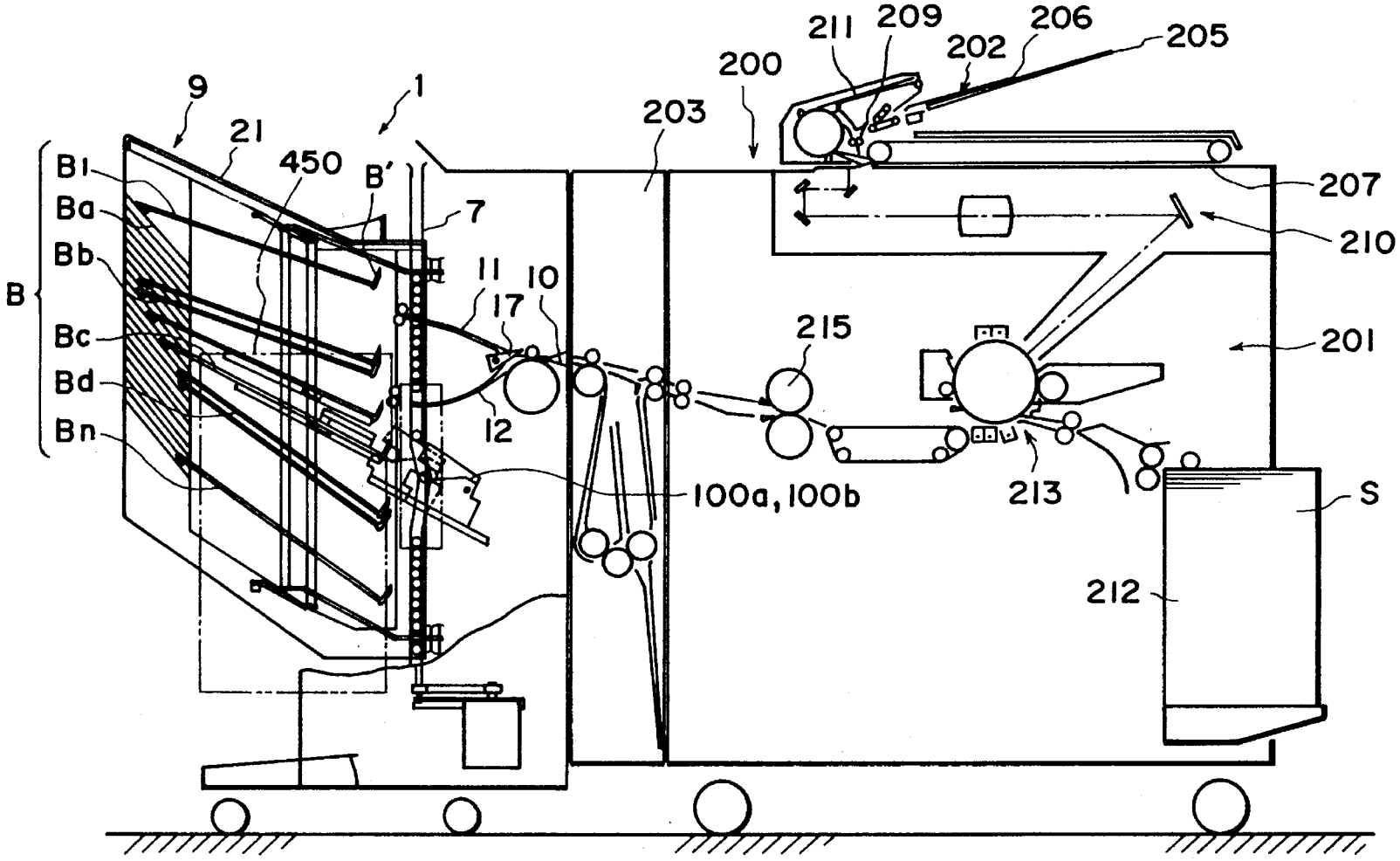
FIG. 1 is a general arrangement of an image forming apparatus using a sheet post-processing apparatus according to the present invention.

Referring to FIG. 1, a copying apparatus 200 comprises a main assembly 201 of the copying apparatus, an automatic document feeder disposed at an upper portion of the copying apparatus 201, a sheet folder 203 disposed at a side of the main assembly 201 (sheet discharging side), a sorter 1 disposed downstream thereof, and a stacker juxtaposed with the sorter.

The sorter and stacker are connected independently and respectively.

The stacker may be disposed in the sorter.

An original 206 stacked on an original stacker 205 of the automatic document feeder 201 is separated sequentially from the bottom of the stack, and is fed onto a platen glass 207 of the main assembly 201 along a passage 209. It is read by an optical system 210 of the main assembly 201. After it is read, it is discharged through a path 211 from the platen glass 207 onto the topmost surface of the original stacker 205. A sheet S is fed from a deck 212, and is subjected to an image forming operation in an image forming station 213. The image is fixed by a fixing device 215. Generally, it simply passes through the sheet folding device 203, and is fed to a sheet inlet 10 of the sorter 1.

Figure 2:
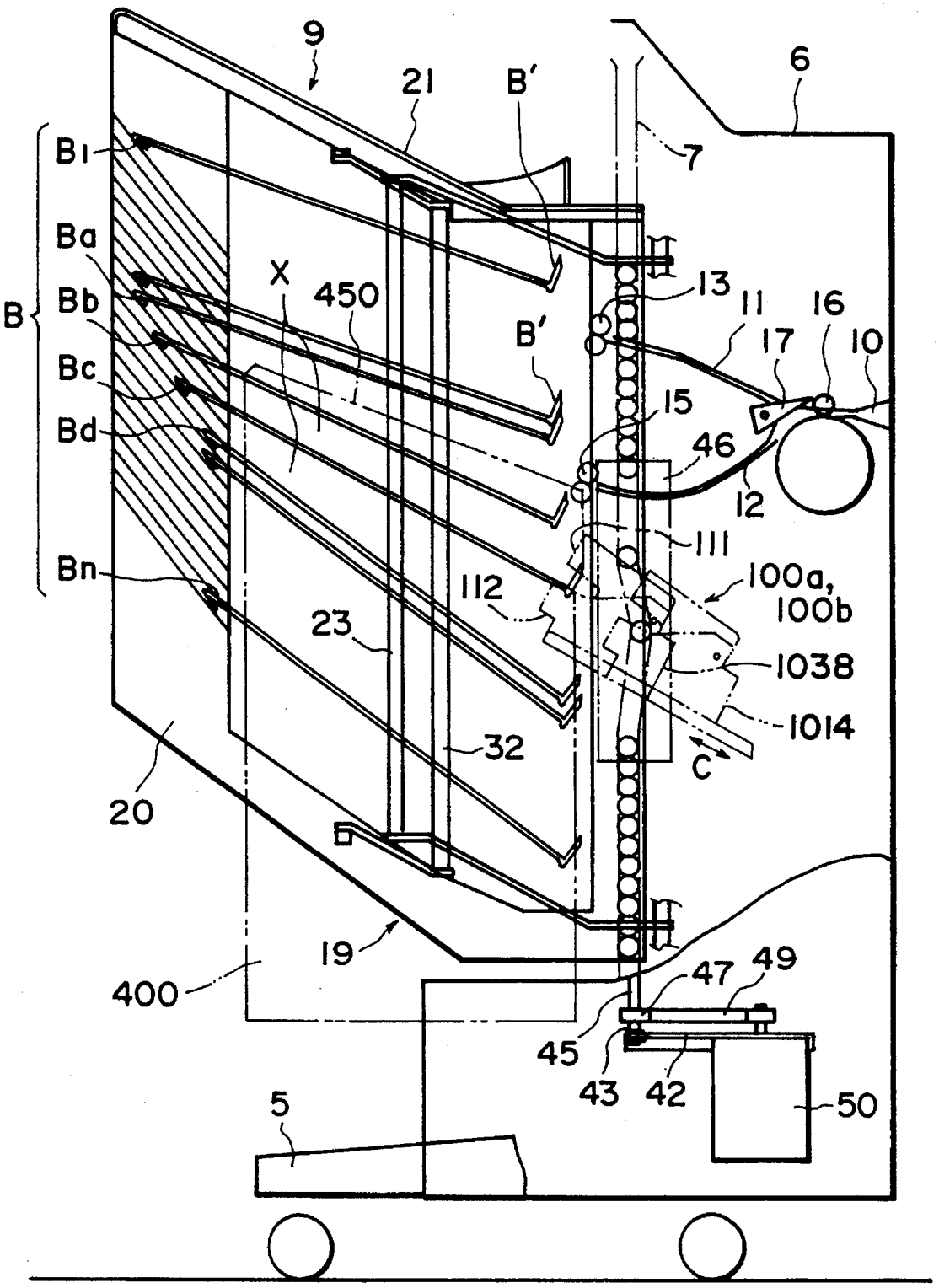
FIG. 2 is a schematic sectional view of the sheet post-processing apparatus according to an embodiment of the present invention.
Figure 3:
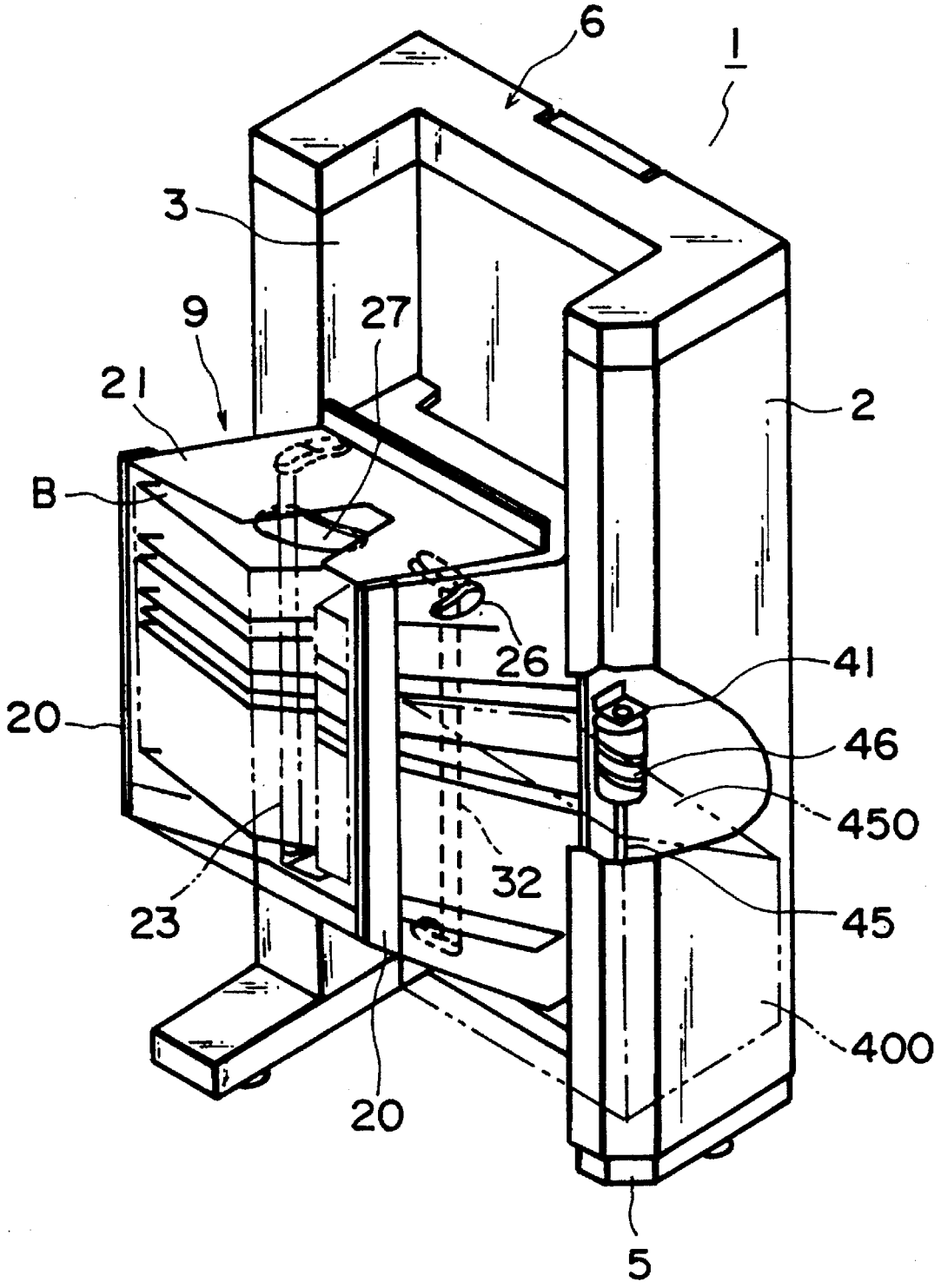
FIG. 3 is a perspective view of a sheet post-processing apparatus according to an embodiment of the present invention.

As shown in FIGS. 2 and 3, a sorter 1 comprises a sorter main assembly 6 including a pair of front and rear plates 3, a base 5, a cover 2, and a bin unit 9.

The sorter main assembly 6 is provided with a sheet inlet 10 for receiving a sheet S discharged from the main assembly 201 of the copying machine. From the sheet inlet 10 toward the bin unit 9, a first sheet passage 11 is extended. A second sheet passage 12 branches out from the first sheet conveyance passage 11. Downstream of the first sheet passage 11, there is an upper discharging roller pair 13 for discharging a non-sorted sheet. Downstream of a second sheet conveying passage 12, there is disposed a lower discharging roller pair 15 for discharging a sorted sheet.

An inlet roller pair 16 and a deflector 17 are disposed at the branch for the first and second sheet passages 11 and 12. When the non-sorting mode (the mode which does not sort the sheets) is selected, the deflector 17 displaced so that it guides the sheet S to the first sheet conveying passage 11. When the sorting mode (the mode which sorts the sheets) is selected, it is displaced so as to introduce the sheet S to the second sheet passage 12.

Figure 4:
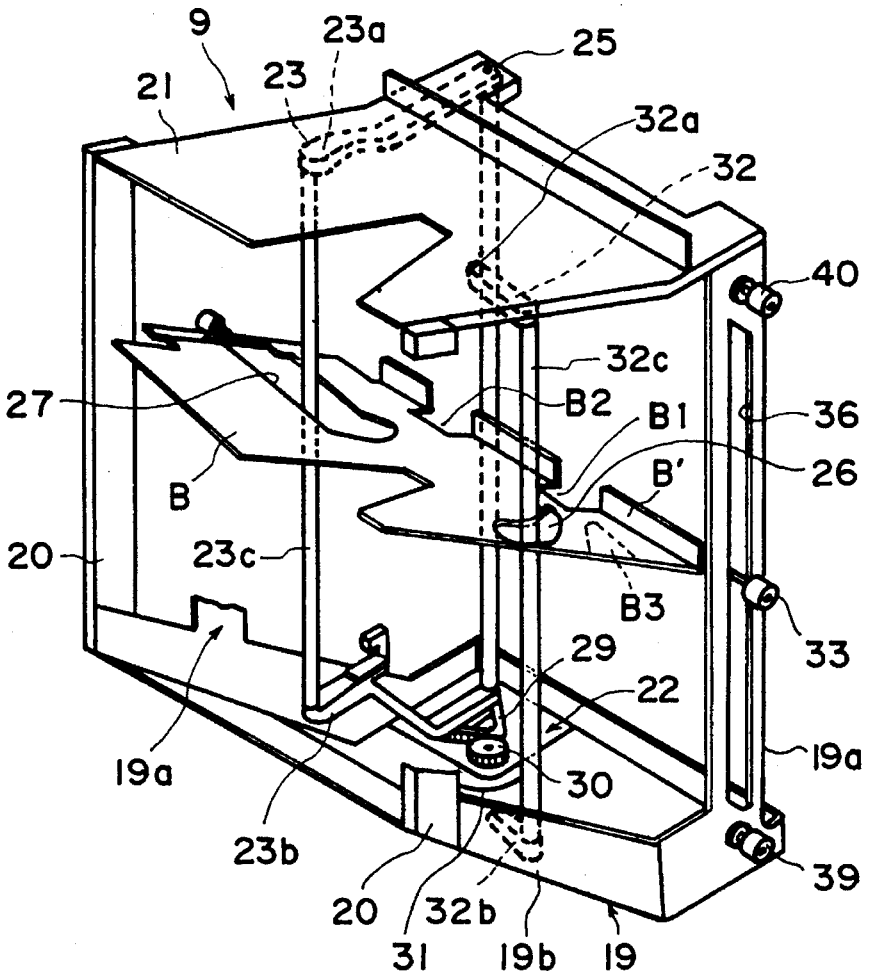
FIG. 4 is a perspective view of a bin unit of a sheet post-processing apparatus according to an embodiment of the present invention.

As illustrated in detail in FIG. 4, the bin unit 9 is provided with a bin frame 19 comprising a standing portion 19*a* and a bottom portion 19*b*, at each of front and rear sides.

At a tip end of the bottom portion 19*b* of the bin frame 19, there is mounted a bin slider 20. In addition, the standing portion 19*a* and the bin slider 20 of the bin frame 19 are fixedly mounted on a bin cover 21.

A supporting plate 22 is securedly fixed to the rear side at a base portion of the bin frame 19. An alignment rod 23*c* is vertically fixed to the end portions of the upper and lower arms 23*a* and 23*b* which are rotatable about a rotational shaft 25 on the supporting plate 20 and this bin cover 21. In the manner, an alignment means 23 is constituted.

Through cut-away portions 27 formed in bins B, the aligning rod 23*c* extends, and is operable to align the sheets on the bin B toward the front side.

A sector gear 29 is mounted on the supporting plate 22 for rotation about the rotational shaft 25. The lower arm 23*b* is fixedly mounted on the sector gear 29. A pinion 30 meshing with the sector gear 29 is mounted to a pulse motor 31 fixed on the bottom side of the supporting plate 20.

Figure 7:
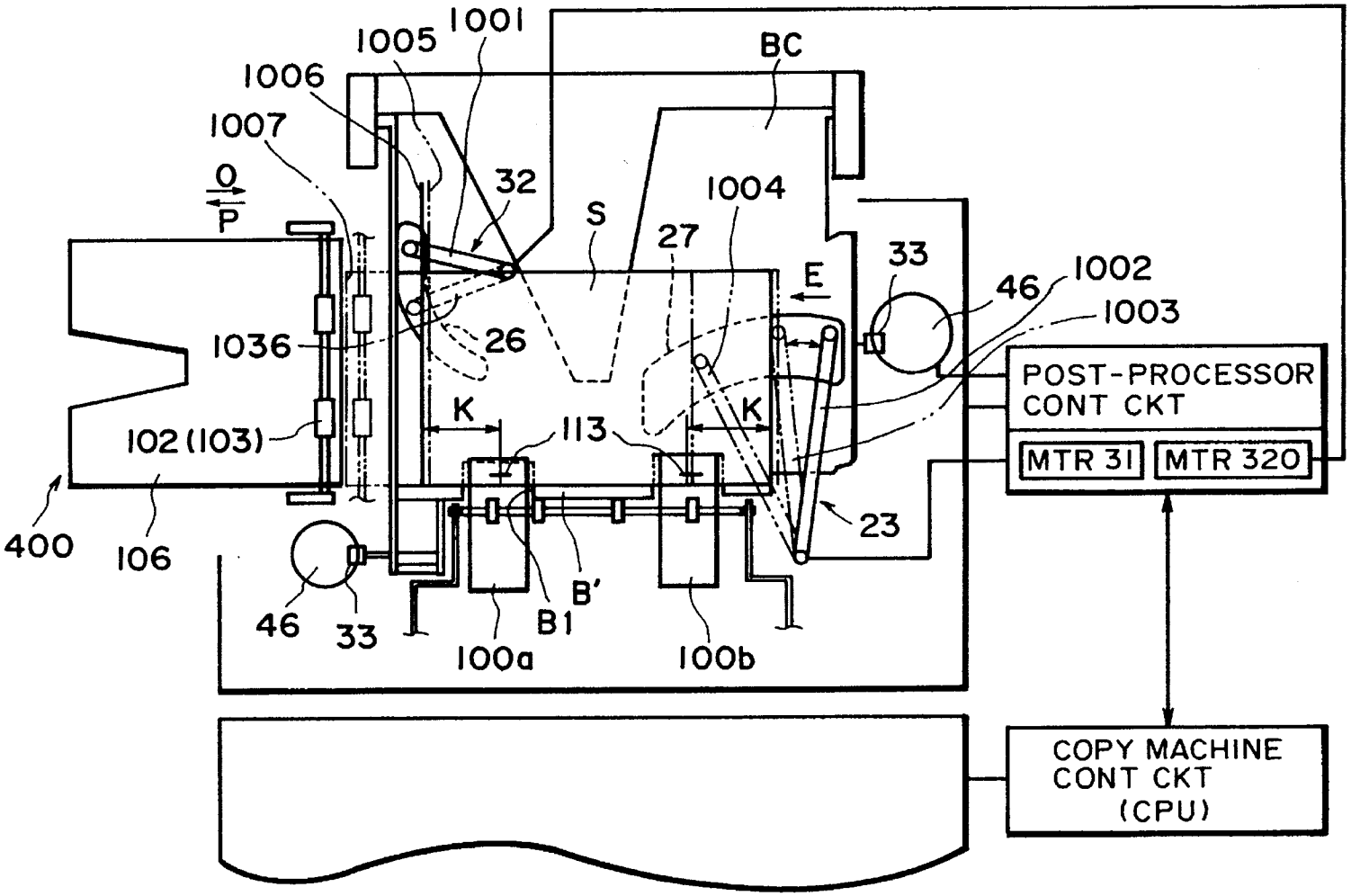
FIG. 7 is a top plan view of a sheet post-processing apparatus according to an embodiment of the present invention.

An alignment reference rod 23*c* is fixed to the end portion of the upper arm 32 rotatably supported at the bottom portion of the bin cover 21 and the end portion of the lower arm 32*b* rotatably supported and extended vertically at the left and front side of the bin frame 19. In this manner, the alignment reference member 32 is constituted. The reference member extends through the cut-away portions 26 of the bins, and it is driven by an unshown driving means, so that it is movable between an alignment reference position 1036 (FIG. 7) and a retracted position 1001 (FIG. 7).

Figure 5:
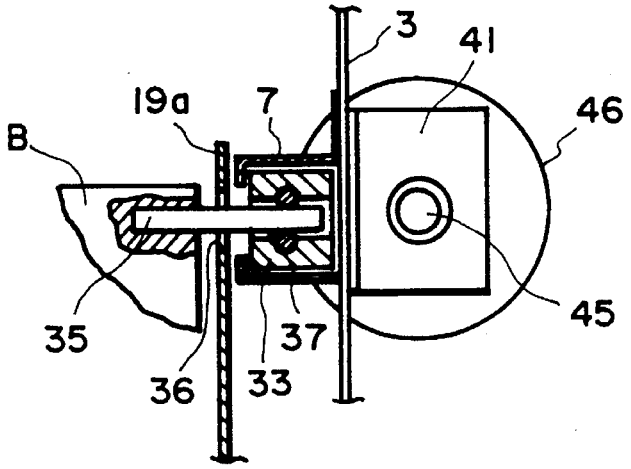
FIG. 5 is a detailed illustration of the roller and a lead cam according to an embodiment of the present invention.

One end portion of the bins B accommodated in the bin unit 9 are carried movably on a comb like portion of the bin slider 20 (FIG. 3), and as shown in FIG. 5, pins 35 are fixedly secured to the front and rear of the base side end. Trunnions 33 are rotatably supported on the pins 35. Each pin 35 extends through a slit 36 formed in the front and rear standing portion (pin support) 19*a*. Between the pin 35 and the trunnion 33, an O-ring 37 is mounted as a buffer material. As shown in FIG. 5, the trunnion 33 is mounted so as to be overlaid on a guide rail 7. The bottommost trunnion 33 is in contact with a lower guiding roller 35 which is rotatably supported on the standing portion 19 (not shown in the rear side) of the bin frame 19 of FIG. 4. Each bin B is supported at an interval equal to the diameter of the trunnion 33 to the bin unit 9. In this structure, the topmost and bottommost trunnions 33 do not have any bin, although they have respective trunnions.

The bin B is inclined so as to be raised at one end, and a stopper B' is provided for the base side end portion of the lowermost part.

The upper guide roller 40 and the lower guide roller 39 of the bin unit 9 are engaged to the guide rail 7, and they are movable vertically along the guide rail 7.

On the other hand, adjacent the lower discharging roller pair 15, as shown in FIGS. 2 and 7, two electric staplers 100*a*, 100*b* for stapling the sheets S accommodated in the bin Bc are disposed for retracting movement in the direction C by driving means at a position perpendicular to the sheet receiving direction. Normally, they are retracted at the position 1014 (FIG. 2) so as to avoid interference with vertical movement of the bin B. When a set of sheets S on a bin B is to be stapled, the set of sheets is moved to a position 1038 (FIG. 2), and the sheets S are stapled. After the completion of the stapling operation, the electric staplers 100*a* and 100*b* return to the position 1014 by an unshown driving means.

The electric staplers 100*a* and 100*b* carry out the stapling operation by rotation of an unshown motor. When the stapling operation is to be carried out for a plurality of bins B, the bin unit 9 moves through a one bin interval after each detection of a stapling completion signal for the sheets S on one bin B, and the sheets S on the next bin then are stapled. As shown in FIG. 4, each bin B is provided with cut-away portions B1 and B2 for permitting reception of the staplers 100*a* and 100*b* to avoid interference with the staplers 100*a* and 100*b*.

Since there are provided two electric staplers 100*a* and 100*b*, each one is selectively operable (one position stapling and two position stapling with two staplers), in accordance with selection by the operator. As shown in FIGS. 3 and 5, a cam shaft holder 41 is mounted to each of the front and rear plates 3 faced to the pair of the lower discharging rollers 15 and the staplers 100*a* and 100*b*. As shown in FIG. 2, bearings 43 are provided on a motor table 42, and the lead cam shafts 45 are supported by the camshaft holder 41 and the bearing 45, and a lead cam 46 is fixed to the lead camshaft 45. A pulley 47 is fixed to the shaft 45, and a shift motor 50 for driving the pulley 47 with a belt 49 is mounted to the bottom surface of the motor table 42 (FIG. 2).

Figure 6:
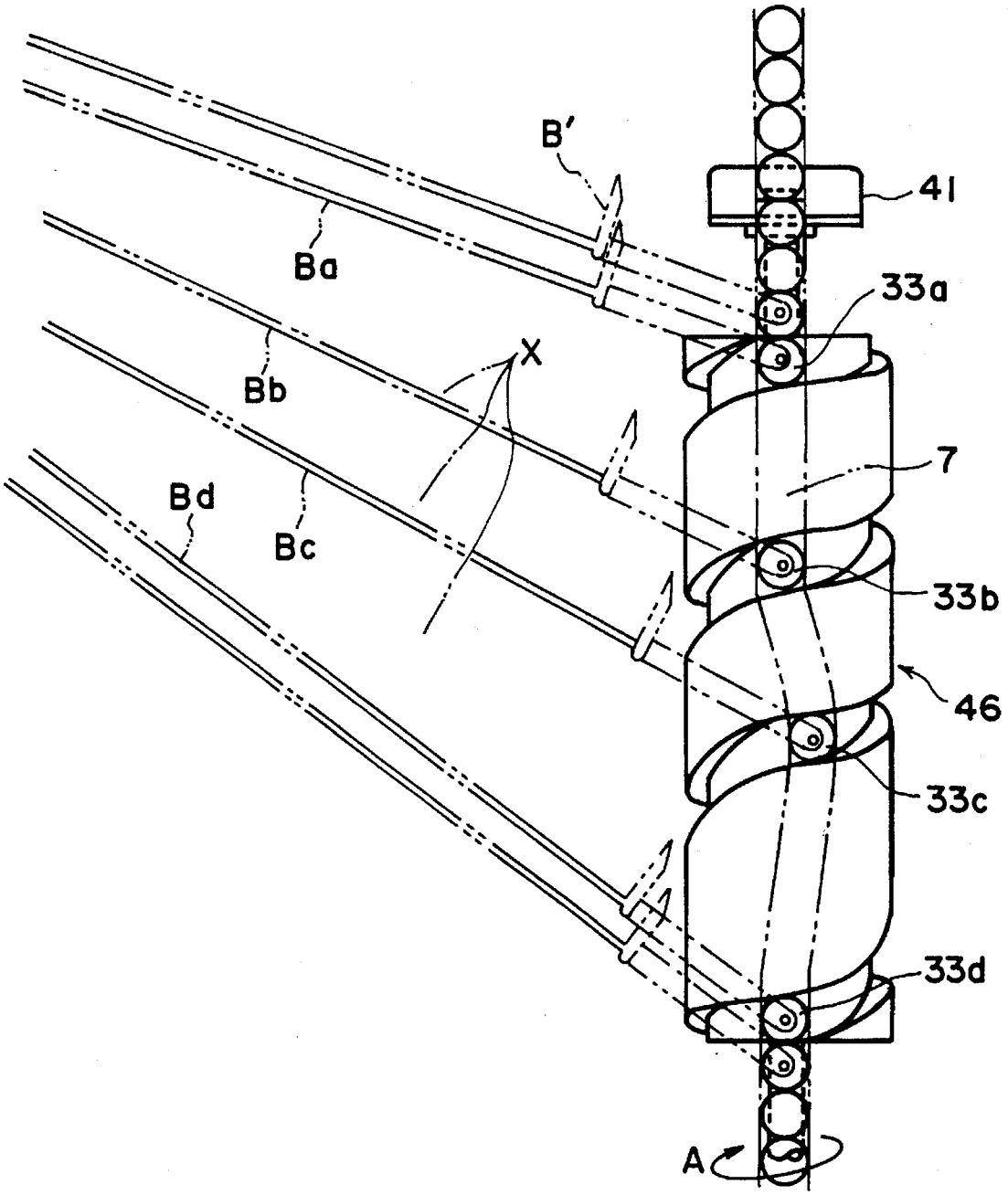
FIG. 6 is a partial view of a driver for the lead cam and the bin in an embodiment of the present invention.

The lead cam 46 faces to the lower discharging roller pair 15 and, as shown in FIG. 6, trunnions 33*a*–33*d* of the bins Ba–Bd are carried on the helical groove of the lead cam 46, so that the spacing interval between the adjacent bins is expanded, by which a sheet S is easily received by the lower discharging roller pair 15, and also, the electric staplers 100*a* and 100*b* are easily operated.

The guide rail 7 is bent so that the bin Bc, for example, is projected toward the front for the same purpose.

As shown in FIG. 7, adjacent a left side of a taking-out bin of the sorter 1 (the bin Bc in this embodiment), a sheet receiving tray 106 is disposed slightly below. The tray 106 moves up and down depending on the state of the stack thereon. The tray is provided with sheet taking-out rollers 102 and 103 so as to permit the sheets to be taken out of the bin Bc, and the sheets are then stacked on the tray 106. The operation thereof will be described in detail hereinafter.

The apparatus of this embodiment has the structure described above, and therefore, a sheet S discharged from the main assembly 201 of the copying machine is introduced from the sheet inlet 10 in the non-sorting mode, it is introduced into the first or second sheet conveying passage guided by a deflector 17 in the sheet sorting mode.

When the non-sorting mode is selected, the sheet is discharged to and accommodated by a bin cover 21 which is the first bin of the bin unit 9, by the upper discharging roller pair 13 through the sheet conveyance passage 11.

When the sorting mode is selected, in the bin unit 9, the trunnion 33 is moved by the helical groove 46*a* of lead cam 46 by the rotation of the lead cam 46, so that as shown in FIG. 6, gaps X which are larger than the spacing interval between other adjacent bins are formed at three positions, at a position between the position facing the lower discharging pair 15 and the bin B facing the stapler, and the upper guiding roller 40 or the lower guiding roller are moved by the moving trunnion 33. A sheet S is discharged to and accommodated in the opened next bin B by the lower discharging roller pair 15 through the second sheet passage 12, in the order from the first bin B1.

For example, when a sheet S is discharged to the bin Bb moved to the position facing the lower discharging roller pair 15, the sheet S is moved to the rear end stopper B' by its own weight on the bin Bb inclined with the bottom end stopper B' side down.

As shown in FIGS. 4 and 7, since the alignment reference member 32 is already moved to the reference position of the sheet S (FIG. 7, 1036) by the driving means (motor 320), the aligning member 23, in response to the pulse signal generated in accordance with the size of the sheet S, is moved through a predetermined distance to a position 1003 in a direction of an arrow E from the stand-by position 1002. Then, the alignment member 23 returns to the stand-by position 1002 to be prepared for the discharge of the next sheet S. Even when the sheet S is discharged with one side alignment along a line 1005 shown in FIG. 7 from the main assembly 201 of the copying machine, it is aligned with the line 1006. The above operation is repeated, so that a plurality of sheets S are accommodated on a bin Bb with the lateral edges thereof abutted to the alignment reference member 32 and with the trailing edges abutted to the stopper B' of the bin.

The alignment member 23 extends through all the bins B, and sheets S accommodated in the other bins B are similarly aligned.

The stapling operation for sheets S discharged to and accommodated on a bin B, is selectable. If the stapling mode is not selected, and the operation of the sorter 1 temporarily stops.

When the stapling mode is selected, the electric staplers 100*a* and 100*b*, in response to a staple starting signal of an unshown control means, is moved to the stapling position 1038 from the position 1014, as shown in FIG. 2.

At this time, as shown in FIG. 2, for example, the head portions 111 of the electric staplers 100*a* and 100*b* enter the openings X formed between the bin Bc for receiving the sheet S to be stapled and the upper bin Bb, and an anvil 112 enters the lower expanded opening X to the stapling position.

When the electric staplers 100*a* and 100*b* move to an stapling position, the unshown control means produces a stapling permission signal, in response to which the electric staplers 100*a* and 100*b* operate to staple sheets S, as shown in FIG. 7.

Upon completion of the stapling operation with the stapler 113, the electric staplers 100*a* and 100*b* are returned to the positions 1014 (FIG. 2), and the stapling operation for one bin is completed. In a stapling operation for a plurality of bins B, it is most efficient if the stapling operation is carried out in order from the bin B which last received a sheet.

At this time, the series of operations of the electric staplers 100*a* and 100*b* are carried out in respect to a bin shift completion signal, and the next bin shifting operation is carried out in response to a completion signal for the series of operation of the electric staplers 100*a* and 100*b*. By repeating this, the stapling operations are automatically carried out and completed.

In this embodiment, the bin frame 19 of the bin unit 9 is provided with a alignment reference member 32, and the alignment member 23 is mounted to the bin unit 9. Therefore, sheets S in the bins B can be assuredly aligned. The sheet aligning operation is carried out by moving an aligning rod 23*c* penetrating through the cut-away portions 27 of all the bins B. The aligning member 23 is mounted on the bin unit, by which the alignment of the sheets S is possible by movement of the aligning member 23 even during the bin shift movement as well as after the sheets are discharged to the bins B. In other words, sheets S can always be aligned except when the sheet S is in the process of movement to the bin B. In this embodiment, the aligning member 23 and the alignment reference member 32 are moved about a rotational shaft, and the rotational shaft is integral with the bin unit 9. Therefore, the sheets can be aligned stably at all times.

As shown in FIG. 6, three expanded portions X are simultaneously formed facing to the positions of the electric staplers 100*a* and 100*b*, and therefore, upon a sheet stapling operation of the electric staplers 100*a* and 100*b*, the head 111 and the anvil 112 can be easily moved to the stapling position, as shown in FIG. 2, and in addition, without interference to the sheet S accommodated in the lower bin, the sheets can be reliably stapled.

Now, the operation of the apparatus of this embodiment will be described. The description will be made as to the first mode in which sheets on the bin are taken out onto the tray, and the second mode in which the sheets are not taken out to the tray, will be described. It is determined depending on the number of copies whether the first mode or the second mode is selected. More particularly, if the number inputted by the operator on the keys on the operation panel is smaller than the number of bin trays, then the second mode is selected by a control means 1111 (FIG. 15). The first mode will be first described. As described hereinbefore, an end (1005) of a sheet S discharged is aligned (alignment position 1006) by the swinging motion of the aligning member 23 from 1002–1003 and from 1003–1002 to the alignment reference rod 32 (1036 position (FIG. 7)). Then, a stapling operation is carried out in the manner described above if the stapling mode is selected. If the stapling mode is not selected, then the alignment reference member 32 is moved to a home position (retracted position 1001 in FIG. 7) by an unshown driving system in accordance with a signal indicating completion of a sheet alignment for the last discharged sheet.

By doing so, the lateral limitation of the set of sheets is released. By the motion of the aligning rod 23 from 1002 to 1004 (FIG. 7) in response to the home position signal of the alignment reference member 32, and portions of the sheets are pushed out together to the position 1017 (FIG. 7) (second position). The aligning rod 23 returns to the home position 1002 (FIG. 7), and the series of operations of completed. On the other hand, when the stapling mode is selected, the set of sheets is moved in a similar manner in response to a staple completion signal for the last sheet set.

By a set moving operation, an end portion of the sheet (1007 in FIG. 7) is released from the top surface of the bin.

Figure 8:
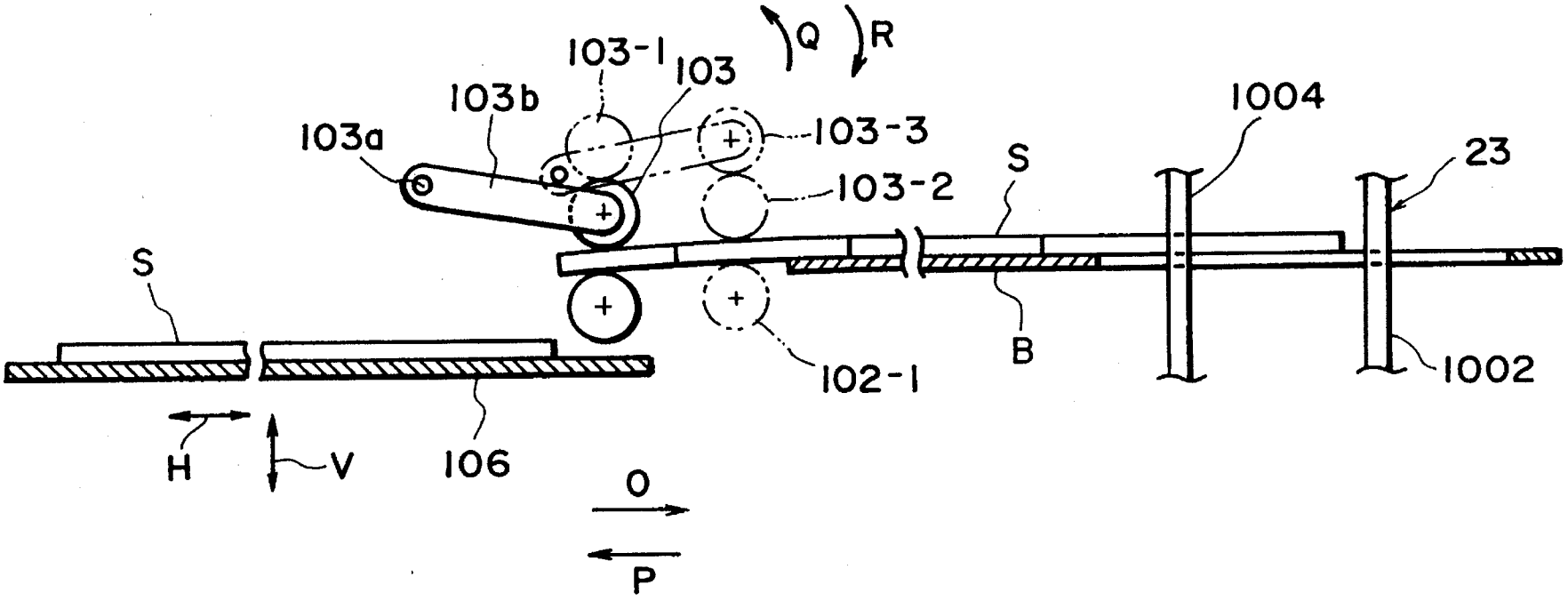
FIG. 8 is a schematic enlarged view of a stacker portion in an embodiment of the present invention.

In the direction of this sheet conveyance, there is a receiving stacker 400 for receiving sheets S from a bin (FIGS. 7 and 8). The stacker 400 is provided with a sheet receiving tray 106 movable in the vertical direction depending on the amount of sheets stacked thereon and sheet discharging rollers 102 and 103 for discharging the sheets from the bin. The roller pair is movable in the directions O and P by a guiding rail for guiding an unshown driving means (a unit having a motor and a gear grain) and a motor for driving the unit. In addition, an arm **103*b* is rotatable by an unshown driving means (solenoid) in the directions Q and R, the arm 103*b* supporting the roller 103 on the central shaft 103*a*. When the overall motion for the sheets as described with FIG. 7 is completed, a predetermined bin Bc is moved (upward or downward) through the above-described operation to a position facing the above-described roller pair 102 and 103**, in order to push the sets of sheets S one-by-one from the bins.

The first bin for the sheet set pushing operation is different depending on whether the stapling mode is selected or not. If the stapling mode is selected, then it is most efficient if the operation starts with the last stapled bin. In the case of the no-stapling mode, it is most efficient if the operation starts with the bin having received the last sheet. If the bin (staple or discharging) faces the roller pair, then the motion of the bin after the completion of the operation is not required. When the predetermined bin is moved to the position facing the roller pair 102 and 103, the rollers 102 and 103 are moved from the position 102, 103 to the position 102' and 103' through a predetermined distance, and therefore, they are placed at the sheet gripping position. Here, the arm **103*b* is rotated in the direction R, so that the sheets S are gripped (101-1, 103-3), and they are again moved in the direction P (103, 102). Here, the roller pair is rotated in the direction indicated by an arrow, so that the set of sheets is fed to the sheet receiving tray 106. After the operation, the bin B is shifted. By repeating the bin shifting operation, the sets of sheets are all taken out to the receiving tray 106**.

Here, the sets of sheets may be sorted on the receiving tray 106 by reciprocating the tray in the direction H. It may be effected by alternately changing in the position in the direction of an arrow P the stop position (sheet discharging position) of the rollers 102 and 103. The tray 106 shifts in the direction V sequentially in accordance with the stacking amount of the sheets S. The mechanism for the shifting may comprise a motor Mo, a chain 402 for supporting the tray 106, a transmitting means for transmitting the rotation of the motor to the chain and means for detecting the distance of the shift of the tray 106.

Thus, the sheets are discharged from the bin B to the tray 106 by using a pair of rollers. However, it is possible to pull the sets out using a gripper or the like.

In this embodiment, after overall discharging for all the bins (sheet end is moved from 1006 to 1007), a predetermined bin is moved to a position facing to the roller pair 102 and 103. However, the overall pushing operation may be carried out during the bin motion or after the bin motion.

In this embodiment, the sheets are taken out from the stapling bin Bc. However, it is possible to do it for the sheet stacking bin Bb, or any other bin.

A description will be made as to the case in which the second mode is selected, that is, the sheets are not pulled out to the stacker. As described hereinbefore, the sheets S are aligned on the bin B (to the position of the sheet end).

In FIG. 1, the description will be made as to the case in which all the bins (Bl–Bn) carry sheets S.

Figure 9:
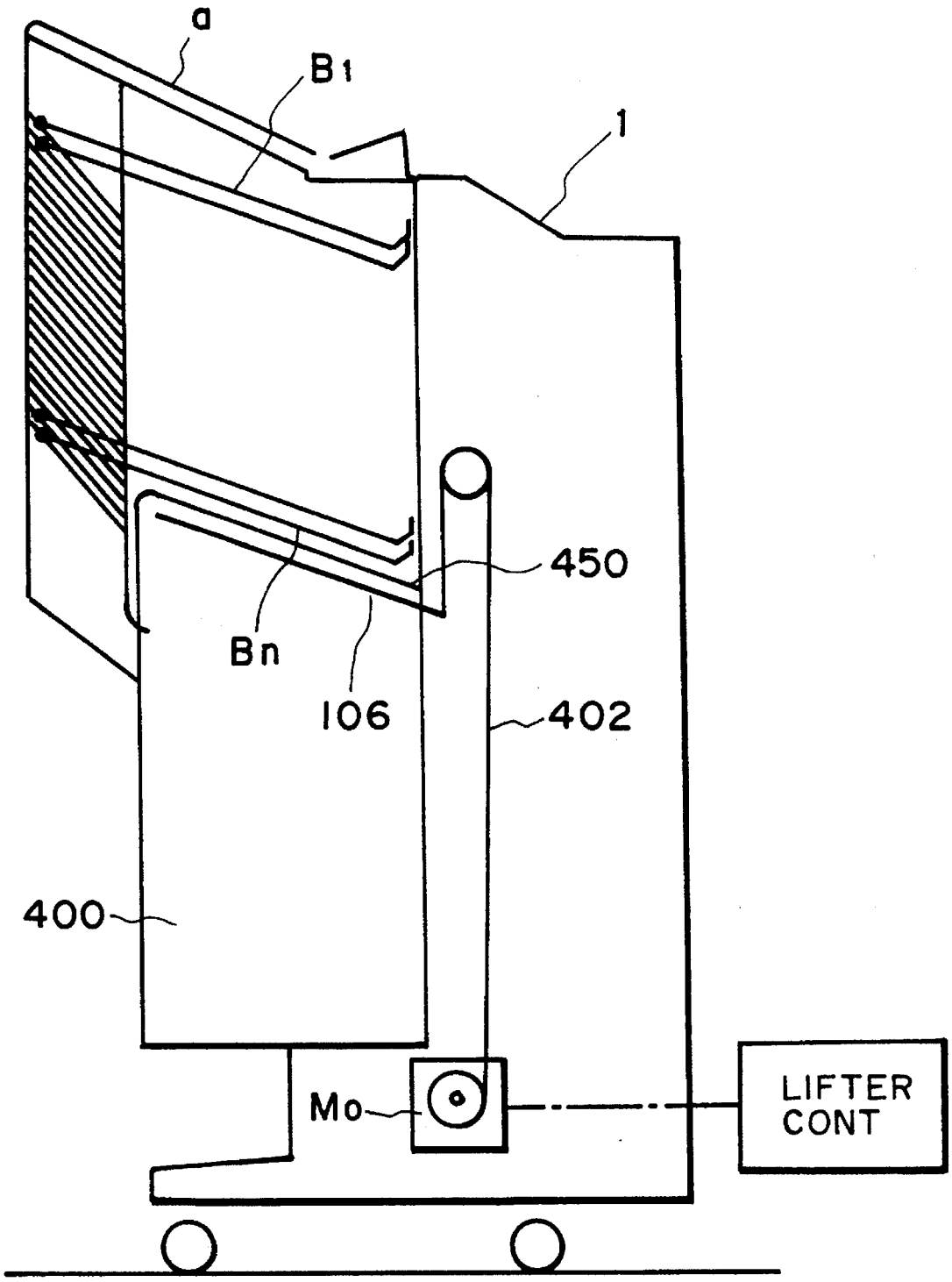
FIG. 9 is an illustration of operation of a sheet post-processing apparatus according to an embodiment of the present invention.

After completion of sheet alignment, the of bin Bn (bottommost bin) of FIG. 1 is lifted to the position bin Ba which is above the top surface 450 of the stacker 400 by the bin moving means described above (FIG. 9). By the above operation, there is no stacker 400 at the front side of all of the bins (Bl–Bn). Here, the sheet ends 1006 are moved to the positions 1007, as described in FIG. 7, by which the sheets on all the bins are pushed to the front beyond the bin end, so that the operator is permitted to take the sheets S out without difficulty.

When sheets are stacked in not all of the bins, but only a limited number of bins, such as bin Bl–Bd, the bottommost bin Bd is shifted up to the position Ba (above the stacker 450). In other words, the bottommost bin that carries sheets is shifted up to a position above the top surface of the stacker 400, and then the intended operation is possible. In this embodiment, the bottommost stacking bin is moved to the predetermined position which is above the top surface 450 of the stacker 400, and thereafter, the sheets on the bin are pushed toward the front as a whole by the aligning rod 23. The bottommost bin may be moved to a position above the top surface 450 of the stacker 400 after the sheets on the bin are pushed toward the front by the aligning rod 23. In addition, if the movement of the sheets toward the front is effected during the bin motion, the time loss can be saved.

In a second mode of this embodiment, the bin is moved to the position above the top surface 450 of the stacker, and the sheets are pushed all together by the aligning member 23. However, the bin may be provided with a cut-away portion to permit the set of sheets to be taken out of the bin, in which only the bin is moved, and the overall pushing is not carried out (chain line B3 of FIG. 4).

In this embodiment, alignment is carried out after the sheet is discharged onto the bin, and the first or second mode operation is carried out. However, if the stapling operation is not required, then the aligning operation may be omitted, and the above operation is carried out.

(Other Embodiments)

Figure 10:
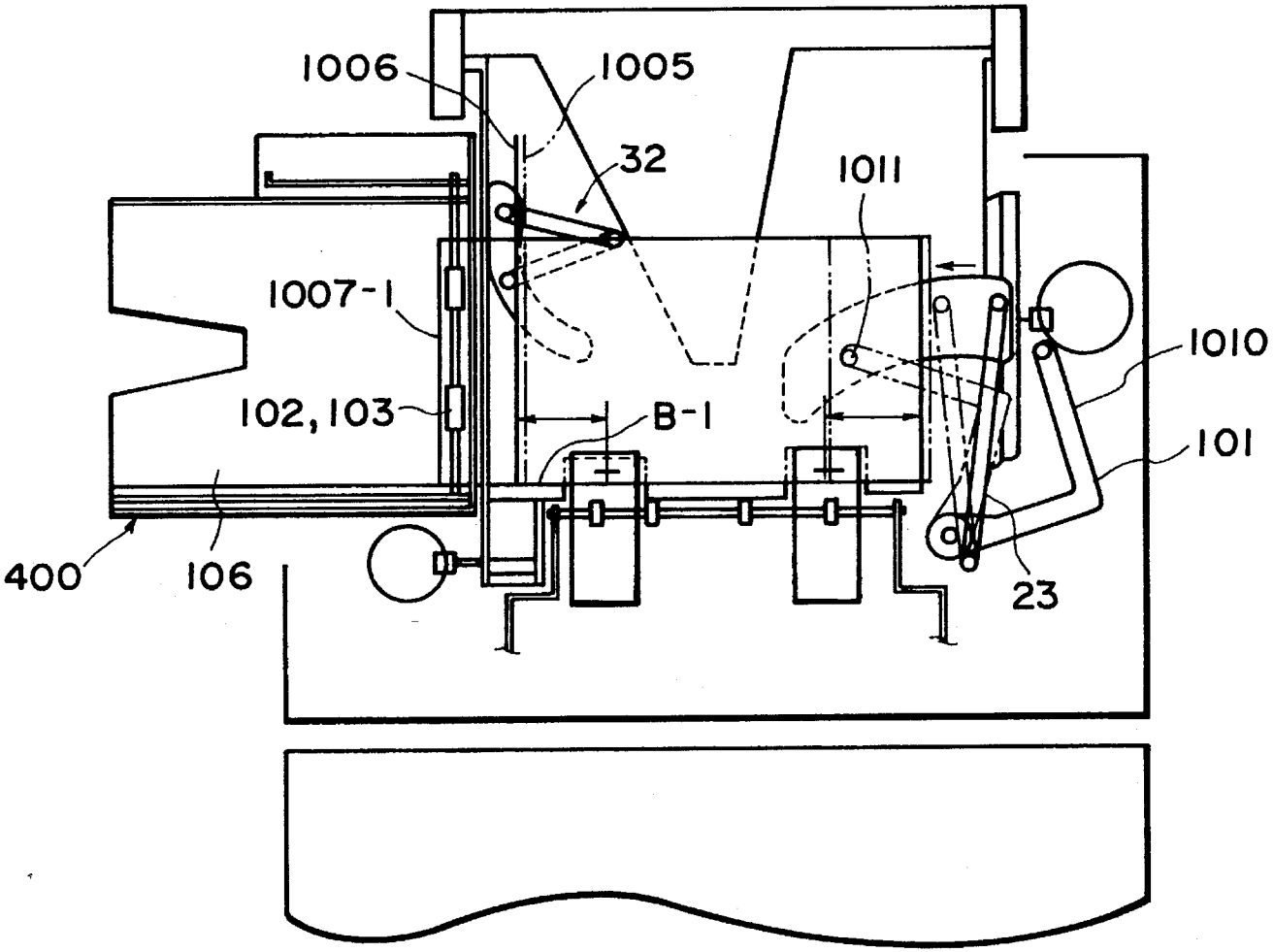
FIG. 10 is a top plan view of an apparatus according to another embodiment of the present invention.

A description will be made as to another embodiment operable in the second mode not taking the sheets out to the stacker. FIG. 10 deals with the case in which the sets of sheets are taken out one-by-one from the stacking bins. In the first mode, for the purpose of discharging the sets to the tray 106, as shown in FIG. 10, the sheet set on one bin is pushed (from 1010 to 1011) by the set pushing member 101, and the pushed sheets are gripped by gripper rollers 103. Then, they are discharged to the sheet receiving tray 103. Subsequently, the same operation is carried out repeatedly while shifting the bins stage by stage.

In the second mode, it is shifted up to a position above the top surface 450 of the stacker 400, and here, the sets are pushed out all together by the aligning rod 23. If the stacker 400 is placed slightly away from the sorter, then the overall pushing timing, similarly to the foregoing, may be during the bin shifting or before the bin shifting. At this time, the pushing to the front may be effected not by the aligning rod 23 but by the set pushing member 101, in which case the pushing rod of the set pushing member is extended through the bin in the bin height direction.

Figure 11A:
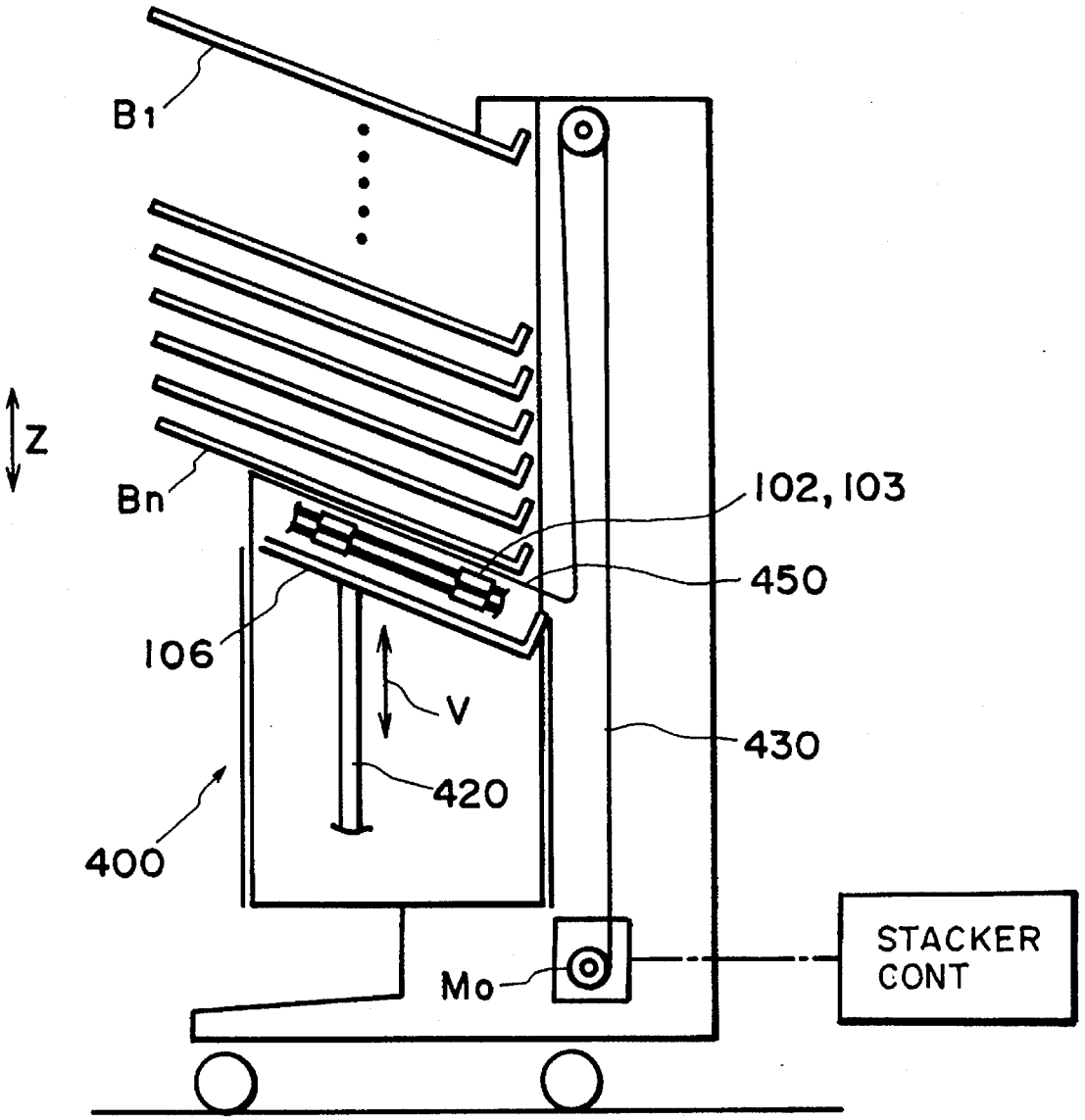
FIG. 11A is a front view of an apparatus according to an embodiment of the present invention.
Figure 11B:
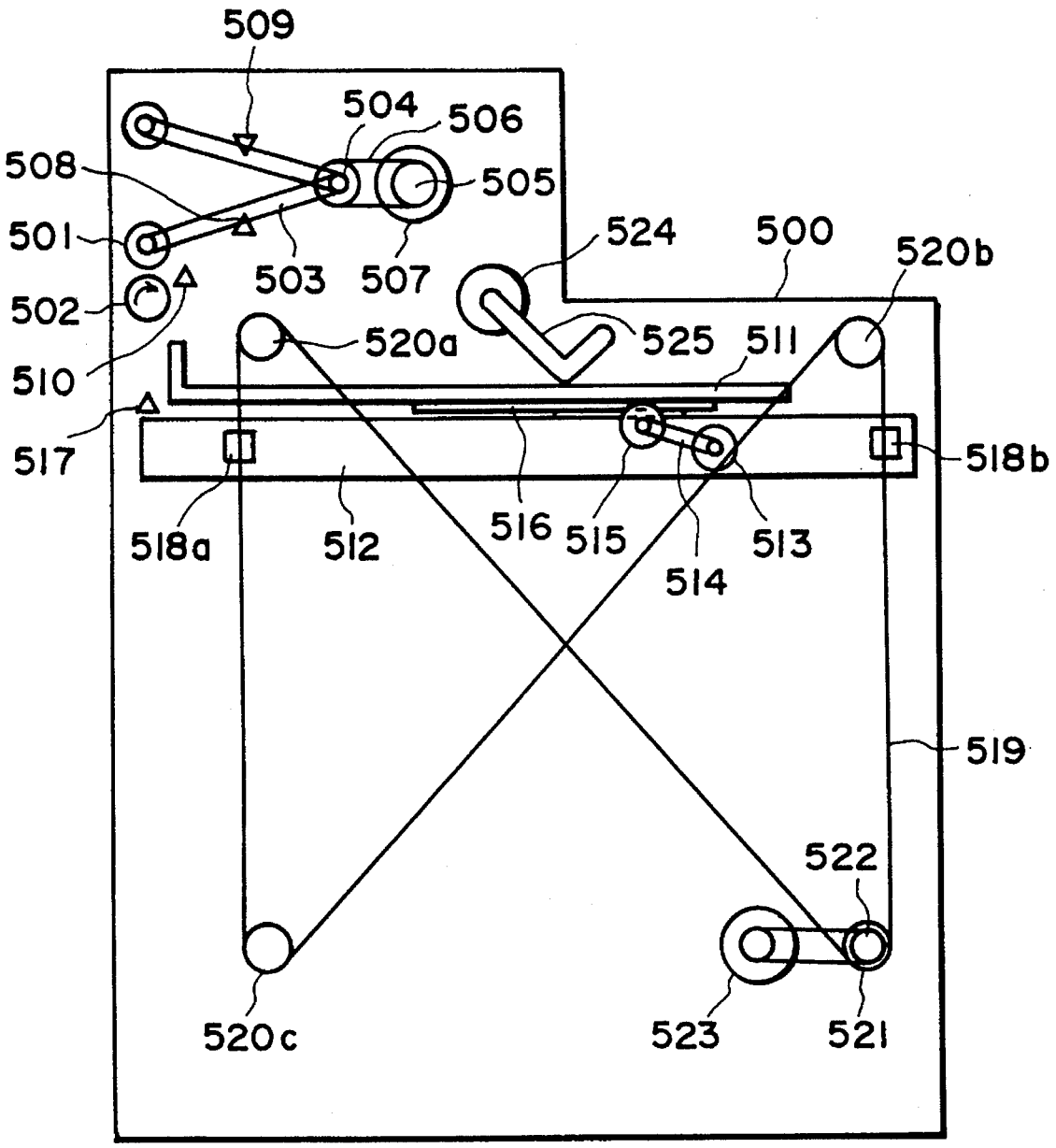
FIG. 11B is a front view of a further modified embodiment of a stacker.

FIGS. 11A and 11B shows a further embodiment. In the foregoing embodiment, the sorter is a bin moving type. However, the same advantageous effects can be provided even in a fixed bin sorter if the stacker and the discharging roller pair are moved in the direction V. In other words, when the sheets are to be stacked on the stacker 400 (the first mode), the conveying rollers 102 and 103 are moved to a predetermined bin, and takes the sheets out to the tray 106, and the sheet receiving tray 106 is moved in the direction V by a driver (lifter 420) which is different from the discharging roller pair 102 and 103, in accordance with the amount of the stacked sheets. At this time, the rollers 103 and 102 are moved independently in the direction Z, while leaving the tray below. The sheets may be stacked after being returned from the bin to the tray 106. Otherwise, the roller couple and the tray 106 are moved all together to the bin position, and sheet may be stacked in the tray 106. When the sheets are not stacked on the stacker (the second mode), the stacker is lowered by the lifter 430, by which the top surface 450 of the stacker is moved so as to be below the bottommost one of the stacking bins, by which the same advantageous effect can be provided.

Figure 12:
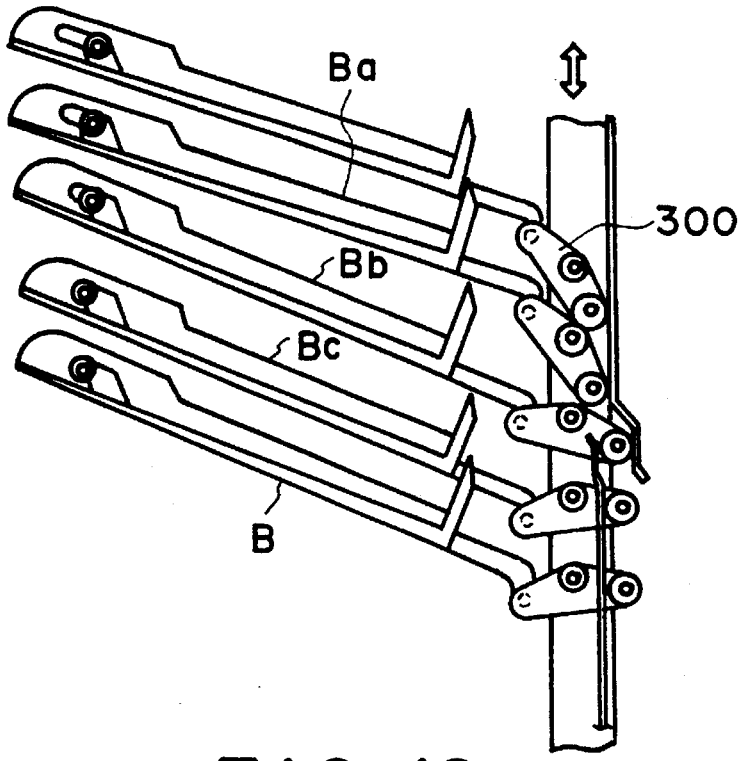
FIG. 12 is a front view of an apparatus according to a further embodiment of the present invention.

In this embodiment, the sorter is moved by the lead cam, and the fixed bin type sorter has been described in the above embodiment. However, as shown in FIG. 12, the present invention is applicable to a sorter in which the bin interval is switched by a link 300.

Figure 13:
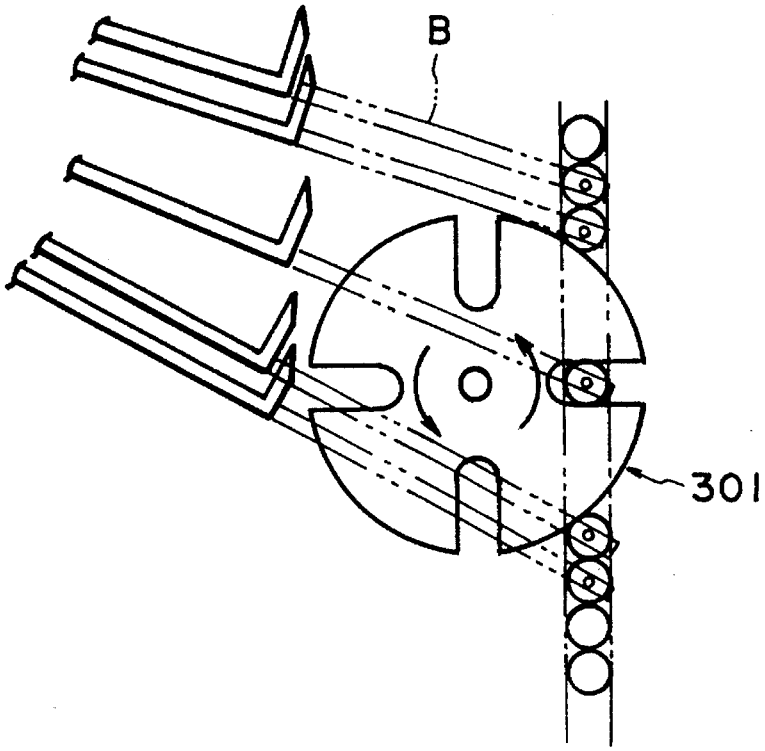
FIG. 13 is a front view of an apparatus according to a further embodiment of the present invention.

As shown in FIG. 13, the present invention is applicable to a sorter using a Geneva mechanism 301 to change the bin interval.

Figure 14:
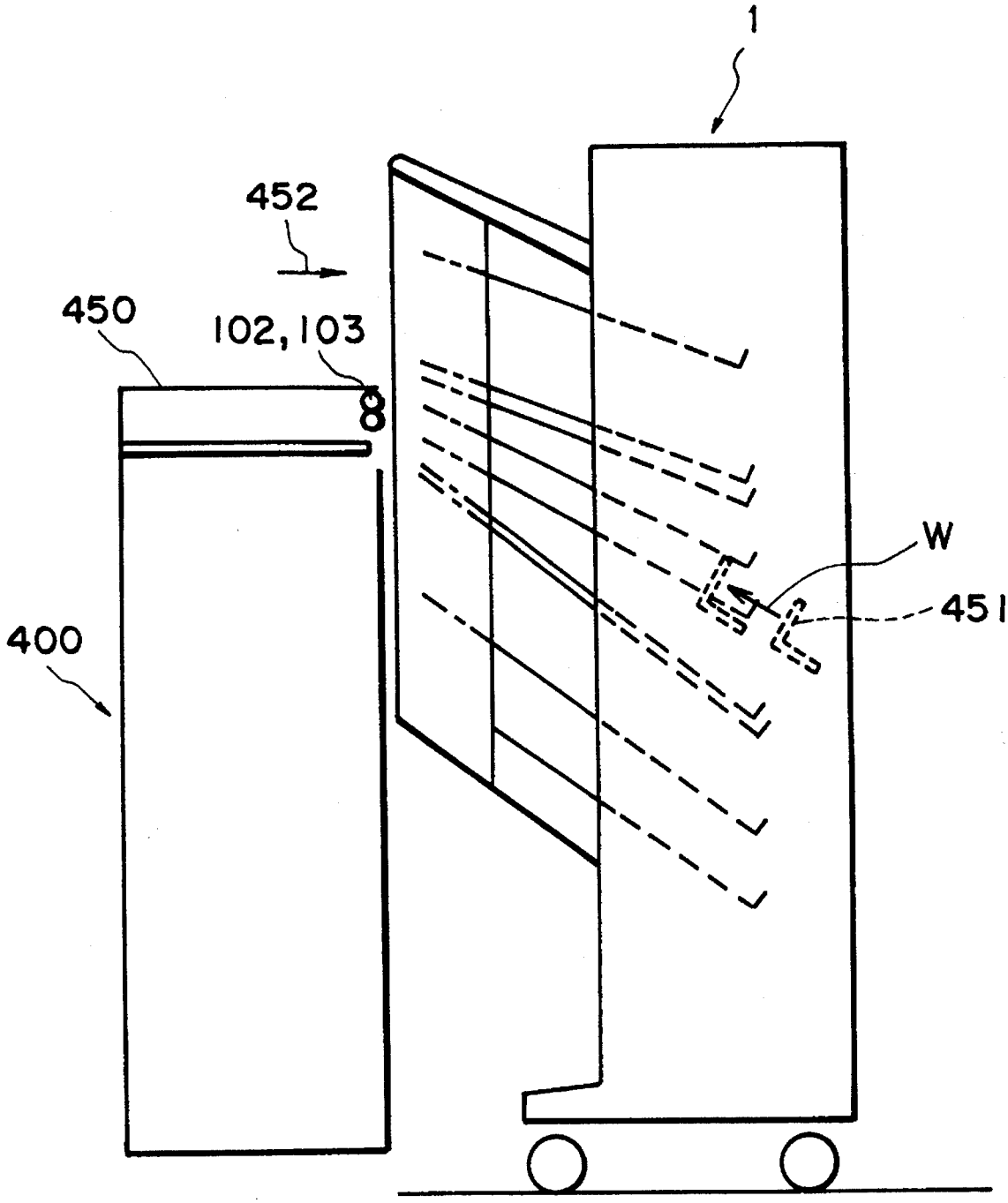
FIG. 14 is a front view of an apparatus according to a further embodiment of the present invention.

As shown in FIG. 14, the above-described advantageous effects can be used in the case of a sorter in which a stacker 400 is disposed in the sheet conveying direction from the main assembly to the sorter, and the sheet can be taken out in the direction indicated by an arrow 452.

In the first mode, the sheets are pushed in a direction indicated by an arrow W by the pushing member 451, the rollers 102 and 103 discharge then to the stacker. In the second mode, the bottommost one of the bins stacking the sheets is moved upward beyond the top surface 450 of the stacker 400.

Referring to FIG. 11B, another example of the stacker will be described. In this stacker, the set of sheets pushed out of the sorter juxtaposed therewith is fed by set feeding rollers 501 and 502. The set feeding roller 501 is supported by a swingable arm 503 to be in rolling contact with the roller 502. The swingable arm 503 swings substantially in the vertical direction by an arm swinging motor 507 through pulleys 504, 505, and a timing belt 506. The position indicated by the solid lines for the swingable arm 503 is a feeding position capable of feeding the set of sheets, and the position is detected by a set feeding sensor 508.

The position indicated by broken lines is a receiving position for receiving the set of sheets. The position is detected by a receiving position sensor 509. The feeding roller 502 is driven by an unshown feeding motor to feed the sets of sheets. The set feeding motor is provided with an encoder to detect the movement distance. A sensor 510 detects the set of sheets fed by the set feeding roller. Designated by a reference numeral 511 is a set stacking tray, and is supported on a tray support 512. A tray moving motor moves the set stacking tray 511 through a timing belt 514, a pulley and pinion gear 515 and a rack 516. The tray moving motor includes an unshown encoder, and therefore, the moving amount thereof can be detected. Designated by a reference numeral 517 is a tray home position sensor to detect the home position of the set stacking tray 511. The position of the set stacking tray is detected on the basis of the output of the tray home position sensor 517 and the output of the encoder of the moving motor 513. The tray support 512 is fixed to a wire 519 by fixing means 518*a* and 518*b*. The wire 519 is reeved around pulleys 520*a*, 520*b*, 520*c* and driving pulley 521.

A driving shaft 522 is driven by a tray lifting motor 523 to move the tray support 512 substantially in the vertical direction. The driving shaft 522 is connected with a driving pulley therebehind not shown, and a tray lifting mechanism using the wire is provided at a rear side, so that the tray support 512 is supported at four points.

A sheet surface detecting sensor 524 is in the form of a potentiometer for producing an analog signal in response to a height of the sheet surface supplied by a sensor arm 525. The tray lifting motor 423 controls the height of the tray support 512 in accordance with an output of the sheet surface detection sensor 524.

The motion of the stacker will be described. The detector 510 detects insertion of the set A of a sheets. The arm swinging motor 507 starts to rotate to close the space between the upper swingable arm 503 and the lower arm, so that the set A of sheets is nipped between the upper feeding roller 501 and the lower feeding roller 502. When a proper pressure is applied between the upper feeding roller and the lower feeding roller, the motion of the arm swinging motor 507 stops. Then, the set feeding motor is actuated, and the upper feeding roller 501 and the lower feeding roller 502 rotate at the same speeds, so that the set of sheets A is fed. When the trailing end of the set of sheets A is detected by the detector 510, the set feeding motor is stopped, and then, the arm swinging motor 507 is rotated so that the pressure between the upper feeding roller 501 and the lower feeding roller 502 is released.

The tray moving motor 515 is actuated while the trailing edge of the set A of sheets in the process of feeding, is in contact with the lower conveying roller, and the leading edge is in contact with the set stacking tray 511. By doing so, the set stacking tray 511 is moved in the conveying direction, and it is stopped after completion of the discharge of the set of sheets. In this manner, sets are offset on the stacking tray. In addition, the switching operation for the sheet set receiving position can be accomplished for each job.

The height of the tray supporting table 512 is controlled by moving the tray lifting motor 523 in accordance with an input from the sheet surface detecting sensor 524.

Referring to FIGS. 15–19, a detailed description will be made as to the alignment, stapling and pushing-out of the sets of sheets in the structure of FIGS. 7 and 10. Before describing this, a sheet handling reference will be described. Generally speaking, there are two types of sheet handing references in an image forming apparatus. In one of them, one lateral edge of a sheet is aligned with a predetermined reference position at all times (lateral alignment system), and in the other, a center line of a sheet is aligned with a predetermined reference (line) at all times (center alignment system).

In the former type, a reference lateral edge of the discharged sheet (generally, it is a front side of the apparatus) is always on a reference line irrespective of the size of the sheet (a width of the sheet measured in a direction perpendicular to the sheet movement direction). This has the following advantages:

(1) When the discharged sheet is aligned by abutting an end to a fixed abutment plate, or the sheet is manually fed (to the image forming apparatus), the position of the abutment plate is fixed.

(2) Since one lateral edge of the sheet passes by a fixed line at all times, any small size sheet is always at the front side lateral end if so selected, in case the sheet is jammed in the image forming apparatus. Therefore, the operator can retrieve a jammed sheet without inserting his hand deeply into the image forming apparatus. Thus, the jam clearance operation is easy.

However, it is considered disadvantageous in the following points as compared with the center alignment.

(1) In order to stably feed a sheet having different width, a balance with an auxiliary conveying roller has to be considered, in consideration of all the usable size. Therefore, the number of rollers in the width direction tends to increase with the result of cost increase.

(2) It is difficult to dispose a roller and auxiliary rollers uniformly distributed for the gravity centers of sheets having different sizes for all sizes.

In the case of center alignment, the gravity (center line) of the sheet is aligned with the feeding mechanism, and therefore, if the rollers are disposed symmetrically relative to the feeding reference, then uniform balance can be provided relative to the gravity center of the sheet for all sizes. In addition, it is disadvantageous from the standpoint of heat distribution of a heat-fixing type fixing unit or another image forming process condition.

Accordingly, two types of sheet handling co-exist. Recently, however, the center alignment type image forming apparatus is increased from the standpoint of the stabilized sheet handling conditions and the copying process conditions. Therefore, the copying machine of the center alignment type will be considered from the standpoint of the application of a sheet post-processing apparatus connected with the image forming apparatus. When the sorter is connected to the copying machine, if the sorter permits taking-out out of the sheets at the front side, and when the small width sheets are sorted and stacked, the operator has to insert his hand deep into the stacked bin arrangement, and therefore, it is difficult. If the size of the cut-away portions is increased in an attempt to make the taking-out operation easier, then the sheets hang down in the cut-away portion when the size of the sheets is large, and in addition, the mechanical strength of the bin deteriorates to prevent stacking of a great number of sheets.

In the case of the structure in which the sets of sheet can be taken out from a lateral side of the sorter, if the position of the cut-away portions of the bins is shifted in the lateral direction, then the sorter is usable with copying machines of the center alignment type and of the lateral alignment type without increasing the size of the cut-away portion. However, in the case in which long and short sheets (in the direction of the movement of the sheet) are used, the size of the cut-away portions in the sheet feeding direction increases.

Therefore, in this invention, after the alignment reference member is retracted, the sheets on the bins stacking the sheets are pushed out to the outside of the stacking member by an aligning member or the pushing member. By doing so, the sheets can be easily taken out of the stacking member without decreasing the mechanical strength and the sheet stacking conditions of the stacking member.

Figure 15A:
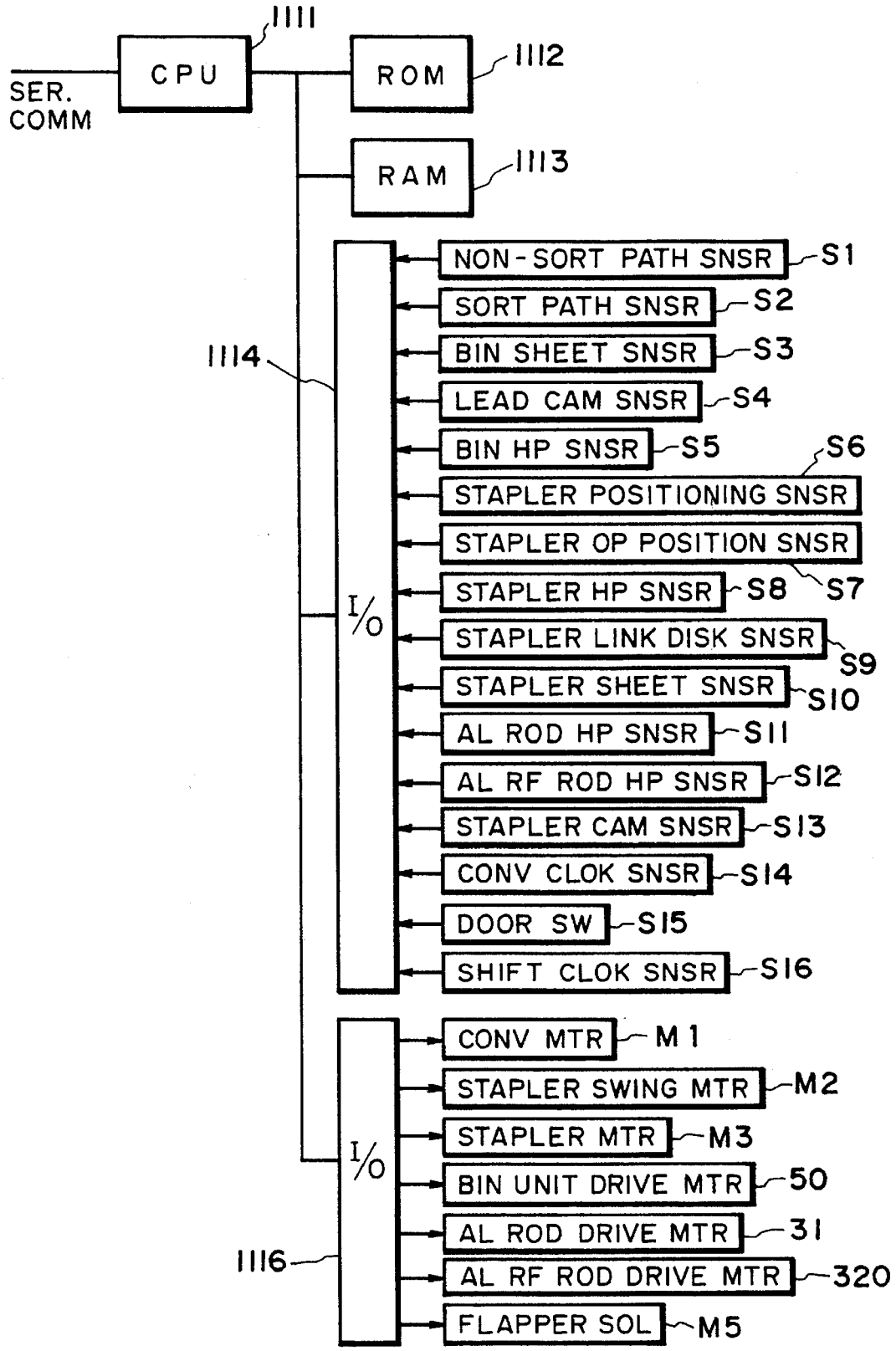
FIGS. 15A, 15B and 15C, is a block diagram.
Figure 15B:
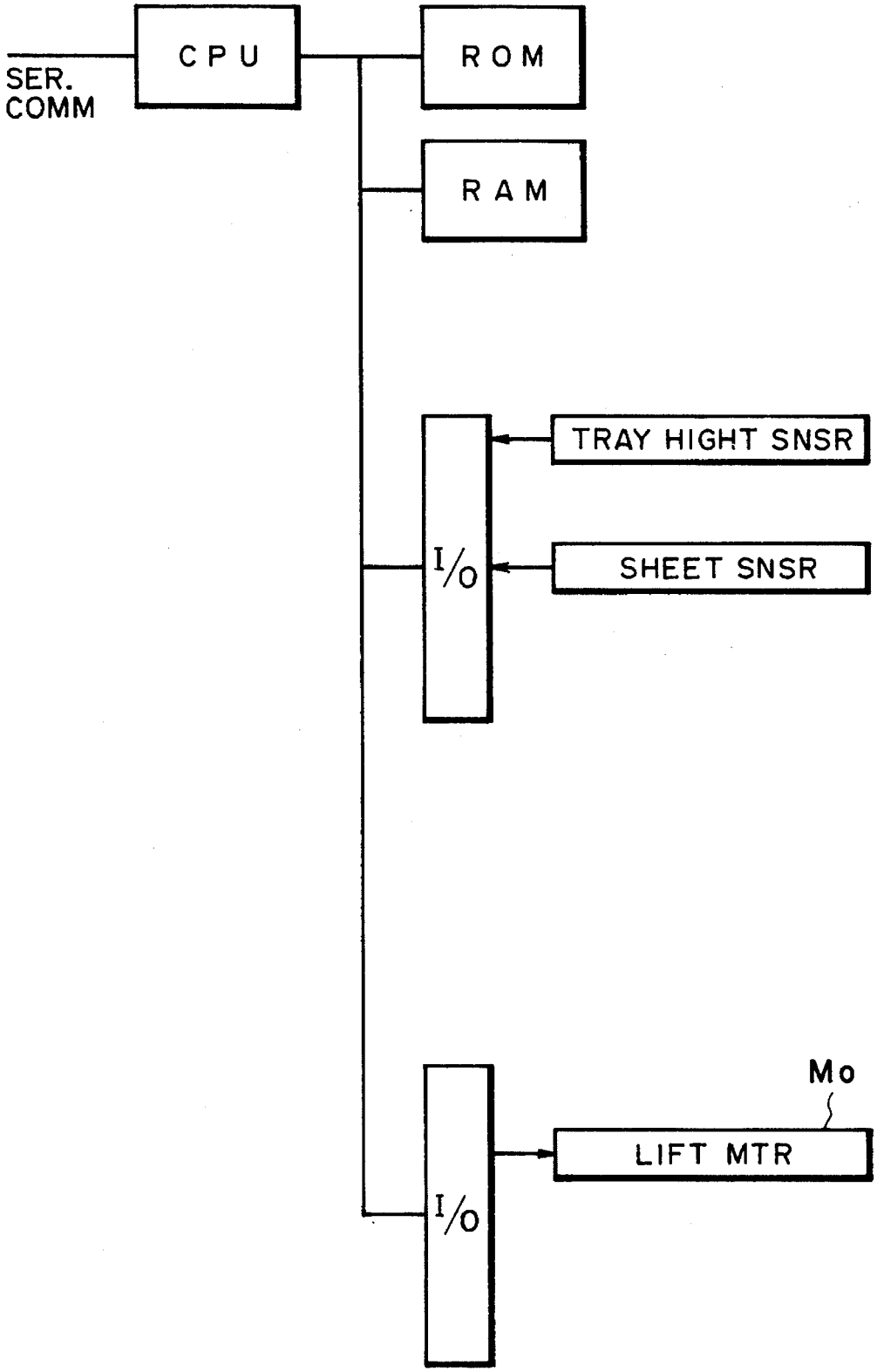
Figure 15C:
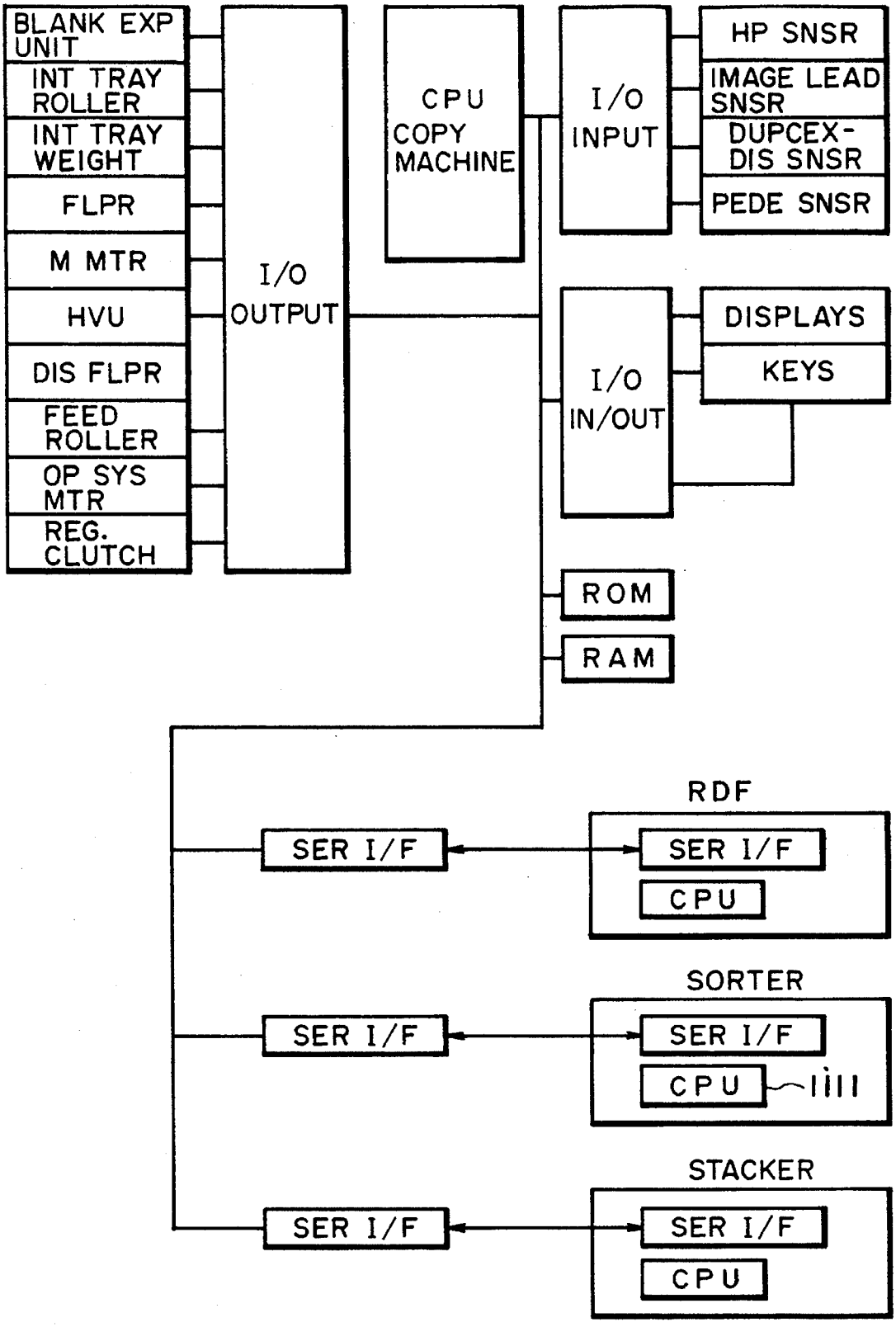

FIGS. 15A to 15C are block diagrams and a flow chart for the apparatus of this embodiment. As shown in FIG. 15A, a controller (CPU) 1111 for controlling the entire sorter is connected with an aligning rod home position sensor S11, alignment reference rod home position sensor S12 or other sensors (S1–S16) through a ROM 1112, RAM 1113, interfaces (I/O) 1114 and 1116. It is also connected with various driving sources (M1–M5) such as a bin unit driving motor (shift motor) 50, and an aligning rod driving motor (pulse motor) 31.

As shown in FIG. 15C, the CPU 1111 is serially connected with the CPU of the main assembly of the copying machine.

FIG. 15B shows a block diagram of a control device for a stacker.

Figure 16:
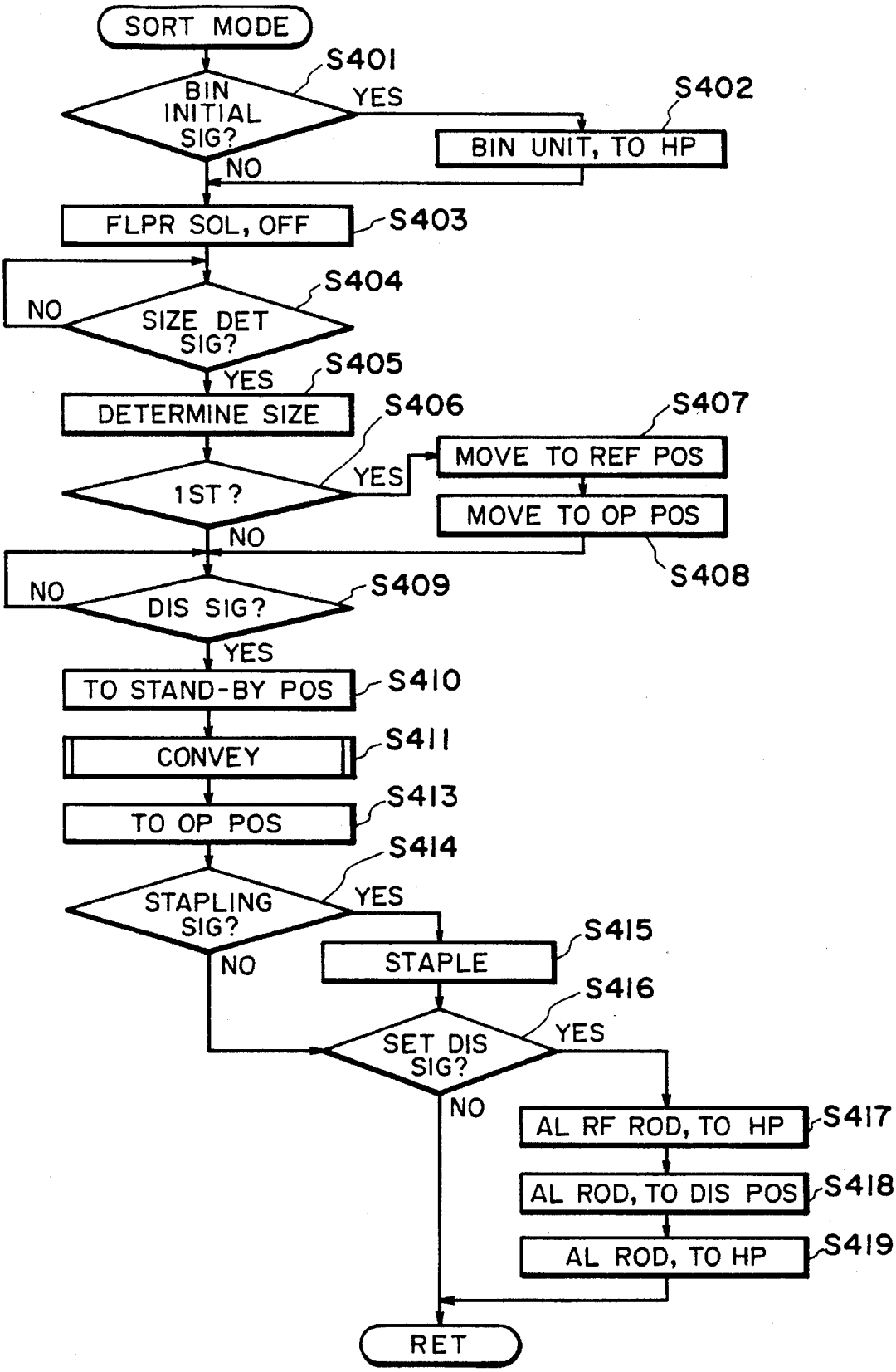
FIG. 16 is a flow chart showing an operation of a sorter.

Referring to FIG. 16, an operation in the sorting mode will be described. The description will be made as to whether there is a bin initializing signal indicative of the necessity of returning the bin unit 9 to the home position in the main assembly 201 (S401). Only if it is so, the bin unit 9 is moved to the home position (S402). Subsequently, in order the properly select the sort discharging outlet 15, the flapper solenoid M5 is deactuated (S403). A size determination signal is awaited (S404). When the size determination signal comes, the size is determined (S405), and then, it is confirmed whether the size determination is for the first sheet (S406). Only if so, the alignment reference position 32*c* is moved and correctly positioned at a regulating position 1036 ((FIG. 7) S407). Then, the aligning rod 23*c* is moved to the urging position (lateral shifting position) 1003. The sheet discharging signal from the main assembly of the apparatus 201 is awaited (S409), and when it comes, the aligning rod 23*c* is moved to the stand-by position 1002 which is predetermined distance away from the urging position 1003 in the direction of the width of the sheet S. Until the completion of the successive sheet discharges, the aligning reference position 32*c* is positioned at the regulation position 1036.

Subsequently, the sheet S is discharged to the bin B (S411), and the aligning rod 23*c* is moved to the urging position 1003 (S413). As regards the shifting motion of the bin B, it is carried out in the interval between the discharging of a sheet S and the movement of the aligning rod 23*c* to the urging position. However, this is omitted in the flow chart for the sake of simplicity.

At step S414, the discrimination is made as to whether a stapling signal is produced or not. Only if so, the stapling operation is carried out (S415). Thereafter, the discrimination will be made as to whether the sheet set pushing signal is produced or not (S416). Only if so, the alignment reference rod 32*c* is moved to the retracted position 1001 (the home position retracted from the passage along which the sheet S is pushed out to the front side (S417)). Thereafter, the aligning rod 23*c* is moved to the pushing position 1004 to push the set of the sheets toward the front (S418), and thereafter, the aligning rod 23*c* is returned to the retracted position 1002. The program returns to the main routine.

In this embodiment, when the stapling and sorting modes are selected, the stapling operation and the sheet pushing-out operation are carried out continuously. However, when only the sorting mode is selected, which is normal, the operation may be temporarily stopped before the step S414. An unshown manual stapling button or manual pushing-out button may be used. If the stapling is not required, the sheets are pushed out without the stapling operation if the pushing-out button is actuated. If the manual stapling button is pushed, the stapling operation is carried out under the routine after the step 414, and the sheet set pushing out operation is carried out.

When the sorting mode is selected, as described above, in this embodiment, the manual stapling operation is selectable after completion of the sorting operation. The pushing out of the sets of sheets in the case of stapling to be carried out, the order of operation is stapling-sheet-pushing, and therefore, the manual set pushing-out button is provided in addition to the manual stapling button. However, it is possible that the modes are determined to be staple-sort-pushing mode, or sort-pushing mode beforehand. In this case, if the latter mode is selected, then the sheets are automatically pushed out after completion of the sorting operation.

FIG. 16 shows the flow chart in the sorting mode, but the shown steps after step S414 also applies to the operation after the completion of the sorting operation.

A description will be made as to an embodiment in which the moving speed of the aligning rod 23*c* is changed. The aligning rod 23*c* reciprocates between the stand-by position 1002 and the urging position 1003, before the next sheet S is discharged to the same bin B or the upper or lower bin B, by which the lateral edge of the sheet S is urged to the alignment reference rod 32*c* at the regulating position 1036, and is aligned at the position 1006.

At this time, a speed α at which one of the lateral edges of the sheet S moves from the position 1005 to the position 1006, that is, the sheet width direction component (urging speed) of the movement speed of the aligning rod 23*c* from the position 1002 to the position 1003, is selected to be a proper level to effect the aligning operation within the time period of the sheet S interval discharged out of the main assembly 201 of the apparatus (α at the motor speed (PPS (pulse speed))). Here, the speeds of the movements from the position 1002 to the position 1003 and from the position 1003 to the position 1002 may be the same. From the standpoint of the stability of the motion of the sheet S, the urging speed α from the position 1002 to the position 1003 may be smaller than the speed from the position 1003 to the position 1002, provided that the movement is possible within the sheet interval. Upon completion of the above described alignment operation, the stapling operation is carried out, as described in the foregoing. If the stapling mode is not selected, then the alignment reference rod 32*c* is moved to the retracted position 1001 by an unshown driving system in response to a completion signal of the discharged sheet S.

By doing so, the confinement of the set of sheets in the direction A is released. In response to the home position signal of the alignment reference rod 32*c*, the alignment rod 23*c* is moved from the stand-by position 1002 to the pushing position 1004 (during the motion from the position 1003 to the position 1004 is usable), by which one of the lateral edges of the sets of sheets are pushed out all together to the position 1007. The aligning rod 23*c* returns to the stand-by position 1002, so that the series of operations is completed. When the stapling mode is selected, the set feeding operation described above is carried out in response to the stapling completion signal for the last set of sheets. Here, a speed β at which the lateral edge of the sheet moves from the position 1006 to the position 1007, that is, the sheet width direction component of the speed of the aligning rod 23*c* moving from the stand-by position 1002 or the urging position 1003 to the pushing position 1004 (motor speed β', PPD), is selected to the lower by a predetermined by the urging speed α during the aligning operation described hereinbefore (α>β, α'>β').

Unlike the sheet moving operation in which the sheet S is urged to the alignment reference member 32 one-by-one as in the aligning operation, the set of sheets S is not urged to the regulating position, but are moved on the bin B, and therefore, the speed is selected so as to prevent the set of sheets slacks when the aligning rod 23*c* is moved or stopped (1004 position).

In addition, since the rotational speed of the motor is lower from α'PPS to β'PPS, the torque of the motor is larger. The load for moving the set of sheets is larger than during the alignment operation. However, since the set of sheets are moved at a lower speed, it is not necessary to add an additional motor or the like, and no large capacity motor is required. Thus, the same motor is usable.

By the above sheet set feeding operation, one of the lateral side edges of the sets of sheets can be moved to the position 1007, so that they are projected out of an end of the bin B. Therefore, the operability is remarkably improved when the sheet sets are taken out in the direction A.

When the stapling mode is not selected in this embodiment, the set of sheet is moved from the discharging position (1005) to the aligning position (1006), and thereafter, it is moved to the set taking-out position (1007). However, if alignment is not required because no stapling operation is required, then the aligning operation is not executed at the discharge position 1005, and the sheet is moved to the taking-out position 1007 at a pushing speed β.

In this embodiment, the aligning rod 23*c* is moved along an arc, and therefore, during sheet movement, the sheet moving speed is slightly different depending on the position on the bin B. However, the relation between the urging speed α and the pushing speed β is satisfactory if the maximum of the pushing speed β is smaller than the minimum of the urging speed α. The aligning rod 23 may be moved along a straight line rather than the arc line.

In the case of the linear reciprocal movement, the flow chart therefor is a modification of the flow chart of FIG. 16. More particularly, the moving speed of the aligning rod 23*c* at steps S408 and 413 in FIG. 16 is α, the moving speed of the aligning rod 23*c* at step S418 is β.

In the foregoing description, two different speeds are selected for the urging speed during the alignment operation (α) and the moving speed during the pushing operation (β), wherein α>β is satisfied. However, the pushing speed β may be variable in accordance with the number of sheets stacked on the bin B. More particularly, the number of sheets S stacked on all the bins B is counted, and if the count is small, β1 is selected, whereas if it is large, β3, β3 and βn are selected with an increase of the counts, so that a plurality of set moving speeds are selectable (α>β1>β2>β3>βn), by which the speed is higher when the number of sheets is small, in which case the load is small and the sets are not easily deviated, but when the load is large, in which case the sets are easily deviated, the speed is lower. In this case, the results are advantageous in view of the set deviation and the load variation.

The same advantageous effects can be provided if the above-described speeds are changed in accordance with the size of the stacked sheets (low speed γ1 for large size, a high speed γ2 for small size (α>γ2>γ1)).

Furthermore, the speeds may be variable in accordance with the number of sheets described above and also the size of the sheets (nature).

In the foregoing embodiment, the drive of the aligning member 23 is carried out using a pulse motor 31. However, a DC motor or the like is usable in place thereof, in which case the urging speed α and pushing speed β are switched by changing the voltage applied. Using a constant speed of the motor rotation, the speed may be changed using a gear train or the like.

In the case that the sorter is provided with a stacker, in which the sheet set is taken out from respective bins, by a set pushing member, the same advantageous effect can be provided by selecting the pushing speed β of the set pushing member and the urging speed α of the aligning rod 23*c* so as to satisfy α>β.

If only a sorter 1 is provided without a stacker in then the structure described above, the sheet set taking out at the front side may be carried out not by the aligning member 23 but the set pushing member. Furthermore, in order to move the sheet to permit the taking-out in front side, the number of the stacked sheets on the bin B may be counted. If it is small, then they may be pushed out all together by the aligning member 23. If the count is large, then it may be pushed to the front side by the set pushing member for respective bins.

By doing so, the driving motor for the aligning member 43 or the like, can be made even smaller.

In the foregoing, the description has been made only as to the movement of the set of sheets for permitting them to be taken out at the front side. However, when the sheet aligning position and the stapling position are different from each other, the sheet moving speeds can be set in the same manner described above. More particularly, when the lateral edge of the stapling position is remote from the lateral edge of the sheet discharging position 1005, and the movement distance for the alignment is large, the urging speed $\alpha$ for alignment adjacent the sheet discharging position 1005, and after the alignment, it is returned to the stapling position at the pushing speed $\beta$.

Figure 17:
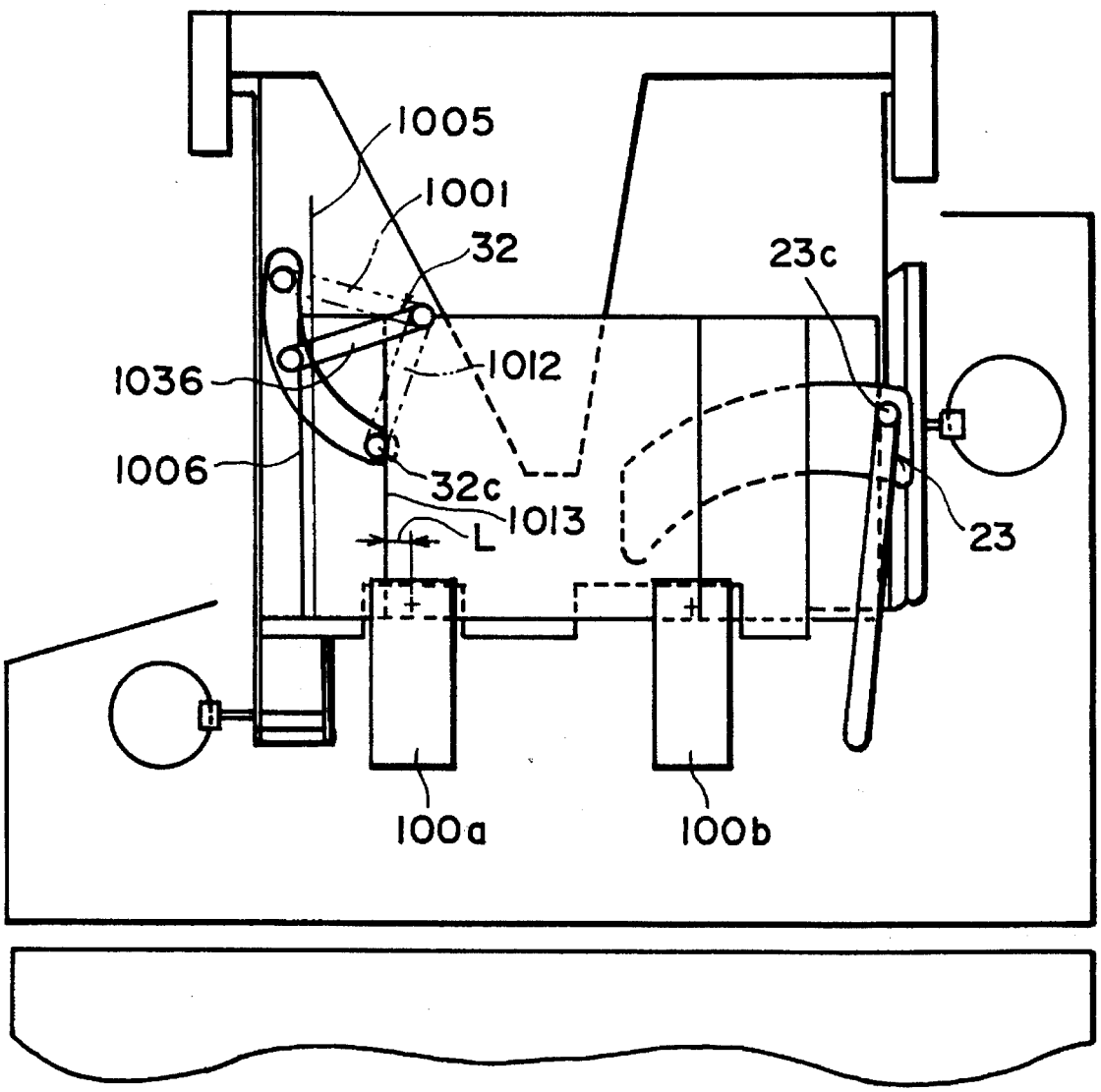
FIG. 17 illustrates an operation of an alignment member when a stapling position is changed.

Referring to FIG. 17, an operation is shown for shifting the stapling position from position K of FIG. 7 to position L of FIG. 17 (K>L). The lateral edge position at the time of the sheet S discharge, is indicated by 1005, similarly to the foregoing example. During the alignment operation, the aligning speed is $\alpha$ at the position 1006. After the completion of alignment, the alignment reference rod 32*c* moves the sheet sets on all the bins at the speed $\beta$ to the position 1012 (1013) so that the sheets S are stapled at a position L away from the side edge.

Using the foregoing structure ($\alpha>\beta$), the set movement without disturbance to the sets is possible. Thereafter, the sheet S may be moved using the aligning member 23 to the front unloading position, in the manner described in the foregoing.

Figure 18:
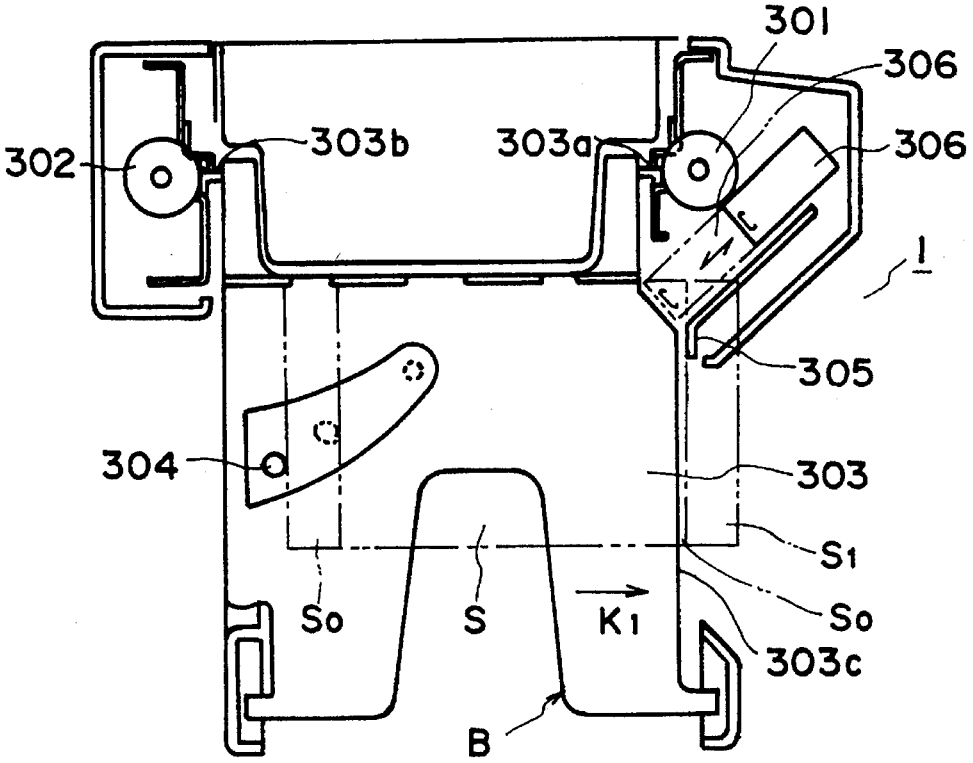
FIG. 18 is a top plan view of an alignment reference member according to a further embodiment of the present invention.
Figure 19:
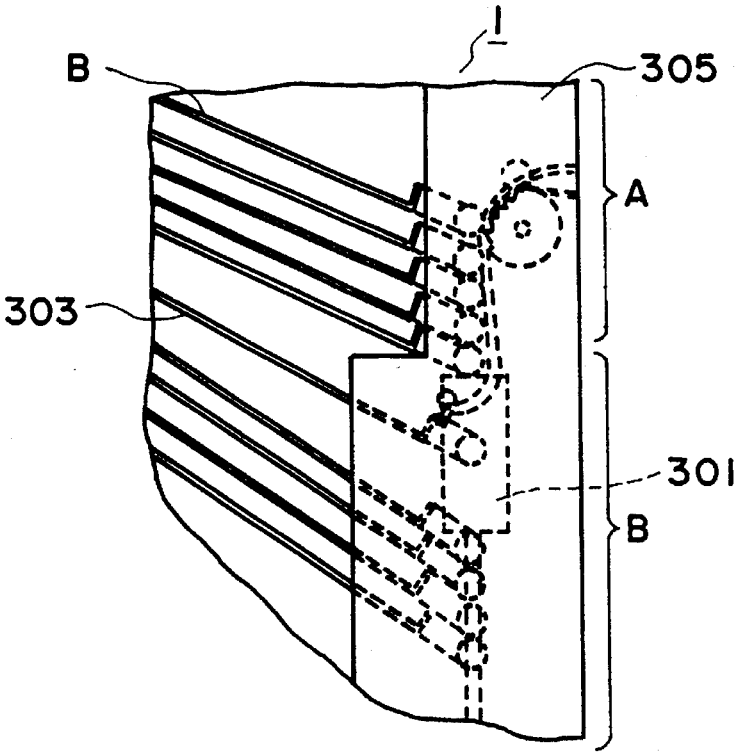
FIG. 19 is a side view thereof.

As another example, FIGS. 18 and 19 show the case in which the sheet sets are pushed out toward the front side (toward the operator) all together. FIG. 18 is a top plan view, and FIG. 19 is a side view.

The vertical movement of the bin B is carried out by lead cams 301 and 302 at the rear and at the front. At one side of the bin 303, there are rollers 303*a* and 303*b* engageable with the lead cams 301 and 302.

The sheet S is discharged to the bin 303. When the bin 303 is shifted up by the lead cams 301 and 302, it moves toward the A region of the sorter 1, and when it is shifted down, it moves toward the B region. In other words, when all of the bins are shifted up to reach the A region, the bin unit is at the upper home position, and the front side of the bin unit (each bin) is released.

When the bin is in the B region, there is a regulating member (alignment reference member) 305 for the erection of the width of the bin B, and therefore, when the bin B is in the B region, the sheets are aligned by the aligning rod 304 (FIG. 15) and the limiting member 305 during the sorting operation, the bin B to which the sheet S is discharged is necessarily in the B region, and when the reciprocating sorting operation is repeated, the sheet discharging bin B repeats alternately the entrance to the A region and to the B region. The sheet S once aligned in the B region, is not urged by the aligning rod 304 again, even without the front regulating member 305, and therefore, it is not disturbed by the bin shifting operation.

When the stapling mode is selected, the stapling operation is started by the stapler 306 in order from the sheet set stacked on the last sheet received bin, when the stapling mode is selected.

When the number of originals is even, all the bins B in the bin unit are in the B region (lower position), and the stapling operation is carried out in order from the topmost bin. After the bottommost bin is stapled, one bin shifting is carried out, and then, all the bins having been subjected to the stapling operation are placed in the A region. With this state maintained, the sheet sets are pushed in the direction K1 in FIG. 15 all together by the aligning rod 304, and they are stopped at a position S1, in which the lateral edges of the sets of sheets are projected beyond the end 303*c* of the bin 303. Thus, the sheet set feeding is completed.

When the number of originals is odd, if the stapling operation is started in order from the last sheet discharge bin B, when the last sheet S is discharged, then all the bins B are in the B region (the lower limit home position) at the end of the stapling operation for all bins B.

In this state, the regulating member 305 is at the front side of the sheets F, and the sheet sets cannot be pushed out. Therefore, the shifting up operation is carried out to place all of the sheet set carrying bins B in the A region. Thereafter, the sheet sets are moved by the aligning rod 304 from S0 to S1. If the bins B carrying the sheet sets are in the B region at the time when the last sheet S is discharged to the bin B, all the bins B are shifted up to the A region at all times, and only then, the side edge portions of the sheet sets are moved all together from S0 to S1 by the aligning rod 304.

Depending on whether the number of originals is odd or even, the time period required for the completion of the sheet set movement is different by the bin shifting up time. However, since the sheet sets can be taken out in the upper A region of the sorter, and therefore, at a proper level from the floor, without requiring the operator to stop, but permitting the operator to work standing. Therefore, the operability is further improved. In this case, the aligning speed and an overall pushing speed are selected in a similar manner as described above, so that the further advantageous effects are provided.

In all of the foregoing examples, when the sheets S are taken out from the bins B after completion of the copying operation, it is desirable that the entire bins B are shifted up as much as possible, by which the sheets S can be taken out with the operator.

As described in the foregoing, an alignment reference member for aligning the discharged sheets is retracted, and the sheets are pushed out by the aligning member, so that the sheet sets are pushed out all together to a easy taking-out position, thus improving the operability.

The sheet stacking member (bin) is not necessarily required to have a cut-away portion for facilitating the sheet taking-out, although it may be formed. If the cut-away portion is not used, then the strength of the stacking member can be increased. Therefore, the stacking capacity (maximum specification) can be accomplished together with the improvement of the operability.

Since the sheet set pushing operation is carried out by the aligning member, no additional member or device for the pushing is required, and therefore, the entire structure can be simplified.

In addition, the sheet conveying speed after the alignment is sufficiently made lower than the aligning speed, the disturbance of the sets of sheets by the sheet set motion on the bin, can be prevented.

The size of the driving means for the sheet set motion, is not required to be large. Referring to FIGS. 20–24, another example of the sheet aligning method will be described. In this method, when the sheets discharged to the sheet receiving tray (bin) have to be moved through a significant degree of the bin for the purpose of convenience of the post-processing such as stapling or binding or the like, they are moved after being aligned. By doing so, the sheet movement is accomplished without being influenced by the shortness of the time period of the sheet intervals in the case of a high speed copying machine, and with simple structure, and without disturbance to the aligned sheets on the sheet receiving tray.

Embodiments will be described referring to the FIGS. 20 to 24. In these Figures, the same reference numerals are assigned to the elements having the corresponding functions, and the detailed descriptions there of are omitted for simplicity.

FIGS. 20–24 are top plan views of electric staplers (binding means) in a sheet post-processing apparatus.

Figure 20:
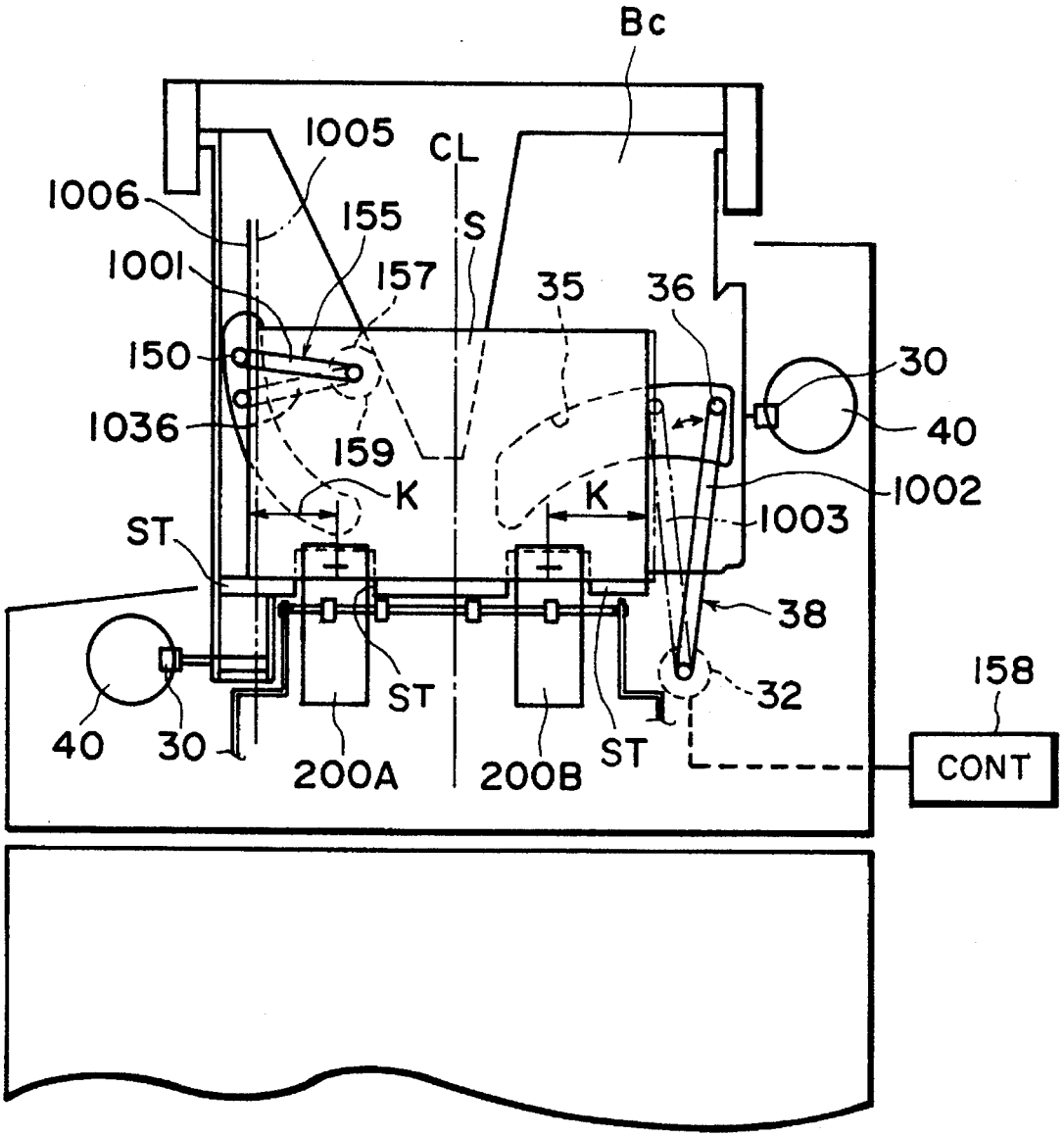
FIG. 20 is a top plan view of a sheet post-processing apparatus according to a further embodiment of the present invention.

Control means 158 of FIG. 20 is connected to pulse motors (driving means) 32 and 159 for swinging an aligning rod (first member) 36 and an aligning rod (second member) 150, and controls these motors 32 and 159.

When single stapling mode (stapling at one position) is selected, the control means 158 actuates the motor 159 at a predetermined timing before the sheet S is discharged onto the bin between the aligning rods 36 and 150, and the second aligning member 155 is shifted from the position 1001 to the position 1036, and the aligning rod 150 is retained at the alignment reference position. Subsequently, at a predetermined timing after the sheet S is discharged onto the bin B, the motor 32 is actuated, and the first aligning member 38 is moved from the position 1002 to the position 1003. Then, the aligning rod 36 is contacted to the side edge of the sheet S, and urges the sheet S to the aligning rod 150 to move it. At this time, the other side edge of the sheet S is moved from the position 1005 to the position 1006. After sheets S are discharged from the copying machine 101 to all the bins (sheet receiving tray) B, one-by-one, the above operation is carried out.

The alignment reference position is changeable in accordance with the size of the discharged sheet S. The position is selected so that the movement distance of the sheet during the alignment is small.

Then, the discharging of the sheet S from the copying machine 101 is completed, and the sheets S are aligned. Then, the first aligning member 38 is retracted to a position 1047 shown in FIG. 22, and the second aligning member 155 is moved from the position 1036 to the position 1012, by which the sets of sheets stacked on the bins B after alignment (the side edges are at the position 1006), are urged by the aligning rod 150 at the side edges while keeping the aligned state, and the side edges are positioned at the position 1013 (target position). Only the electric stapler 200*a* is actuated, but the stapler 200*b* is not actuated. Therefore, the aligned set of sheets is stapled at one position D away from the edge.

Thus, when the sheets S are aligned, the movement distance of the sheets S is short (between the position 1005 and the position 1006), and therefore, the movement can be effected in a short period such as the sheet intervals in the case of a high speed machine, without disturbance to the alignment.

When the sheets S are moved through a large stroke to a one-stapling position, all the sets of sheets S having been aligned are moved all together, and therefore, the movement period is remarkably reduced as compared with the case in which the bins are moved for each of the sheet dischargings. Therefore, the operability of the sheet stapling operation can be maintained without disadvantage in the sheet alignment and the processing period.

Figure 23:
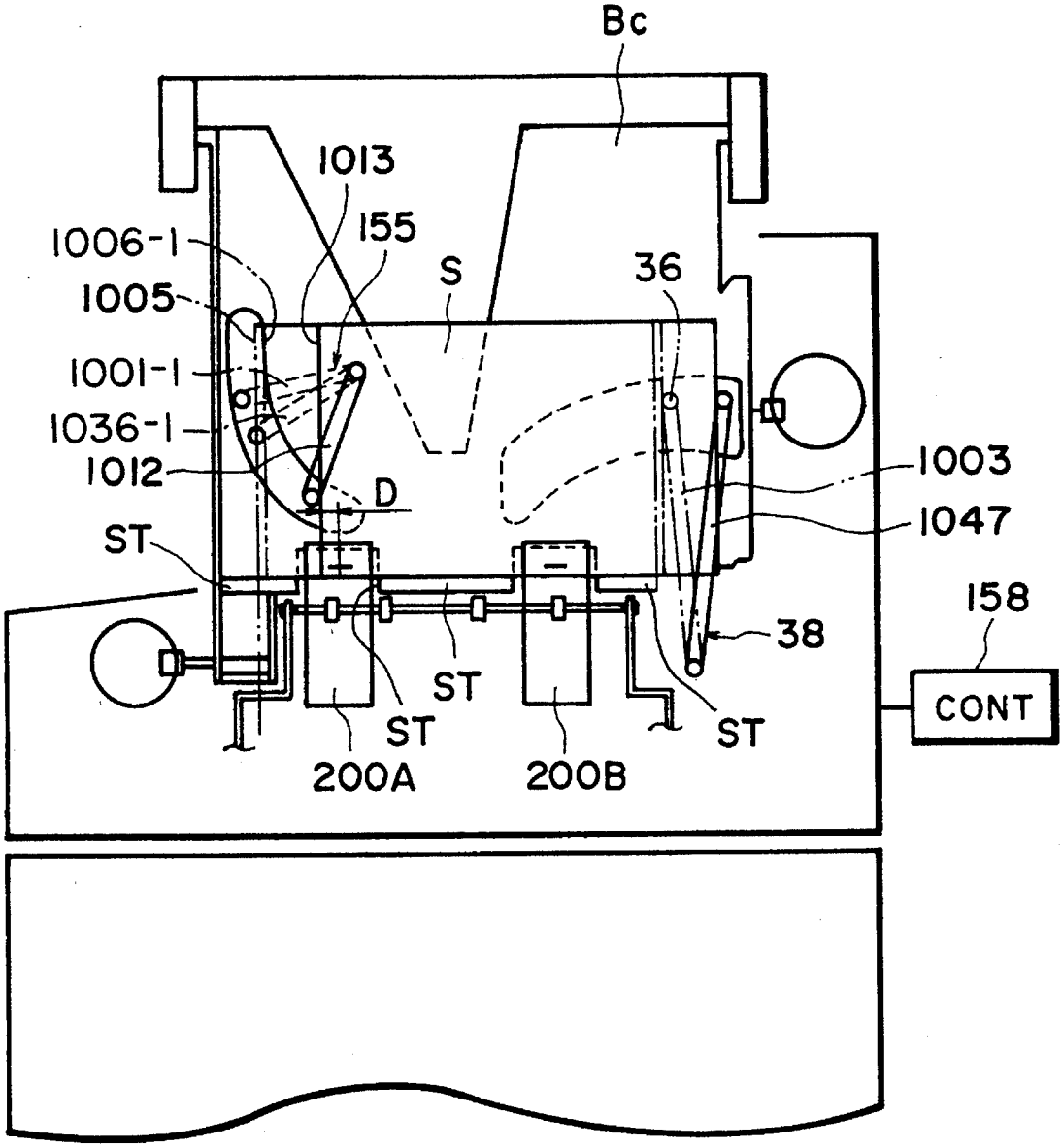
FIG. 23 is a top plan view of a sheet post-processing apparatus illustrating the operation shown in FIG. 20.
Figure 24:
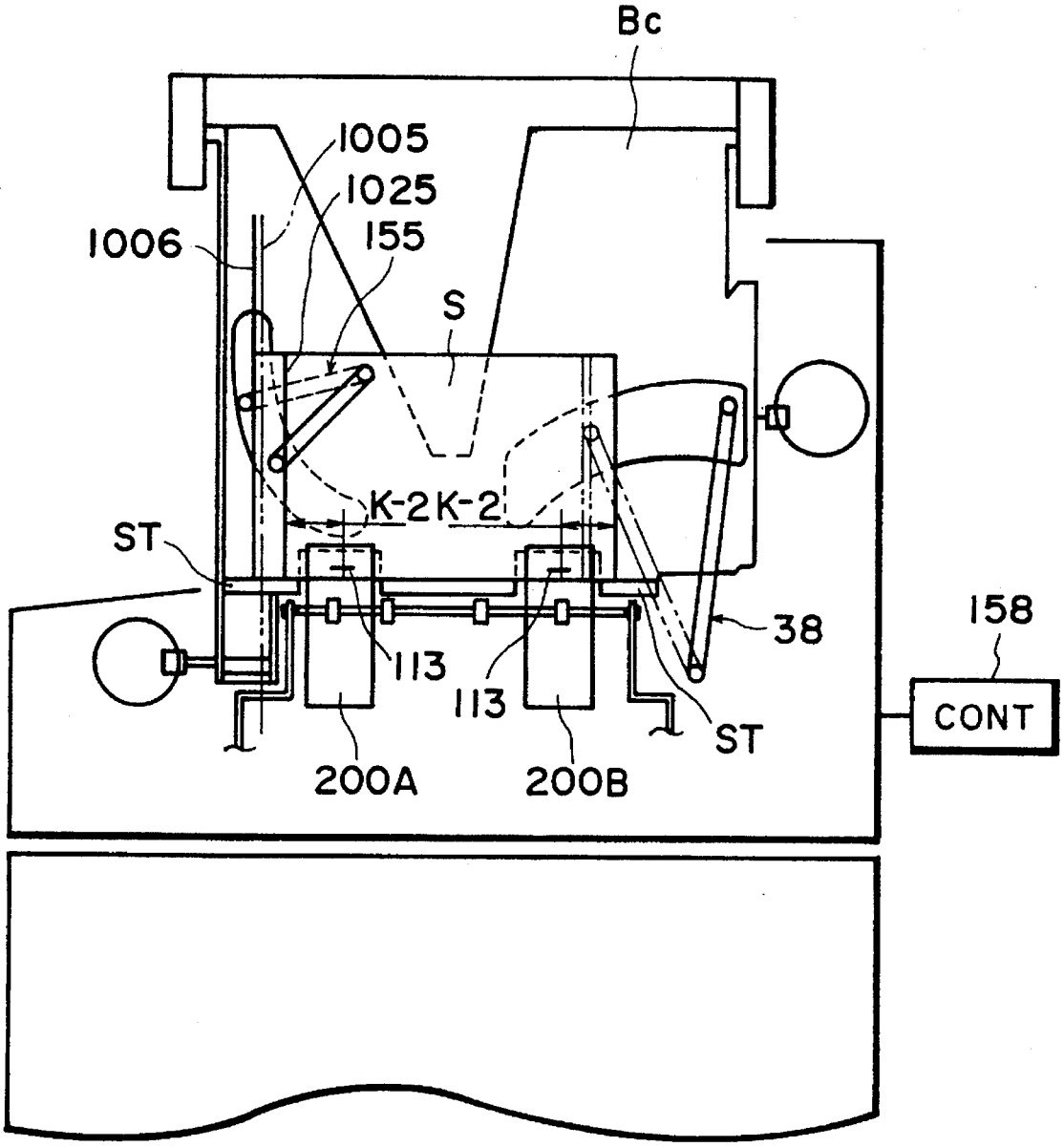
FIG. 24 is a top plan view of a sheet post-processing apparatus illustrating an operation shown in FIG. 20.

Referring to FIGS. 23–24, a further embodiment will be described. In this embodiment, the order of operation of the first aligning member 38 and the second alignment member 155 is reverse as compared with the foregoing embodiment.

As shown in FIG. 23, the first aligning member 38 is first moved to a position 1003, and the aligning rod (second member) 36 is maintained at the alignment reference position.

Subsequently, the pulse motor 159 is actuated to shift the second aligning member 155 to a position 1036-1 from the position 1001-1. Then, the aligning rod 150 is contacted to a side edge of the sheet S, and the sheet S is urged to the aligning rod 36 to move it. At this time, the position of the other side edge of the sheet S changes from a position 1005 to a position 1006-1. This operation is carried out after the sheets S are discharged to all of the bins (sheet receiving tray) B from the copying machine 101 one-by-one.

The alignment reference position is changeable in accordance with the size of the discharged sheet S. However, it is selected so that the sheet movement distance for the alignment is small.

When the sheet 5 alignment is completed, the first aligning member 38 is retracted to a position 1047 shown in FIG. 23. The second aligning member 155 is moved from a position 1036-1 to a position 1012, by which the sheet sets aligned and stacked on the bin B (the side edges thereof are at the position 1006-1), are moved so that the side edges thereof are positioned at a position 1013, while keeping the aligned state. Only the electric stapler 200*a* is actuated, (the electric stapler 200*b* is not actuated) and therefore, the sheet sets aligned are stapled at only one position D away from the side edge. Thus, the same advantageous effects are provided as in the foregoing embodiment of FIGS. 20–22.

More particularly, when the sheets are aligned, the movement distance of the second aligning member 155 is short (from 1001-1 to 1036-1). Therefore, it is properly usable with a high speed apparatus having a short sheet interval period without disturbing the alignment performance.

When the sheets S are moved through a long stroke to the one-stapling position, they are moved all together while being maintained in the aligned state. Therefore, the movement period is remarkably shorter than the case in which the movement is carried out for each bin receiving the sheet S. Therefore, the operability of the sheet stapling operation can be provided without damaging the sheet alignment performance and the processing period.

Figure 21:
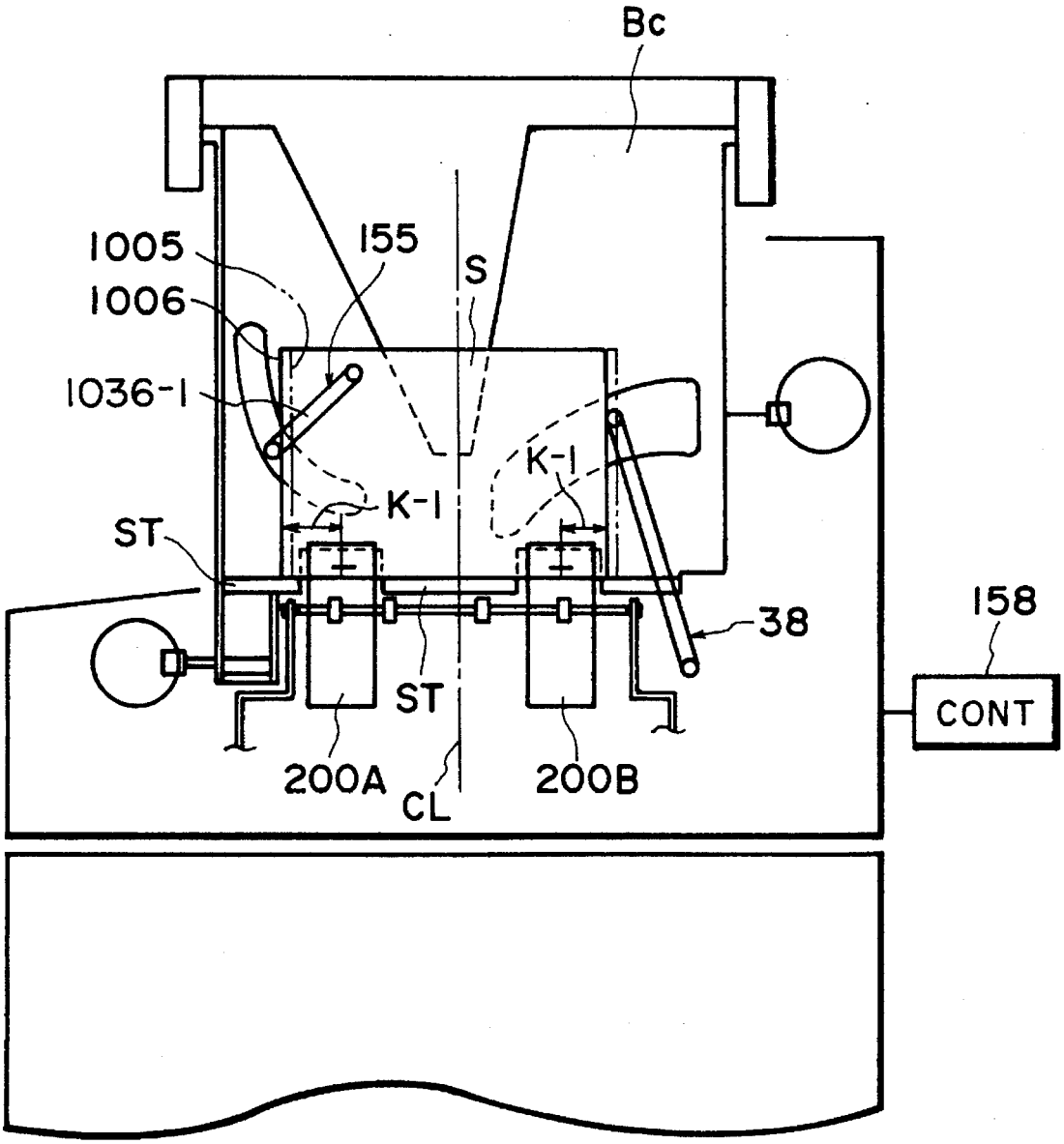
FIG. 21 is a top plan view of a sheet post-processing apparatus illustrating the operation shown in FIG. 20.
Figure 22:
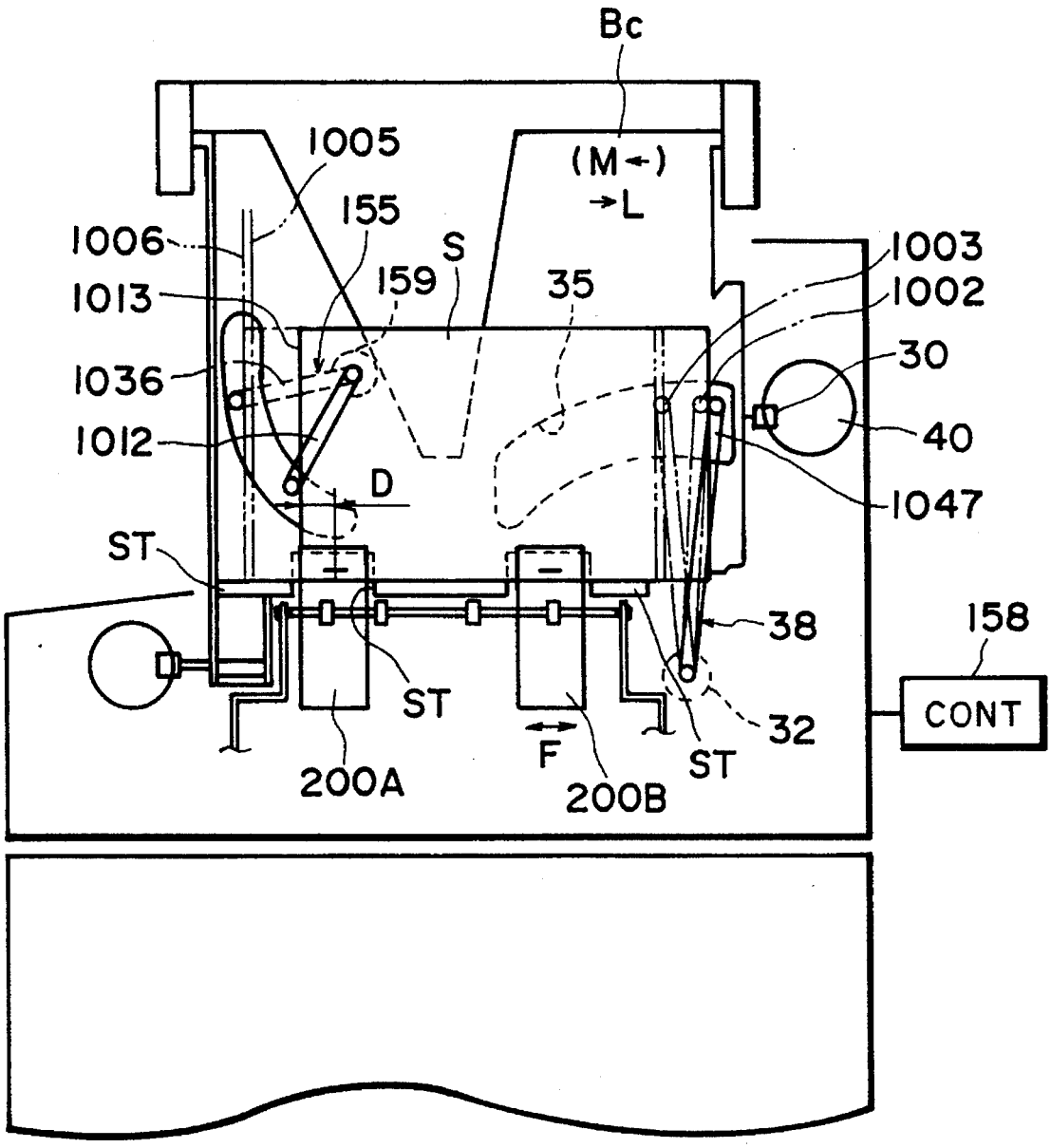
FIG. 22 is a top plan view of a sheet post-processing apparatus illustrating the operation shown in FIG. 20.

In the two embodiments described in conjunction with FIGS. 20–24, the center alignment system is used, and therefore, the center line of the discharged sheet is constant irrespective of the size of the sheet (FIGS. 20 and 21). However, this embodiment is not limited to the center line alignment. A lateral side alignment system is usable in which the lateral edge is the same irrespective of the size of the sheet. Referring to FIG. 24, the motion of the aligning members 38 and 155 in the case of the lateral alignment (front side alignment) will be described. When small size sheets are stapled at two position, the sheets S discharged while being aligned to a front side reference (1005), is first moved to a position 1006 by the first aligning member 38, so that it is aligned. Thereafter, the second aligning member 155 operates to move the sets of sheets S to a position 1044 while being kept in alignment. At this position, the sheets are stapled by the electric staplers 200*a* and 200*b* at two positions K-2 away from the respective side edges of the sheet.

In the foregoing, description has been made as to the structure in which the aligning rod not moved during the overall movement, is placed at a reference position for stapling. However, it may be retracted further to such an extent that it is not contacted to the sheet S after the end of the movement, and the stop position of the overall movement may be determined only by the moving aligning rod. When the sheets S are moved after the alignment, one of the aligning members 38 and 155 is first retracted, and the sheets S are moved by the other aligning member 155 or 38. However, the sheet set may be gripped by the aligning members 38 and 155, which may be moved at the same speed to move the sets of sheets.

In this embodiment (FIGS. 20–24), the aligning members 38 and 155 are rotated. However, they may be a reciprocating type.

Figure 25:
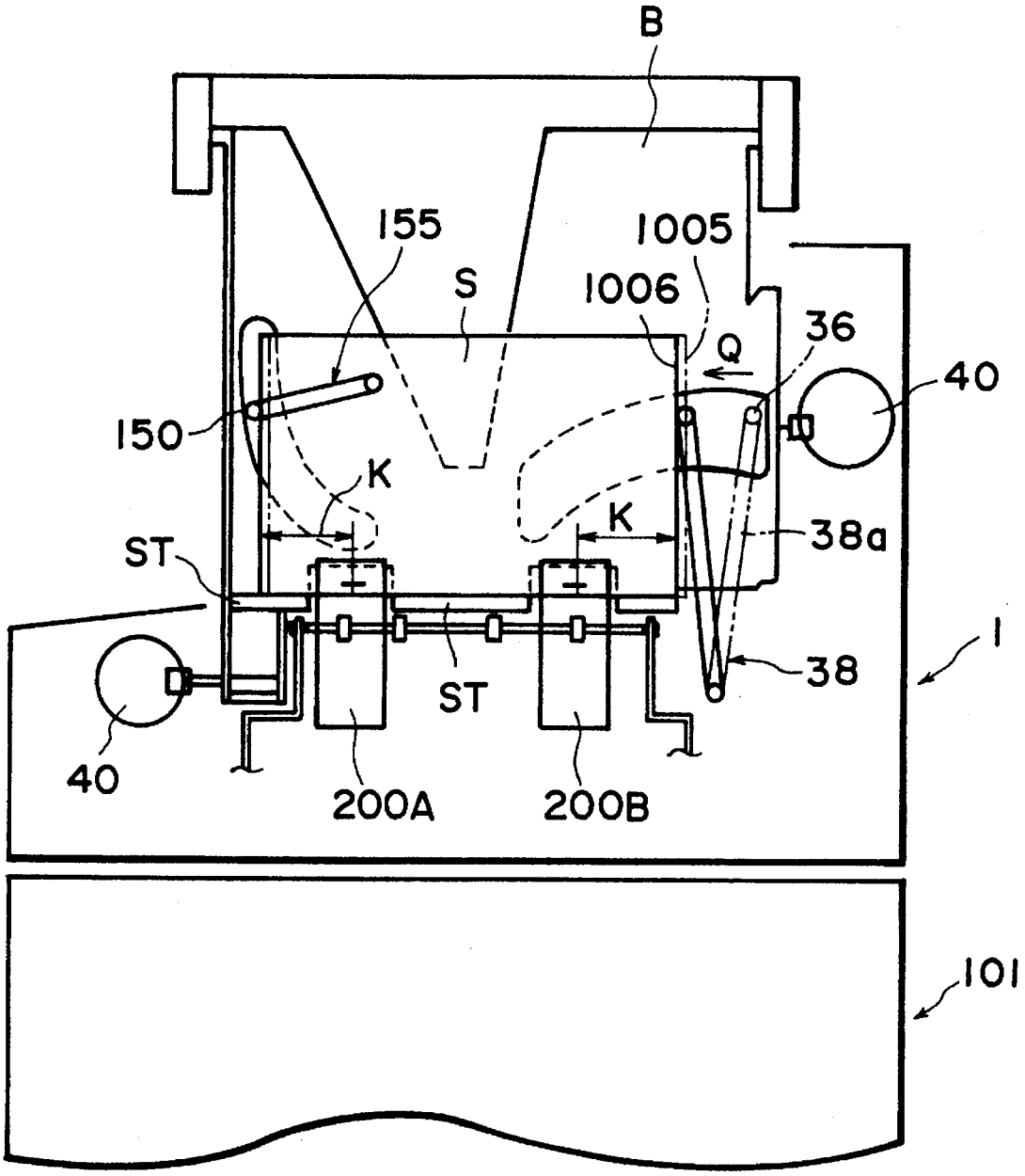
FIG. 25 is a top plan view of an example which is compared with the apparatus of FIG. 20 embodiment.

The advantageous effects of the sheet aligning method of FIGS. 20–24, may be explained in comparison with another example (FIGS. 25 and 26) not using this method. In this another example, immediately before the start of sheet stacking on the bin B, the second aligning member 155 has been moved by the driving means including a motor 159 and a gear train to a position which is a reference for the sheet side edge (the solid line position in FIG. 25), from the stand-by position. The aligning rod 150 is retained at the reference position for the sheet side edge. The aligning rod 36 of the first aligning member 38 is driven through a predetermined distance in a direction Q from the stand-by position 38*a*, as shown in FIG. 25, by a pulse motor 32 rotatable in accordance with the pulse signal responsive to the sheet size by which the side edges of the sheets S are urged to the aligning rod 150 of the second aligning member 155.

Therefore, the sheets S discharged to the bin B with the side edges thereof at a position 1005, are moved so that the side edges thereof are positioned at a position 1006. The first aligning member 38 returns to the stand-by position 38*a* in preparation for the next sheet S discharged.

This operation is repeated, the lateral edges of the sheets S stacked on the bin B, are abutted to the second aligning member 155, and the trailing edges thereof are contacted to the guide ST of the bin B. As a result, the sheet set is aligned. Since the aligning rod 36 or the like of the first aligning member 38 extend through all the bins B, the sheets S stacked on all of the other bins B are similarly aligned.

The stapling operation for the sheets S discharged to and accommodated on the bin B, is selectable. If then the stapling mode is not selected, the operation of the sorter 1 is temporarily stopped.

In response to a stapling start signal from the control means not shown, the electric stapler 200 moves from the stand-by position 200*a* to the position 200*b*, and as shown in FIG. 6 for example, the head 210 of the electric stapler 200 enters the upper expanded portion X formed between the accommodating bin Bc for accommodating sheets to be stapled and the upper bin Bb. The anvil 211 enters the lower expanded portion X". The electric staplers 200 carry out the stapling action by a motor (not shown) so that the sheets are stapled at two positions K away from the side edges. On the other hand, when one-position stapling mode is selected, the first aligning member 38 awaits at a position indicated in FIG. 26, the aligning rod 36 is retained at a predetermined position (alignment reference position).

When the sheet S is discharged to the bin Bb (the side edge is aligned to 1005) from the copying machine 101, the motor 159 is actuated, and the second aligning member 155 is moved from the stand-by position 155*a* to a position 155*b*. At this time, the aligning rod 150 urges the side edges of the sheets S. Therefore, the sheets S are moved to such an extent that the other side edges are contacted to the aligning rod 36. Therefore, the position of the lateral edges of the sheets S is changed from a position 1005 to a position 1013. Such an operation is repeated, and the side edges of the sheets S stacked on the bin B are contacted to the aligning rod 36, and the trailing edges thereof are abutted to a guiding portion ST of the bin B. As a result, the sheet set is aligned.

Then, in response to the actuation only of the electric stapler 200*a*, the sheets are stapled only at one position D away from the lateral edge of the sheet. At this time, the electric stapler 200*b* is not operated.

After completion of the above-described stapling operation, the electric staplers 200 are returned to the position 200*a*, and the stapling operation for one bin is completed.

Figure 26:
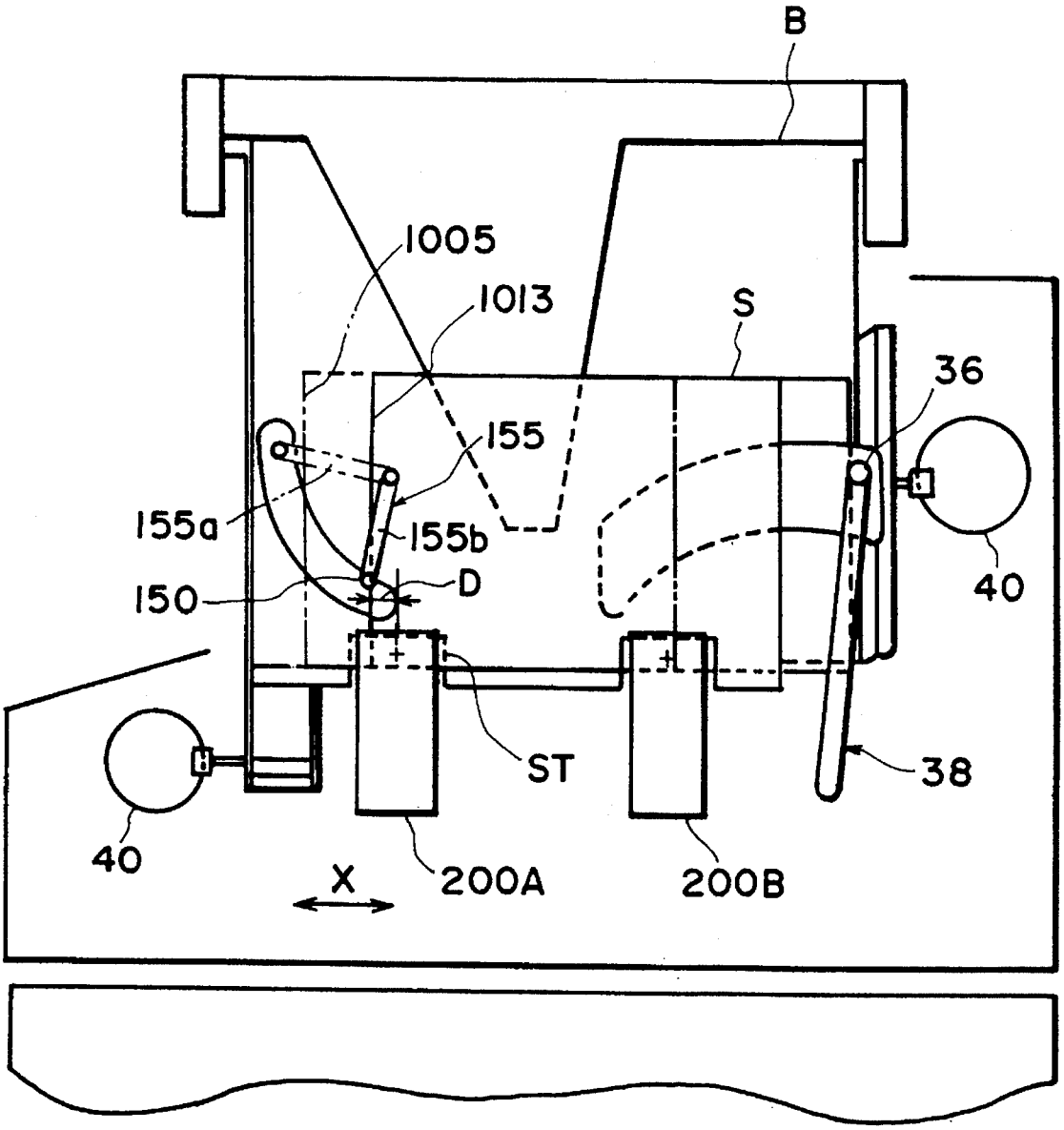
FIG. 26 illustrates operation of FIG. 25 example.

According to the above structure of FIGS. 25 and 26, one-position or two-position stapling can be performed without laterally moving the electric stapler 200. Therefore, it is advantageous, but it involves the following problems.

(1) When the two-position stapling is carried out using the electric stapler (FIG. 25), the sheet movement distance from position 1005 to position 1006 is short, and therefore, preferable, as described in the foregoing. However, when the one-position stapling is carried out by the electric stapler 200, the distance between the discharge position 1005 and the aligning position 1013 is large, and therefore, the movement distance of the second aligning member 155 is large.

(2) Therefore, if it is joined with a high speed copying machine, then the distance between the sheets is short, and the time period between adjacent sheets is short. For this reason, in order to reciprocate the second aligning member 155 from a position 155*a* to the position 155*b* to align the sheet in this period (the sheet interval), the speed of the second aligning member has to be significantly high. According to the foregoing embodiments (FIGS. 20–24), the above problems are solved.

Figure 27:
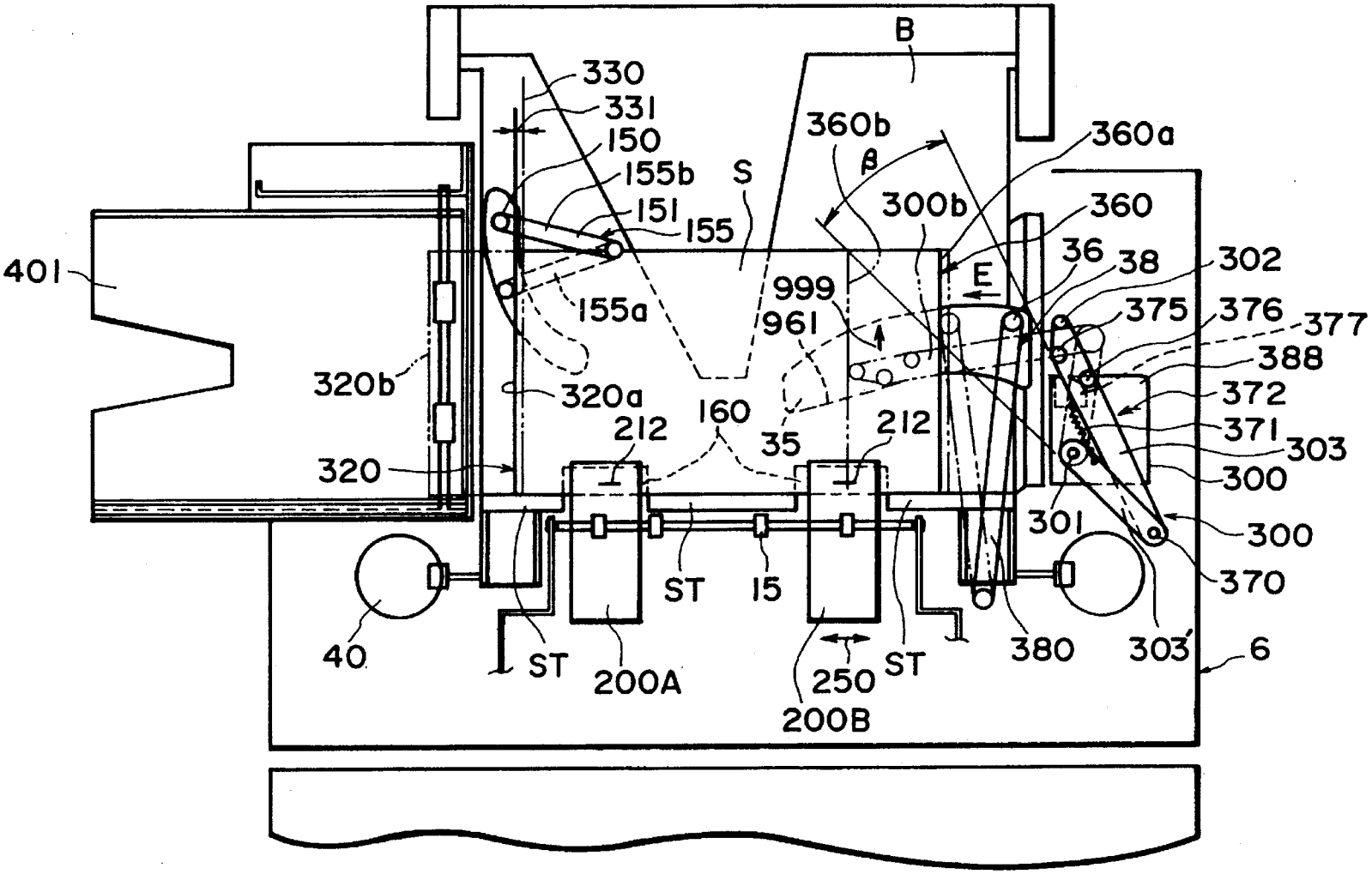
FIG. 27 is a top plan view of a bin unit according to a further embodiment of the present invention.
Figure 28:
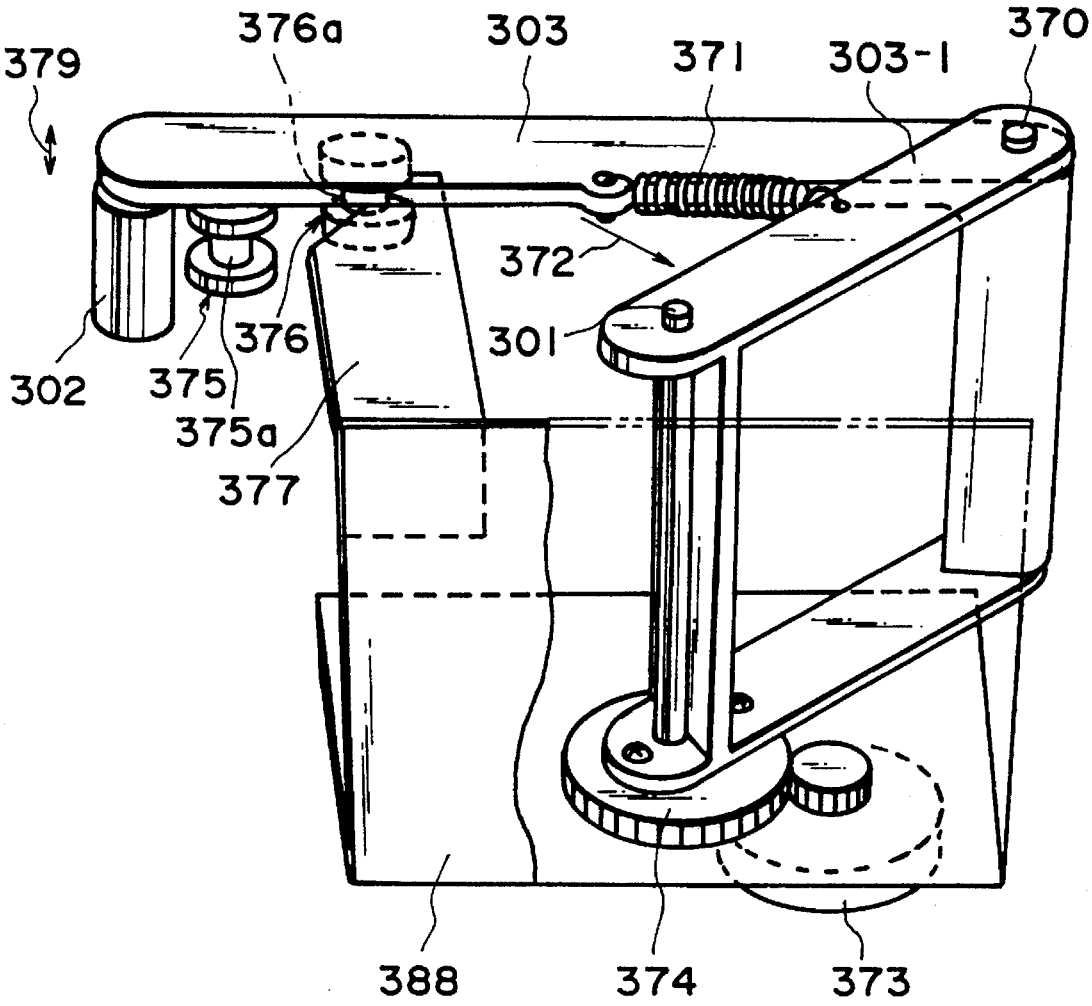
FIG. 28 is a perspective view of a sheet taking-out device shown in FIG. 27.
Figure 29:
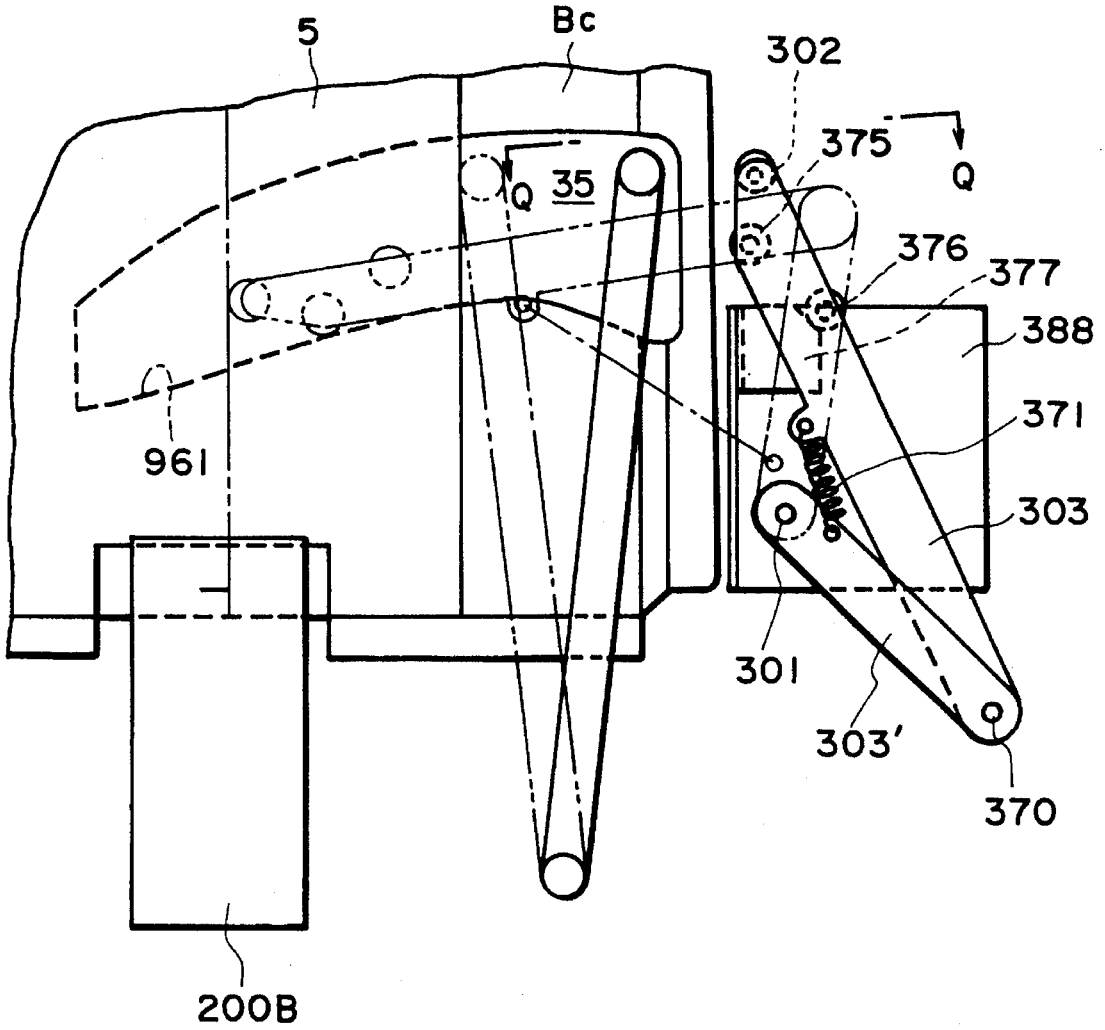
FIG. 29 illustrates a locus of motion of the sheet taking-out device shown in FIG. 27.
Figure 30:
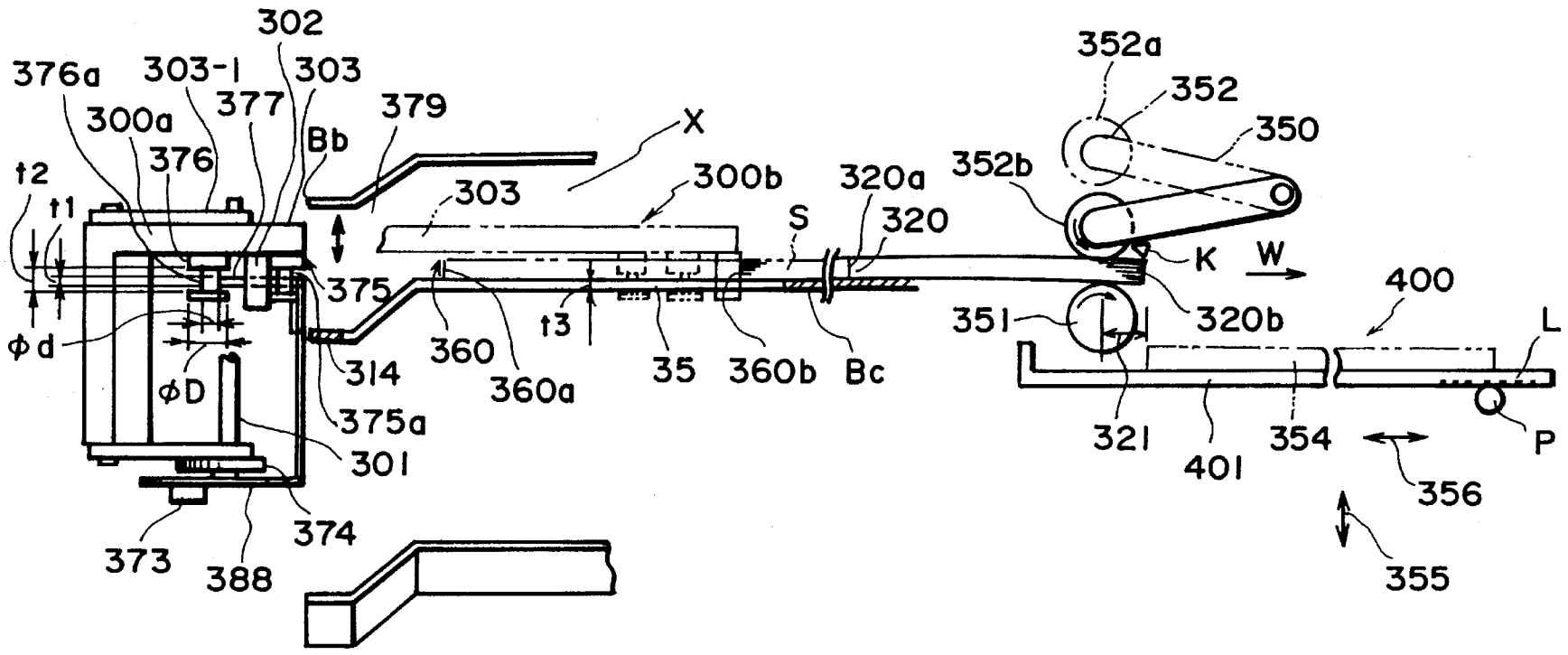
FIG. 30 is a sectional view taken along a line Q—Q in FIG. 29.

Referring to FIGS. 27–35, another means for taking the sets of sheets out, will be described. The sorter main assembly 6 is provided with a sheet taking-out device (sheet feeding means) 300 at a level facing to the bin Bc for which the sheets are stapled by the electric stapler 200 (FIGS. 27, 29 and 30). The sheet pushing means 300 pushes the sheets S stacked on the bin B therefrom.

The sheet pushing means 300 is provided with a supporting plate 388 (FIG. 28), and the supporting plate 388 is provided with a regulating member 377 having an L-shaped cross-section. On the supporting plate 388, a rotational center shaft 301 is rotatably supported, and on the shaft 301, an arm 303-1 is rotatably supported, as shown in FIG. 28. The arm 303-1 is rotated by a motor (driving means) 373 through gear 374 or the like. On the arm 303-1, an operating arm 303 is rotatably mounted for rotation about shaft 370. Therefore, the arm 303 is rotatably supported along the bin B. The arm 303 is provided with two positioning members 375 and 376, and the positioning members 375 and 376 are rotatably supported on the arm 303, and are provided with small diameter portions 375*a* and 376*a*. To the end of the arm 303, a pushing rod 302 is mounted.

As shown in FIG. 30, the diameter of the small diameter portions 375*a* and 376*a* is $\phi d$, and the diameter of the other large diameter portion is $\phi D$, then, $$\phi d<\phi D$$

On the other hand, when a thickness of the regulating member 377 is t1, and the vertical width of the small diameter portions 375*a* and 376*a* is t2, and the thickness of the bin B is t3, then, t2>t1, t3

Between the arm 303-1 spring 371 is disposed, and the arm 303 is urged in the direction of an arrow 372.

FIG. 28 shows the positional relation where the arms 303-1 and 303' are at the stand-by positions, and the arm 303-1 is urged to the regulating member 373 side by the spring 371, and the positioning is effected by the groove 376*a* of the positioning member 376 being abutted to the limiting or regulating member 377. In this state, the regulating member 377 is engaged with the groove 376*a* of the positioning member 376. Therefore, the motion of the sheet pushing means 300 in the direction of the arrow 379 (vertical direction), is regulated.

The sheet pushing device 300 is always faced to the bin Bc for which the sheet stapling operation is carried out irrespective of the vertical movement of the bin unit 9. In addition, when the bin unit 9 moves in the vertical direction, it is maintained at the stand-by position so as not to interfere with the bin unit 9.

When the sheet is to be taken out, the arms 303-1 and 303' are rotated, and the arm 303 enters the wider expanded portion X without interference with the upper or lower bins Bb and Bc to the urging region for urging the lateral edge of the sheet S. The distance between the stand-by position to the urging region is changeable in accordance with the size of the sheets S. The stand-by position and the urging region (maximum pushing position) are indicated in FIG. 30 by solid line 300*a* and chain line 300*b*, in FIG. 30.

Figure 31:
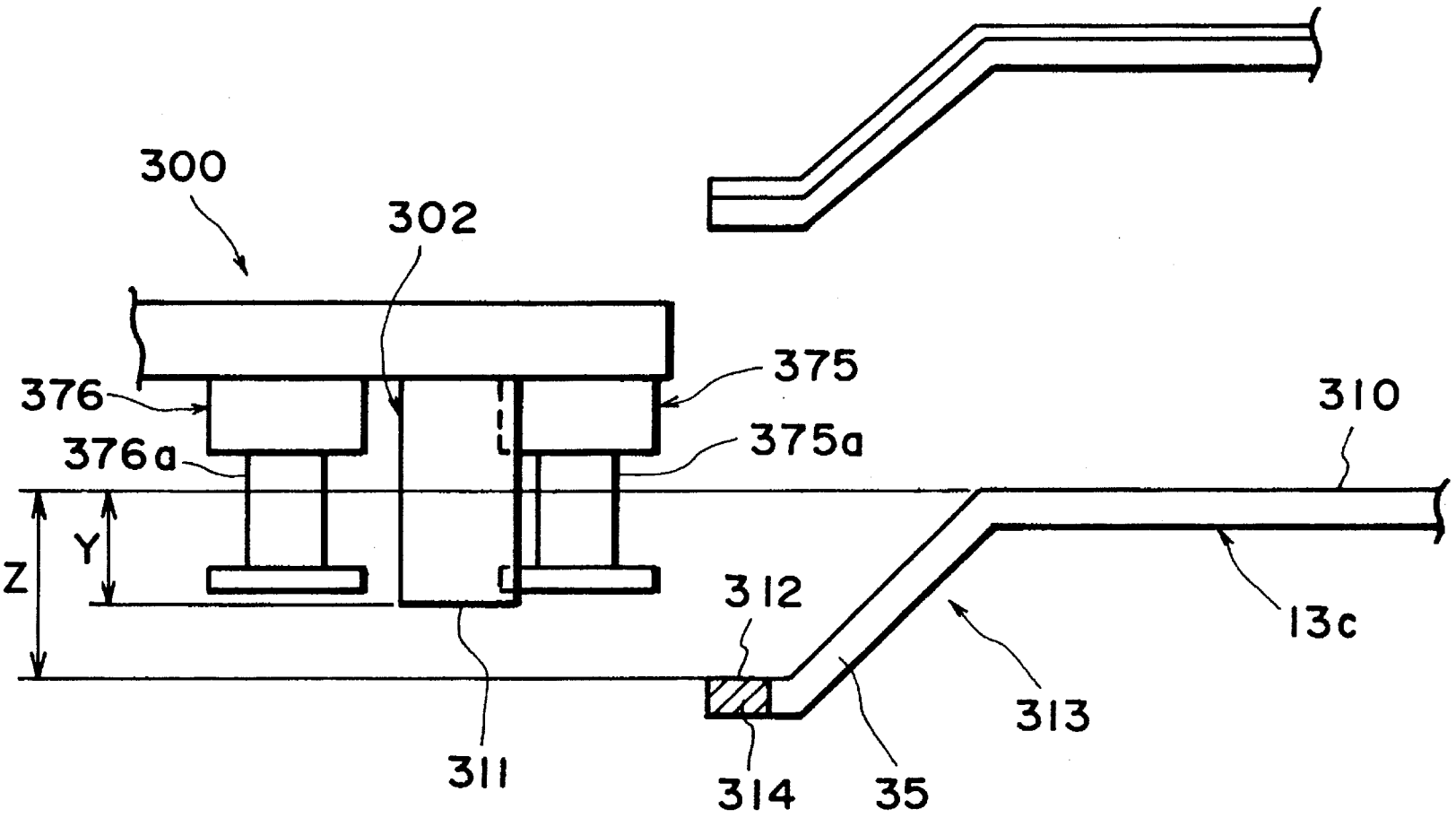
FIG. 31 is an enlarged view of the cross-section shown in FIG. 30.

Referring to FIG. 31, the description will be made as to the configuration of the bin Bc and the engagement relation with the sheet pushing device 300. FIG. 31 is a sectional view taken along a line Q—Q in FIG. 29.

As shown in FIG. 31 in detail, an inclined portion 313 is formed at an end of the bin Bc facing to the sheet pushing device 300, and the bin Bc is provided with a sheet stacking face 310, and an end surface 312 a distance Z below the stacking surface 310. The bin Bb is provided with a cut-away portion through which the aligning rod 36 of the first aligning member 38 extends. The cut-away portion extends over the inclined portion 313 and the stacking surface 310. With the motion of the arm 303, the positioning member 376 or the like mounted on the arm 303 enters the cut-away portion 35 without interference with the bin Bc. From the standpoint of the mechanical strength of the bin Bc, the cut-away portion 35 is not formed in the bin end portion 314. A groove 375*a* of the positioning member 375 is engaged with an end edge (guiding portion) 961 of the cut-away portion 35.

As shown in FIG. 31, a lower end surface 311 of the pushing rod 302 mounted to an end of the arm 303, is a distance Y below the stacking surface 310 (Y<Z). It is guided to the cut-away portion 35 in the bin Bc, and pushes the sheets S out while keeping the distance Y.

As shown in detail in FIG. 30, at the position of the end 320*b* of the sheet S after the motion, a pair of gripping rollers 351 and 352 are rotatably supported, and they are rotated in the direction indicated by arrows in the Figure by an unshown driving means.

By the rotational movement, the sheets S are moved in the direction W in the figure, and are stacked on a stacking tray 401 of the stacker 400.

The upper roller 352 is normally positioned at an upper stand-by position 352*a*, and when the entry of the end of the sheet is detected by the detecting means K, it is lowered by the driving means (not shown) to the gripping position 352*b*, so that the sheets S are gripped in cooperation with the lower roller 351 (sheets S are as indicated by 354).

The tray 401 is movable in the direction of an arrow 355 depending on the sheet stacking state. In order to sort the sheets for respective bins, it is also movable in the direction of an arrow 356 by a combination of a rack L and a pinon P.

The operation of this embodiment shown in FIGS. 27–35, will be described. Before the start of the sheet stacking on the bin B, the second aligning member 155 has been moved by driving means including a motor or gear train to a position 155*a* which is a reference for edges of the sheets, from the stand-by position 155*b* (FIG. 27). The aligning rod 36 of the first aligning member 38 moves through a predetermined distance from the stand-by position 38*a* in the direction indicated by an arrow E by the pulse motor 32 which rotates in accordance with the pulse signal responsive to the sheet size, so that the lateral edges of the sheets S are abutted to the aligning rod 150 of the second aligning member 155 (FIG. 27). After the first aligning member 38 moves through a predetermined distance, it is returned to the stand-by position 38*a*, in preparation for the next sheet discharging.

In such an aligning operation, the sheets S are discharged onto the bin B of the sorter from the main assembly 102 of the copying machine with a lateral edge aligning system, that is, being aligned with a front side line 330. Therefore, the sheets S are aligned by motion through the distance 331. At this time, the first aligning member 38 is selected as the reference side, and the second aligning member 155 is moved to the aligning position from the stand-by position, with the sheet stacked onto the bin B. Otherwise, both side regulating members may be moved to the above positions to effect the alignment. The above operation is repeated, and a plurality of sheets S are aligned on one bin Bb with one of the lateral edges aligned with the second aligning member 155 and with the trailing edges abutted the rear end stopper ST.

The aligning rod 36 or the like of the first aligning member 28 extends through all the bins B, and the sheets S accommodated on the other bins B are similarly aligned.

The stapling operation for the sheets S discharged to and accommodated on the bins, is selectable. When the stapling mode is not selected, the operation of the sorter 1 is temporarily stopped here. If the stapling mode is selected, then the electric stapler 200 moves from the stand-by position 200*a* to a position 200*b* in response to a stapling start signal generated from an unshown control means, so that it is moved to the stapling position indicated by solid lines in FIG. 2.

At this time, as shown in FIG. 2 for example, the head 210 of the electric stapler 200 enters the upper expanded portion X formed between the bin Bc accommodating the sheets S to be stapled and the bin Bb thereabove. The anvil 211 enters the lower open position X" to the stapling position.

When the electric stapler 200 moves to the stapling position, a stapling signal is produced from the unshown control means, so that the electric stapler 200 is actuated to staple the sheets S.

After completion of the stapling operation, the electric stapler is returned to the position 200*a*. This is the end of the stapling operation for one bin.

When the operator designates a number of sets of copies which is larger than the number of bins provided in the bin unit 9, the copying machine 102 and the sorter 1 first produce the number of sheet sets which is equal to the number of bins in the manner described in the foregoing. Then, the control means produces a sheet pushing signal, so that the sheet pushing operation is started.

The sheet pushing operation will be described. First, the bin Bc from which the sheets are to be taken out moves to face the sheet pushing device 300. Then, the second aligning member 155 rotates from the alignment reference position 155*a* to the stand-by position 155*b* not interfering with the sheets S upon the pushing operation.

As described hereinbefore, in the vertical movement of the bin unit 9, the sheet pushing device 300 is retained at the stand-by position 300*a*. At this time, the positioning is established by the engagement between the groove 376*a* of the positioning member 376 and the regulating or limiting member 377.

Subsequently, the motor 373 is actuated, so that an arm 303 rotates. However, the arm 303 is urged in a direction 372 by a spring 371, and therefore, the groove 376*a* moves while being in contact with the limiting member 377. With this state, the arm 303 rotates further, and the positioning member 375 moves to the bin B side. An end of the bin B is provided with an inclined portion 313, which is provided with a cut-away portion 35, and therefore, the positioning member 375 or the like moves into the cut-away portion 35 without interference with the bin Bc.

Figure 37:
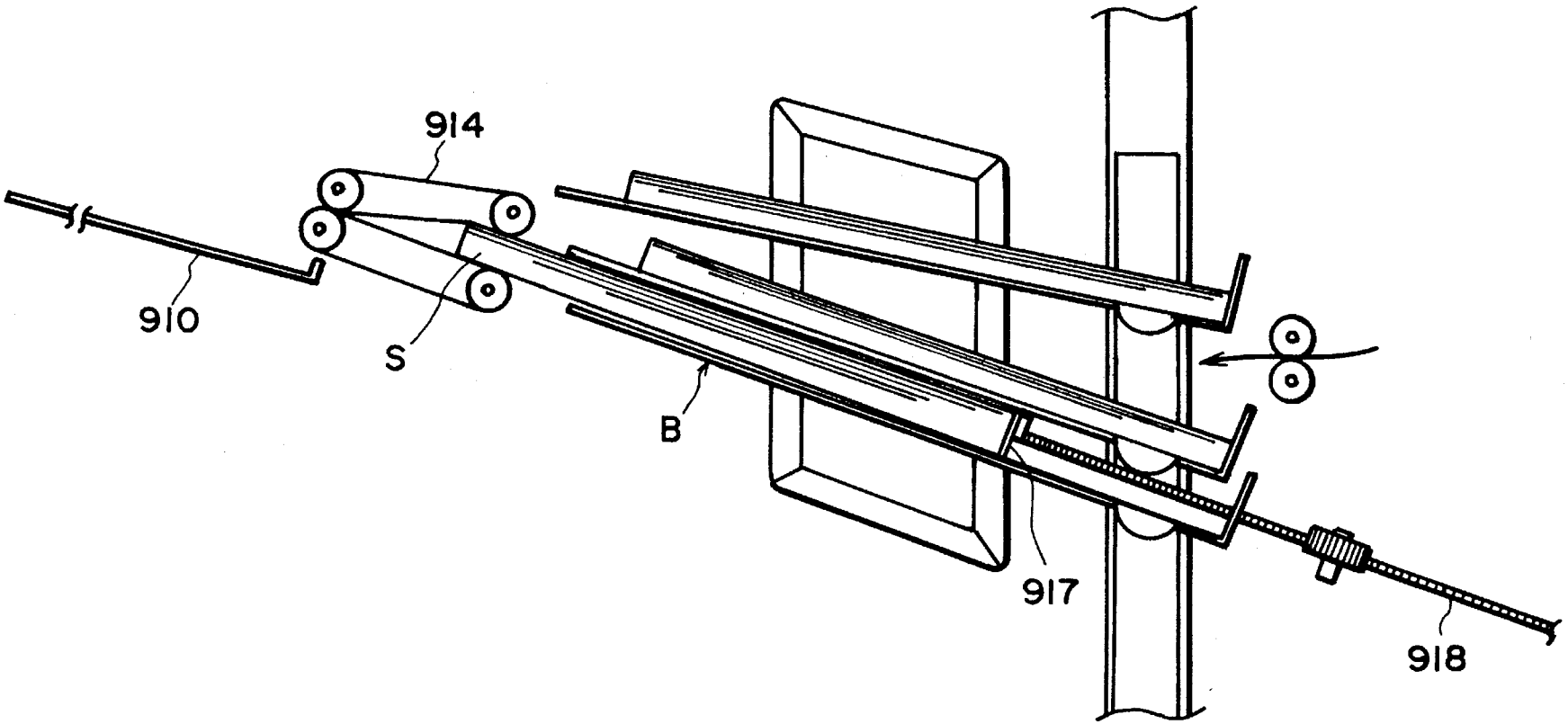
FIG. 37 is a longitudinal sectional view of a comparative apparatus for the apparatus of FIGS. 27–36.

When the arm 303 moves further, engagement is established between the groove 375*a* of the positioning member 375 and an edge 961 of the cut-away portion 35 (FIG. 27). At this time, the arm 303 is urged by a spring 371, and therefore, the groove 375*a* moves along the end edge of the cut-away portion. The relationship between the width t2 of the groove 375*a* and the thickness t3 of the bin Bc is t2>t3. Therefore, it is limited in the vertical position 379. The arm 303 moves to a predetermined position (300*b*) with the central shaft 307 retained as the pivot, while the angle formed with the arm 303 is being expanded. After the positioning member 375 is engaged with the end edge 961 of the cut-away portion, the engagement between the positioning member 376 and the regulating member 377 is released. Therefore, the groove 376*a* of the positioning member 376 is prevented from disengaging from the end edge 961. The sheet pushing device 300 moves from the stand-by position 300*a* to the pushing position 300*b* in accordance with the size of the sheets. When the arm 303 moves in this manner, the rear end edge 306 of the sheets S on the bin Bc is pushed by the pushing rod 302, and the side edge 306 is moved from the initial aligned position 360*a* to the taking-out position 360*b* (FIGS. 37 and 30).

In FIGS. 27, the position 320*a* indicated by the solid line is a front side end of the sheet before the movement, and the chain line position 320*b* is that after the movement. Here, the sheet S is moved while being guided by the rear end stopper ST at its trailing edge, and therefore, it is not deviated on the bin B. After the sheets are moved through a predetermined distance, the sheet pushing device 300 is permitted to return to the initial stand-by position 300*a*.

At the position of the leading edge 320*b* of the sheets S after the movement, there is a pair of gripping rollers 351 and 352, and the upper roller 352 is normally above the stand-by position 352*a*. When a detecting means K detects the entrance of the leading edge of the sheet, it lowers to the gripping position 352*b* by driving means to cooperate with the lower 351 to grip the sheets by the urging means. Thereafter, the rollers 352 and 351 rotate in the direction indicated by an arrow, so that the sheets S are moved in the direction W to a tray 401 of the stacker 400 (sheets S are as indicated by reference numeral 354). The tray 401 is movable in the direction indicated by an arrow 355 depending on the state of sheet stacking. In order to sort the sheets for each of the bins, it is movable in the direction 356 by a combination of a rack and pinion.

To the bin B which is now empty, a next set of sheets S is discharged, and the sheet sets are produced.

In the vertical motion of the bins, at least one of the first aligning member 38 and the second aligning member 155 is at the sheet aligning position respectively, and if the alignment is carried out by a movable side aligning rod after the shifting operation is completed, then the unstapled sheets are not deviated on the bin.

By doing so, during the entrance to the bin Bc and after the entrance thereto, the leading end (pushing rod 302) of the sheet pushing device 300 is limited in its vertical position (arrow 379 direction) by the positioning member 375 and 376. Therefore, during motion of the arm 303, it hardly moves in that direction. For this reason, the clearance between the bins Bb and Bc can be minimized.

In addition the locus after the entrance of the sheet pushing device 300 into the bin Bc, is determined by the configuration of the end edge 961. Thus, the locus of the pushing rod 302 can be selected properly (linear or the like).

Furthermore, the positioning member 375 is urged to the end edge 961 by a spring 371, and therefore, it does not move in the direction 399 (FIG. 20). Accordingly, the size of the cut-away portion 35 can be minimized. Thus, the reduction of the mechanical strength of the bin B can be minimized.

Figure 36:
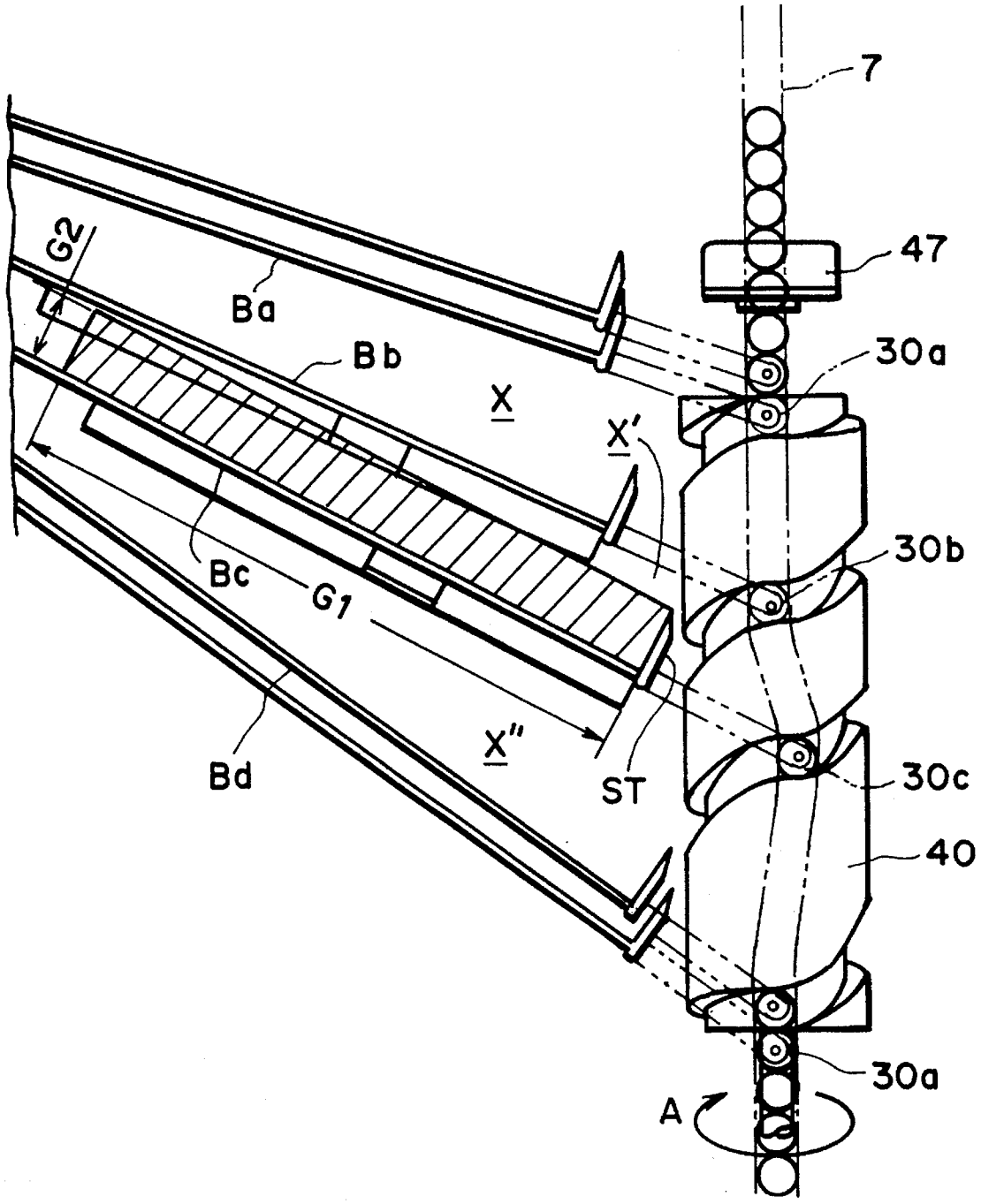
FIG. 36 is a sectional view of a bin unit of FIG. 27.

As shown in FIG. 36, the lead cam 40 is disposed outside a hatched region in the sheet pushing direction, the region being defined by a stackable sheet width G1 and a stackable height G2. Therefore, the sheet sets can be easily taken out while being guided by the trailing edge stopper ST of the bin B described above.

On the other hand, in the embodiment of FIGS. 27–31, a second aligning member 155 is mounted on the bin frame 19 of the bin unit 9 since there is provided a first aligning member comprising an aligning rod 36 or the like for aligning the sheet in the bin unit 9, the sheets S can be reliably aligned on the bin B. The sheets are aligned by the motion of the aligning rod 36 extending through the cut-away portions 35 of all of the bins, and the aligning rod 36 is mounted on the bin unit, by which the sheets S can be aligned by the aligning rod 36 not only after the sheets are discharged to the bin B but also during the bin shifting. In other words, the sheets S can be always aligned unless the sheet S is entering the bin B.

In the embodiment of FIGS. 27–31, the first and second aligning members 38 and 155 are moved by rotation about the rotational shaft, and the rotational shaft is integrally mounted on the bin unit 9, and therefore, the sheet aligning operation is always stabilized.

The sheet aligning means on the bin described above is of a front edge aligning type. However, it may be of a rear edge alignment type or center line alignment type.

Figure 32:
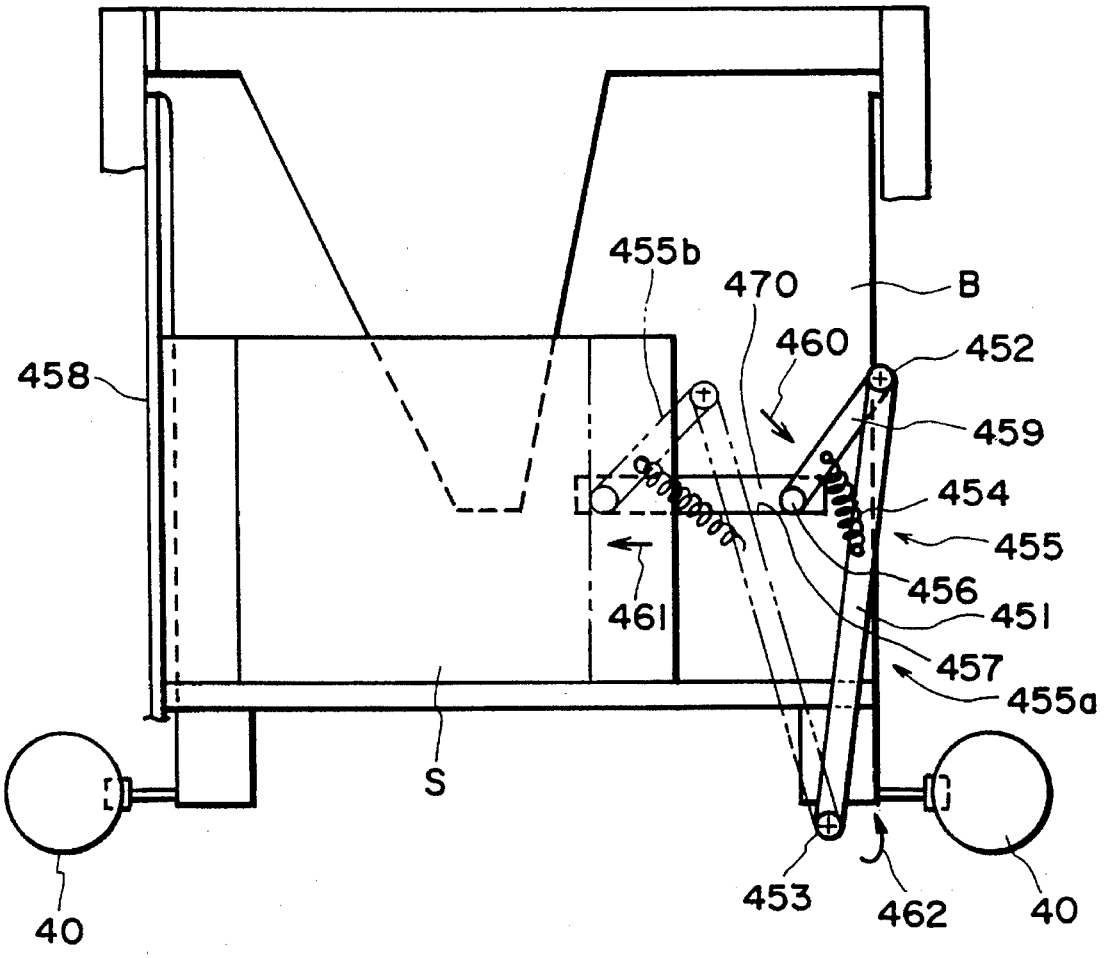
FIG. 32 is a top plan view of an apparatus according to a further embodiment of the present invention.
Figure 33:
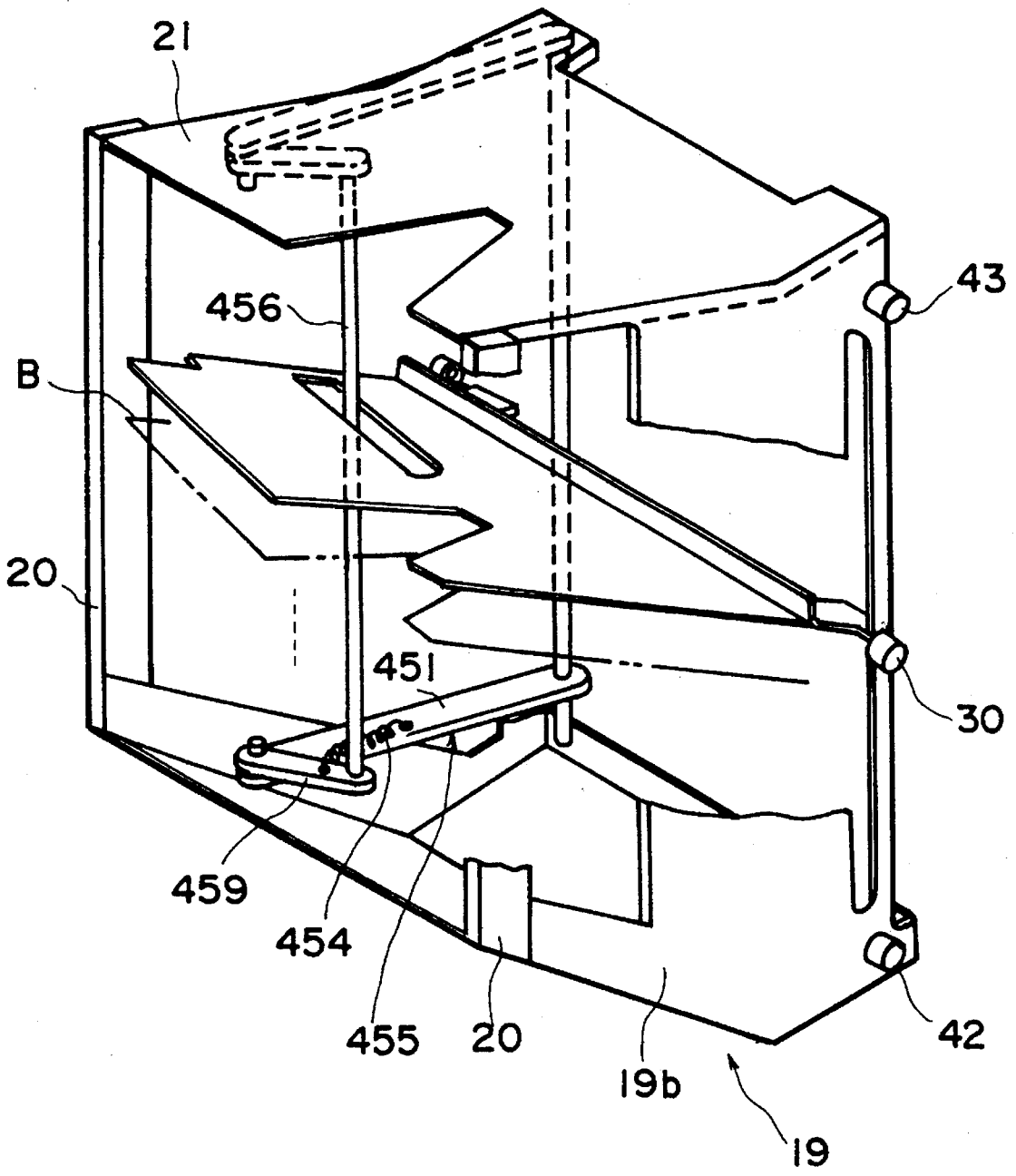
FIG. 33 is a perspective view of an apparatus of FIG. 32.

Referring to FIGS. 32 and 33, a further embodiment will be described. The same reference numerals as in FIGS. 27–31 are assigned to the elements having the corresponding functions, and the detailed description there of are omitted for simplicity.

An aligning member (sheet feeding means) 455 is provided with an aligning rod 456, an arm C (operating arm) 459, an arm D 451 or the like. The arm C 459 is rotatably supported on a rotational central shaft 452 mounted on the arm D 451. The arm C 459 is urged in the direction of an arrow 460 by a spring. The arm D 451 is rotatable by an unshown driving means about the rotational shaft 453 on the bin frame 19. The aligning rod 456 is mounted to an end of the arm C 459, and it extends through the cut-away portions 470 of all bins (sheet receiving trays). Across the sheet S from the aligning member 455, there is an alignment reference plate 458. With this structure, the aligning rod 456 of the aligning member 458 is urged to an end surface (guiding portion) of the bin cut-away portion 470. When the arm D 451 rotates in the counterclockwise direction (arrow 462) by an unshown driving means, the aligning rod 456 is guided by an end surface 457 of the cut-away portions of the bins, so that it moves in the direction 461. Then, the sheets S on the bin B are urged to the alignment reference plate 458, so that the sheets S on all of a bins are aligned in the manner similar to the foregoing. By doing so, the size of the cut-away portion of the bin B can be minimized, similar to the foregoing embodiments. Depending on the configuration of the end surface 457 of the bin cut-away portion, the sheet pushing direction may be straight or otherwise, rather than the conventional arcuate motion, by which the sheet alignment may be improved.

Figure 34:
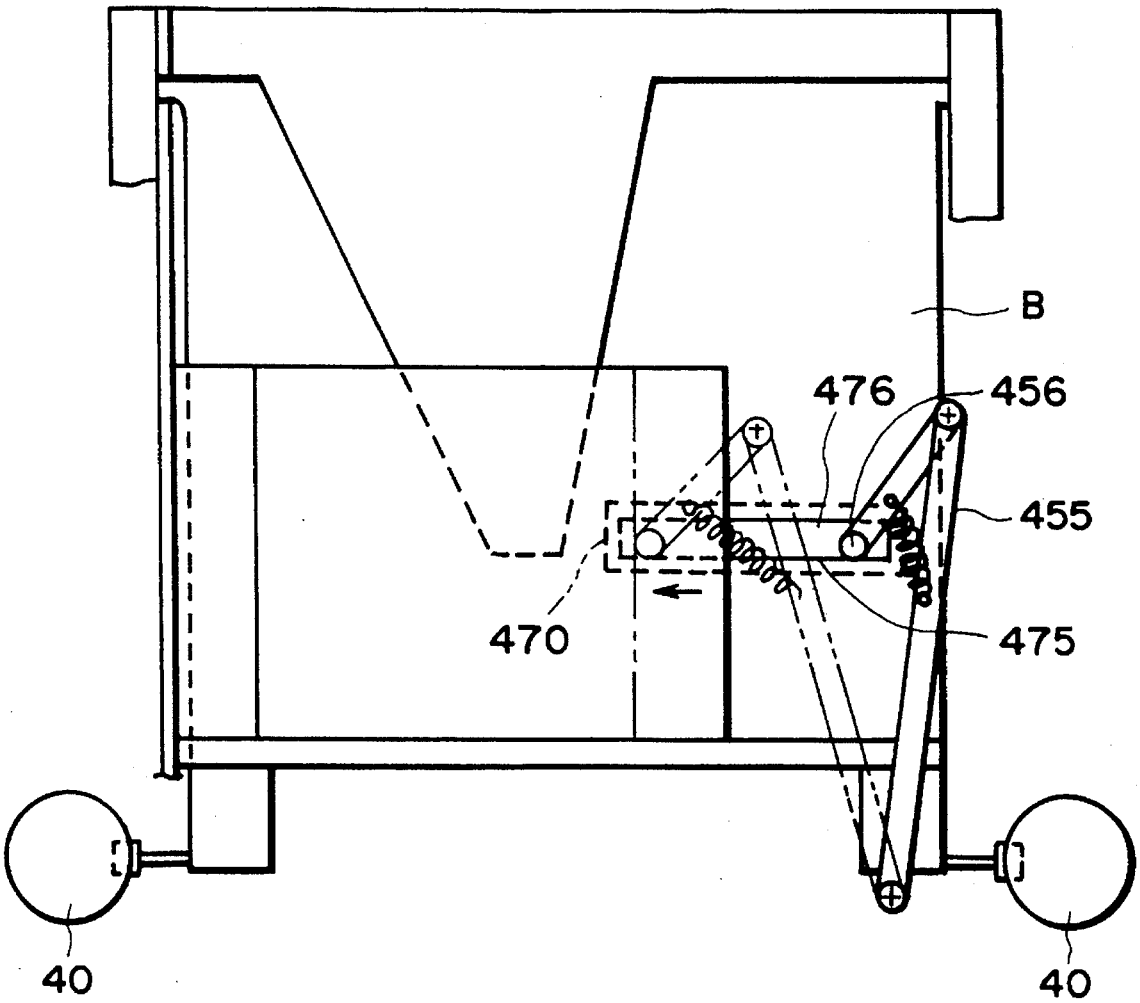
FIG. 34 is a top plan view of an apparatus according to a further embodiment of the present invention.
Figure 35:
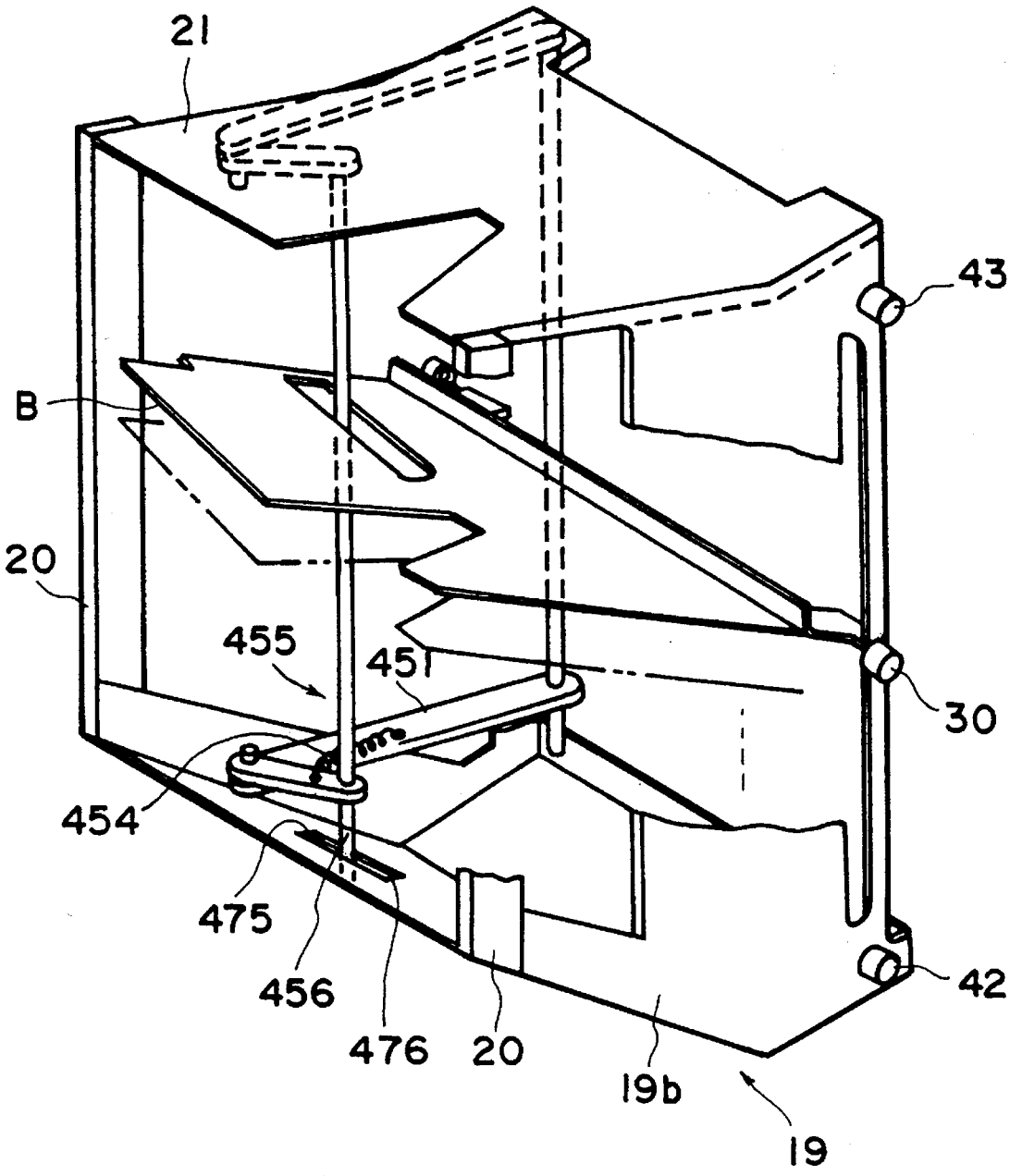
FIG. 35 is a perspective view of the apparatus of FIG. 34.

FIGS. 34 and 35 show a further embodiment, wherein an aligning rod 456 of the aligning member 455 is guided by an end surface (guiding portion) 475 of the guiding member 476 provided on the bin frame 19, rather than the end surface of the bin B cut-away portion. The aligning rod 456 is moved in a similar manner as described above. In this case, the size of the cut-away portion 470 of the bin B is slightly larger than the foregoing embodiment. However, the direction of the sheet pushing can be freely selectable, and therefore, the aligning operation can be performed efficiently. In the foregoing embodiment of FIGS. 32–35, the aligning member is provided only at one side. However, it may be provided at each of the sides.

As described hereinbefore, according to this embodiment of FIGS. 27–36, the locus of movement of the operating arm is determined on the basis of the engagement with the guiding portion. Therefore, the proper movement distance of the operating arm can be assured by properly selecting the movement locus of the operating arm and the pushing direction for the operating arm by the driving means.

Even if the driving means is disposed more or less distant from the sheet receiving tray for the purpose of avoiding the interference with another device, and the size of the operating arm is reduced, the required movement distance of the sheet stacked on the sheet receiving tray, can be properly assured.

In this manner, the sheet feeding means can be disposed outside the sheet receiving tray, and therefore, even in a sheet post-processing apparatus having plural sheet receiving trays, the sheets stacked on the sheet receiving trays can be moved by one sheet moving means by moving the sheet receiving trays vertically and by facing the sheet moving means to all of the sheet receiving trays.

Therefore, the entire structure of the apparatus is simplified, and the reliability and durability are improved.

Simultaneously, the interval between the sheet receiving trays is reduced, thus permitting an increase in the number of sheet trays.

The vertical movement of the second arm is regulated by the engagement thereof with the guiding portion, by which the interval of the adjacent sheet receiving trays when the second arm moves can be reduced.

As described hereinbefore, the size of the second arm or the like can be reduced, and the locus of the movement of the second arm is defined by the guiding portion, and the first and second arms are linked, and therefore, the locus of the movement of the second arm is minimized.

Therefore, even if a cut-away portion is formed in the sheet receiving tray, and the pushing member mounted on the second arm is inserted into the cut-away portion so as to push the sheet out, the size of the cut-away portion can be minimized, thus preventing deterioration of the mechanical strength of the sheet receiving tray and improving the sheet feeding performance.

The advantage of the sheet conveying means of this embodiment (FIGS. 27–36) will be described briefly in comparison with another example shown in FIGS. 37–40.

Figure 39:
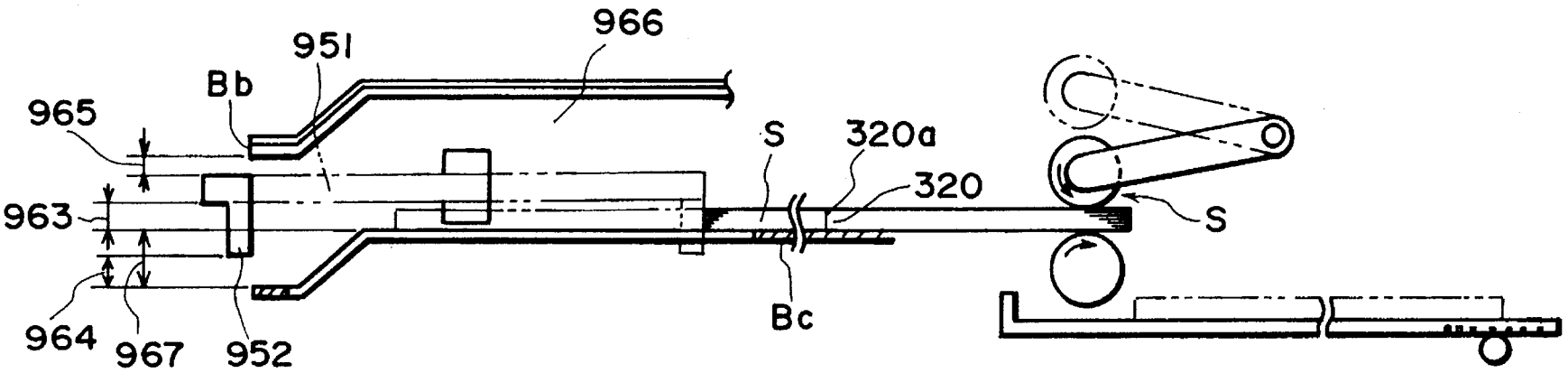
FIG. 39 is a longitudinal sectional view of the apparatus shown in FIG. 38.

In FIG. 39, there is shown a sheet moving means provided with a sliding member 917 slidable on each bin. The sliding member 917 comprises a sheet stacking portion in slidable contact with the bottom surface of the bin and a standing portion extending from the stacking portion. The sliding member 917 is provided for each of the bins. The bin B is vertically movable. At a position corresponding to a bin B at a predetermined level, there is a pushing member 918 for pushing the sliding member 917 for the bin B. At a side to which the sliding member 917 is pushed, there are a grip conveyer 914 and a stack tray 910. The grip conveyer 914 grips the end portion of the sheet set pushed by the sliding member 917, and the grip conveyer 914 carries the sheet set onto the stack tray 910.

Figure 38:
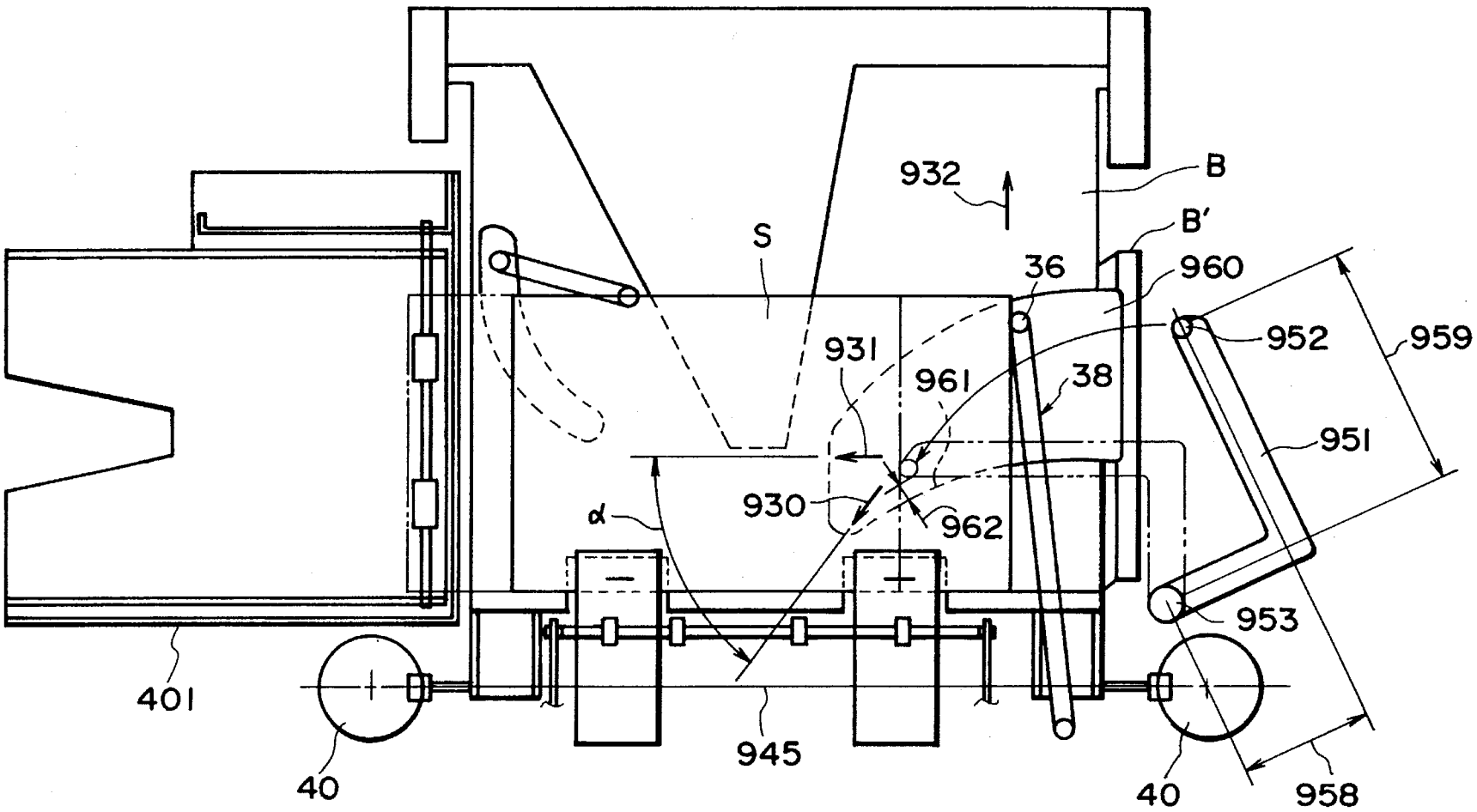
FIG. 38 is a top plan view for comparing two arrangements.

In FIG. 38, there is shown a sheet moving means provided with an L-shaped arm 951. The arm 951 is disposed outside the bin B, and is rotatable about a rotational shaft 953 by an unshown driving means. In bin B, an end B' near the arm 951 is bent downwardly to provide an inclined portion. A cut-away portion 960 is formed extending to the inclined portion. Thus, an end portion 952 projecting to the bin B side (lower side) and mounted to the end portion of the arm 951, enters the cut-away portion 960 without interference with the end B' of the bin. The sheets S on the bin B are pushed to the stacking tray 401. The bin B is vertically movable by a pair of lead cams 40. When the bin B moves vertically, the arm 951 is maintained at a position outside of the bin B, as shown in FIG. 38, and therefore, the interference with the bin B can be avoided. The first aligning member 38 comprises an aligning rod 36 swingable in the cut-away portion 960. By the swinging motion of the aligning rod 36, the edges of the sheets S stacked on the bin B are aligned.

In order to avoid interference with the first aligning member 38, the arm 951 passes an inside of rotation of the aligning rod 36.

Figure 40:
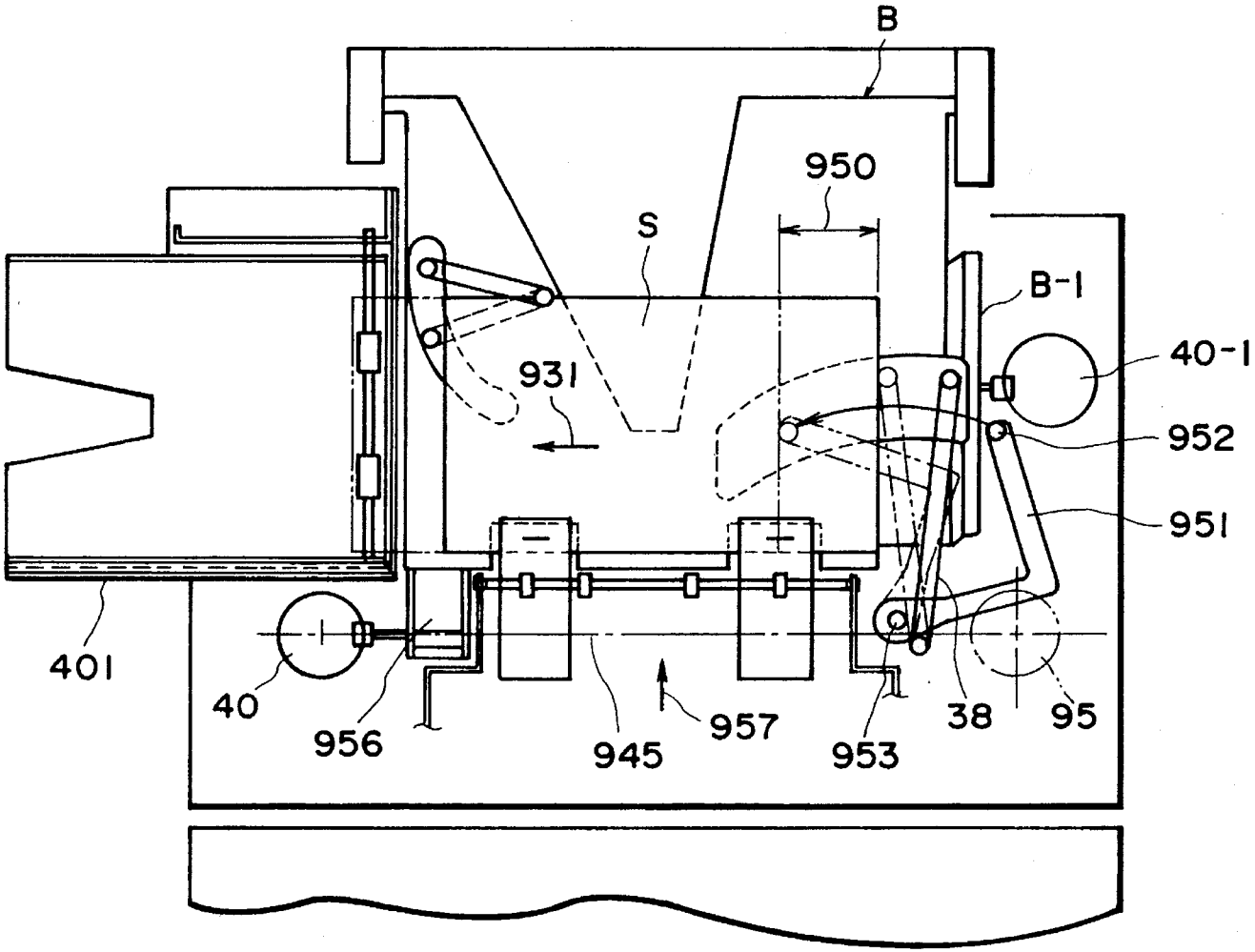
FIG. 40 is a longitudinal sectional view of a third comparative example.

As another method, as shown in FIG. 40, the position of the rotational center 953 of the arm 951 is placed as close as possible to the center of the bin in the sheet moving direction (arrow 931), and the size of the arm 951 is reduced while maintaining the movement distance 950 of the sheets S. Such a method is advantageous from the standpoint of the positional accuracy of the end portion 952, and it is also advantageous in that the moving direction of the end 952 is substantially the same as the sheet moving direction (arrow 931). However, according to the above example of FIGS. 37–40, the following problems arise.

In the sheet post-processing apparatus shown in FIG. 37. A sliding member 917 is provided for each of the bins with the result of high cost. Since the structure is complicated, the reliability and durability are not satisfactory. In addition, the provision of the sliding member 917 necessitates the larger bin intervals, and limits the increase of the number of bins.

In the sheet post-processing apparatus shown in FIG. 38, the rotational center 953 for the arm 951 has to be disposed at a position shown in FIG. 38 to avoid interference with the lead cam 40, and therefore, it is away from the sheets S on the bin B. Therefore, upon the rotation of the arm 951, a deviation occurs (angle $\alpha$) between the movement direction 930 of the end portion 952 and the movement direction 931 of the sheets S, with the result that the moving distance of the sheets S is smaller as compared with the moving distance of the end portion 952.

The movement distance of the sheet S is required to be larger than a predetermined distance, and also, the movement distance of the arm 951 from the stand-by position to the moving position is required to be larger than a predetermined distance and therefore, it is difficult to reduce the length (958, 959) of the arm 951. For this reason, the size of the cut-away portion 960 of the bin B is very large with the result of a reduction in the mechanical strength of the bin B, and in addition, the moment of inertia of the arm 951 increases with the result of an inaccurate stop position of the end portion 952 in the cut-away portion 960 after rotation (inaccuracy of the sheet S pushing-out position). With the increase of the size of the arm 951, the first aligning member 38 becomes bulky. Furthermore, when the length of the arm 951 increases, it becomes difficult to maintain a predetermined height for the level of the end portion 952. Therefore, it is required for prevention of the interference, as shown in FIG. 39, that the distance 963 between the arm 951 and the bin Bc, the distance 964 between the end portion 952 of the arm 951 and the bin Bc and the distance between the arm 951 and the upper bin Bd, are large. Then, the bin interval 966, and the bin step 967 or the like are increased with the result of a bulky apparatus.

As shown in FIG. 40, if the position of the rotational center 953 of the arm 951 is adjacent to the bin center in the sheet conveying direction (arrow 931), there is a likelihood of interference with another device. Therefore, it is not possible, for example, that a rear side lead cam 40 is disposed at a position symmetrical with the front side lead cam 40 (955 position). As shown in FIG. 40, in order to avoid the interference with the arm 951, the front and rear lead cams 40 and 40 are offset.

According to the embodiments of the present invention having been described in conjunction with FIGS. 27–36, the above problems can be avoided.

While the invention has been described with reference to the structures disclosed herein, it is not confined to the details set forth and this application is intended to cover such modifications or changes as may come within the purposes of the improvements or the scope of the following claims.

What is claimed is:

1. A sheet post-processing apparatus, comprising:

at least one tray means for stacking discharged sheets to form a stack of sheets;

stacker means, disposed adjacent to said at least one tray means, for receiving a set of sheets from said at least one tray means;

transfer means for transferring a set of sheets from said at least one tray means to said stacker means;

control means operable in a first mode, in which a set of sheets is transferred from said at least one tray means to said stacker means, and in a second mode, in which the set of sheets remains in said at least one tray means without being transferred to said stacker means, to permit removal of the set of sheets from said at least one tray means; and retracting means, responsive to said control means, for retracting said stacker means to a position where removal of the set of sheets from said at least one tray means is unobstructed by said stacker means, by relative movement between said at least one tray means and said stacker means when said control means is operable in the second mode.

2. An apparatus according to claim 1, wherein said transfer means includes pushing means, responsive to said control means, for pushing the set of sheets in said at least one tray means so that a part of the set of sheets projects outside said at least one tray means when the control means is operable in the first mode, and for not pushing the set of sheets when the control means is operable in the second mode.

3. An apparatus according to claim 1, said transfer means further comprising pushing means, responsive to said control means, for pushing the set of sheets in said at least one tray means so that a part of the set of sheets projects outside of said at least one tray means when the control means is operable in the first and second modes.

4. An apparatus according to either claim 2 or 3, said transfer means further comprising feeding means, responsive to said control means, for feeding a set of sheets projecting from said at least one tray means to said stacker means when said control means is operable in the first mode.

5. An apparatus according to claim 1, wherein said at least one tray means includes a plurality of bin trays of a sorter disposed vertically with intervals between adjacent bin trays, said plurality of bin trays are movable substantially in the vertical direction step-by-step for receiving discharged sheets, said stacker means is fixed at a predetermined position, and said at least one tray means moves up to provide sheet access when said control means is operable in the second mode.

6. An apparatus according to claim 5, wherein said stacker means includes tray position adjusting means for moving said at least one tray means downwardly in accordance with an amount of sheets therein.

7. An apparatus according to claim 1, wherein said tray means is in the form of a plurality of bin trays of a sorter disposed substantially vertically with intervals between adjacent ones, and said stacker means is substantially vertically movably supported at a position corresponding to each of the bin trays, and when the second mode is selected, said stacker means moves to provide a sheet outlet.

8. An apparatus according to claim 1, further comprising aligning means for aligning a sheet in said at least one tray means by pushing one lateral edge of the sheet, and retractable reference means for abutting an other edge of the sheet.

9. An apparatus according to claim 8, further comprising pushing means for pushing a set of aligned sheets out of said at least one tray means.

10. An apparatus according to claim 9, further comprising moving means for moving a set of sheets pushed by said pushing means to said stacker means.

11. An apparatus according to claim 1, further comprising means for stapling a set of sheets stacked in said at least one tray means.

12. An apparatus according to claim 11, further comprising aligning means for aligning a sheet in a set of sheets by pushing one lateral edge of the sheet, and retractable reference means for abutting an other edge of the sheet.

13. An apparatus according to claim 12, further comprising means for simultaneously shifting sets of sheets in said at least one tray means aligned by said aligning means.

14. An apparatus according to claim 1, wherein said transfer means transfers a set of sheets from said at least one tray means to said stacker means when the control means is operable in the first mode, and does not transfer the set of sheets when the control means is operable in the second mode.

15. An apparatus according to claim 1, wherein said transfer means transfers the set of sheets from said at least one tray means to said stacker means when the control means is operable in the first mode, and transfers the set of sheets to a position such that a part of the set of sheets is projected out of said at least one tray means when the control means is operable in the second mode.

16. An apparatus according to claim 15, wherein said transfer means comprises pushing means responsive to said control means for pushing a set of sheets in said at least one tray means so that a part of the set of sheets projects outside said at least one tray means when said control means is operable in the first and second modes, and further comprising feeding means for feeding a set of sheets projecting outside said at least one tray means to said stacker means when the control means is operable in the first mode.

17. An apparatus according to claim 14, wherein said transfer means comprises pushing means responsive to said control means for pushing a set of sheets in said at least one tray means so that a part of the set of sheets projects outside said at least one tray means when the control means is operable in the first mode, and for not pushing the set of sheets when said control means is operable in the second mode; said apparatus further comprising feeding means for feeding a set of sheets projecting outside said at least one tray means to said stacker means.

18. An apparatus according to claim 1, wherein said at least one tray means includes a plurality of bin trays of a sorter disposed with intervals between adjacent bin trays.

19. An image forming apparatus, comprising:

an image forming station;

at least one tray means for stacking sheets discharged from said image forming station to form a set of sheets;

stacker means, disposed adjacent to said at least one tray means, for receiving a set of sheets from said at least one tray means;

transfer means for transferring a set of sheets from said at least one tray means to said stacker means;

control means operable in a first mode, in which a set of sheets is transferred from said at least one tray means to said stacker means, and in a second mode, in which the set of sheets remains in said at least one tray means without being transferred to said stacker means, to permit removal of the set of sheets from said at least one tray means; and retracting means, responsive to said control means, for retracting said stacker means to a position where removal of the set of sheets from said at least one tray means is unobstructed by said stacker means, by relative movement between said at least one tray means and said stacker means when said control means is operable in the second mode.

20. A sheet post-processing apparatus, comprising:

a plurality of single tray means for stacking a number of sheets to be discharged in a set of sheet;

stacker means, disposed adjacent to said plurality of single tray means, for receiving a set of sheets from said tray means;

transfer means for transferring a set of sheets from said at least one tray means to said stacker means;

counter means for providing number information relating to the number of sheets to be discharged; and control means operable in a first mode, in which a set of sheets is transferred to said stacker means, and in a second mode, in which the set of sheets remains in said plurality of single tray means without being transferred to said stacker means, to permit removal of the set of sheets from said plurality of single tray means;

wherein, when a value of the number information is not greater than the number of said plurality of single tray means, said control means is operable in the second mode.

21. An apparatus according to claim 20, wherein said stacker means is provided with tray means that gradually moves down in accordance with the number of sheets thereon.

22. An apparatus according to claim 21, wherein said plurality of single tray means faces said stacker means for step-by-step processing, and pushing means is provided to push sets of sheets to said stacker means.

23. An image forming apparatus, comprising:

an image forming station;

a plurality of single tray means for stacking a number of sheets discharged from said image forming station to form a set of sheets;

stacker means, disposed adjacent to said plurality of single tray means, for receiving a set of sheets from said plurality of single tray means;

transfer means for transferring a set of sheets from said plurality of single tray means to said stacker means;

counter means for providing number information relating to the number of sheets discharged; and control means operable in a first mode, in which a set of sheets is transferred from said plurality of single tray means to said stacker means, and in a second mode, in which the set of sheets remains in said plurality of single tray means without being transferred to said stacker means, to permit removal of the set of sheets from said plurality of single tray means;

wherein, when a value of the number information is not greater than the number of said plurality of single tray means, said control means is operable in the second mode.

24. A sheet post-processing apparatus, comprising:

a plurality of single tray means for stacking discharged sheets to form a set of sheets;

stacker means, disposed adjacent to said plurality of single tray means, for receiving a set of sheets from said plurality of single tray means;

transfer means for transferring a set of sheets from said plurality of single tray means to said stacker means;

counter means for providing number information relating to the number of sheets discharged; and control means operable in a first mode, in which a set of sheets is transferred from said plurality of single tray means to said stacker means, and in a second mode, in which the set of sheets remains in said plurality of single tray means without being transferred to said stacker means, to permit removal of the set of sheets from said plurality of single tray means;

wherein, when a value of the number information is not greater than a predetermined number, said control means is operable in the second mode and, when the value of the number information is greater than the predetermined number, said control means is operable in the first mode.

25. An image forming apparatus, comprising:

an image forming station;

a plurality of single tray means for stacking sheets discharged from said image forming station to form a set of sheets;

stacker means, disposed adjacent to said plurality of tray means, for receiving a set of sheets from said plurality of single tray means;

transfer means for transferring a set of sheets from said plurality of single tray means to said stacker means;

counter means for providing number information relating to the number of sheets discharged; and control means operable in a first mode, in which a set of sheets is transferred from said plurality of single tray means to said stacker means, and in a second mode, in which the set of sheets remains in said plurality of single tray means without being transferred to said stacker means, to permit removal of the set of sheets from said plurality of single tray means;

wherein, when a value of the number information is not greater than a predetermined number, said control means is operable in the second mode, and when the value of the number information is greater than the predetermined number, said control means is operable in the first mode.

* * * * *

UNITED STATES PATENT AND TRADEMARK OFFICE

CERTIFICATE OF CORRECTION

PATENT NO. : 5,556,251

DATED : September 17, 1996

INVENTOR(S) : MASAKAZU HIROI, ET AL.

It is certified that error appears in the above-indentified patent and that said Letters Patent is hereby corrected as shown below:

On the title page, item [56],

"Taneda" should read --Taneda et al.--.
"Hiroi" should read --Hiroi et al.--.

Column 1

Line 37, "than" should read --than that--.
Line 46, "sheet" should read --sheets--.

Column 2

Line 13, "said" should read --the--.
Line 29, "image an" should read --an image--
Line 42, "prising;" should read --prising:--.

Column 3

Line 3, "when" should read --when the--, and "the" should be deleted.

Column 5

Line 40, "the" (last occurrence) should read --this--.
Line 40, "this" should read -- the --.

UNITED STATES PATENT AND TRADEMARK OFFICE

CERTIFICATE OF CORRECTION

PATENT NO. : 5,556,251

DATED : September 17, 1996

INVENTOR(S) : MASAKAZU HIROI, ET AL.

It is certified that error appears in the above-indentified patent and that said Letters Patent is hereby corrected as shown below:

Column 7

Line 5, "a" should read --when a--.
Line 66, "an" should read --the--.
Line 67, "the" should read --an--.

Column 8

Line 18, "a" should read --an--.
Line 44, "mode" should read --mode,--.
Line 45, "mode" should read --mode,--.

Column 9

Line 1, "and" should read --end--.
Line 4, "of" (second occurrence) should read --is--.
Line 18, "gear grain)" should read --gear train)--.
Line 65, "to" (second occurrences) should be deleted.

Column 10

Line 10, "of" (second occurrence) should be deleted.
Line 11, "position" should read --position of--.

UNITED STATES PATENT AND TRADEMARK OFFICE

CERTIFICATE OF CORRECTION

PATENT NO. : 5,556,251

DATED : September 17, 1996

INVENTOR(S) : MASAKAZU HIROI, ET AL.

It is certified that error appears in the above-indentified patent and that said Letters Patent is hereby corrected as shown below:

Column 11

Line 3, "shows" should read --show--.
Line 10, "takes" should read --take--.
Line 19, "sheet" should read --sheets--.
Line 40, "discharge then" should read --discharging them--.
Line 49, "swings" should read --is swung--.

Column 12

Line 22, "the" should read --a--, and "a" should be deleted.

Column 13

Line 14, "size." should read --sizes.--.
Line 37, "out" should be deleted.
Line 46, "sheet" should read --sheets--.
Line 63, "15C" should read --15C and 16--.

Column 14

Line 27, "is" (second occurrence) should read --is a--.
Line 65, "The" should read --In the--.

UNITED STATES PATENT AND TRADEMARK OFFICE

CERTIFICATE OF CORRECTION

PATENT NO. : 5,556,251 Page 4 of 7

DATED : September 17, 1996

INVENTOR(S) : MASAKAZU HIROI, ET AL.

It is certified that error appears in the above-indentified patent and that said Letters Patent is hereby corrected as shown below:

Column 15

Line 7, "applies" should read --apply--.
Line 44, "is" should read --the rod is--.
Line 45, "are" should read --is--.
Line 56, "a predetermined by the" should read --the predetermined--.
Line 59, "the sheet" (second occurrence) should read --the set of sheets--.
Line 62, "are" should read --is--.
Line 64, "slacks" should read --slackens--.

Column 16

Line 2, "are" should read --is--.
Line 12, "sheet" should read --sheets--.
Line 30, "413" should read --S413--.

Column 17

Line 1, "then" should be deleted.
Line 2, "above," should read --above, then--.

Column 18

Line 36, "standing. Therefore," should read --standing,--.
Line 45, "operator." should read --operator standing.--
Line 49, "a should read --an--.
Line 62, "the" (first occurrence) should read --if the--.

UNITED STATES PATENT AND TRADEMARK OFFICE

CERTIFICATE OF CORRECTION

PATENT NO. : 5,556,251 Page 5 of 7

DATED : September 17, 1996

INVENTOR(S) : MASAKAZU HIROI, ET AL.

It is certified that error appears in the above-indentified patent and that said Letters Patent is hereby corrected as shown below:

Column 19

Line 15, "there of" should read --thereof--.
Line 30, "the" (second occurrence) should read --a--.

Column 20

Line 24, "5" should read --S--.
Line 59, "position, the" should read --positions, the set of--.

Column 21

Line 20, "another" should read --other--.
Line 44, "extend" should read --extends--.
Line 47, "then" should be deleted.
Line 48, "the" (first occurrence) should read --then the--.
Line 62, "the" should read --and the--.

Column 22

Line 58, "the" (first occurrence) should read --if the--.

Column 23

Line 5, "303-1 and 303′ " should read --303 and 303-1--.
Line 6, "303-1" should read --303--.
Line 20, "303-1 and 303′ " should read --303 and 303-1--.

UNITED STATES PATENT AND TRADEMARK OFFICE

CERTIFICATE OF CORRECTION

PATENT NO. : 5,556,251

DATED : September 17, 1996

INVENTOR(S) : MASAKAZU HIROI, ET AL.

It is certified that error appears in the above-indentified patent and that said Letters Patent is hereby corrected as shown below:

Column 24

Line 30, "sheet" should read --sheet being--.
Line 35, "abutted" should read --abutting--.

Column 25

Line 32, "303" should read --303-1--.
Line 44, "37" should read --27--.
Line 45, "FIGS." should read --FIG.--.

Column 26

Line 12, "member" should read --members--.
Line 34, "9" should read --9, and--.
Line 56, "there of" should read --thereof--.

Column 28

Line 54, "37." should read --37,--.
Line 55, "A" should read --a--.

Column 29

Line 29, "40" should read --40-1--.
Line 33, "40" (second occurrence) should read --40-1--.

UNITED STATES PATENT AND TRADEMARK OFFICE

CERTIFICATE OF CORRECTION

PATENT NO. : 5,556,251 Page 7 of 7

DATED : September 17, 1996

INVENTOR(S) : MASAKAZU HIROI, ET AL.

It is certified that error appears in the above-indentified patent and that said Letters Patent is hereby corrected as shown below:

Column 30

Line 67, "transfers" should read --pushes--.

Column 31

Line 52, "sheet;" should read --sheets;--.

Signed and Sealed this

Fifteenth Day of April, 1997

Bruce Lehman

*Attest:*

BRUCE LEHMAN

*Attesting Officer*

*Commissioner of Patents and Trademarks*